US006865534B1

(12) United States Patent
Murashima et al.

(10) Patent No.: US 6,865,534 B1
(45) Date of Patent: Mar. 8, 2005

(54) SPEECH AND MUSIC SIGNAL CODER/DECODER

(75) Inventors: Atsushi Murashima, Tokyo (JP); Kazunori Ozawa, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/719,826

(22) PCT Filed: Jun. 15, 1999

(86) PCT No.: PCT/JP99/03185

§ 371 (c)(1),
(2), (4) Date: Feb. 12, 2001

(87) PCT Pub. No.: WO99/66497

PCT Pub. Date: Dec. 23, 1999

(30) Foreign Application Priority Data

Jun. 15, 1998 (JP) ..... 10-166573

(51) Int. Cl.[7] ..... G10L 13/02

(52) U.S. Cl. ..... 704/262; 702/262; 702/219

(58) Field of Search ..... 704/219, 220, 704/222, 223, 227, 228, 229, 230, 262, 264, 265, 269, 500–504

(56) References Cited

U.S. PATENT DOCUMENTS

| | | | | | |
|---|---|---|---|---|---|
| 5,526,464 | A | * | 6/1996 | Mermelstein | 704/219 |
| 5,778,335 | A | * | 7/1998 | Ubale et al. | 704/219 |
| 5,819,212 | A | * | 10/1998 | Matsumoto et al. | 704/219 |
| 6,345,246 | B1 | * | 2/2002 | Moriya et al. | 704/219 |

FOREIGN PATENT DOCUMENTS

| | | |
|---|---|---|
| JP | 2-123828 | 5/1990 |
| JP | 4-301900 | 10/1992 |
| JP | 5-113799 | 5/1993 |
| JP | 5-216500 | 8/1993 |
| JP | 5265492 | 10/1993 |
| JP | 7-273659 | 10/1995 |
| JP | 8263096 | 10/1996 |
| JP | 946233 | 2/1997 |
| JP | 9-127985 | 5/1997 |
| JP | 9127987 | 5/1997 |
| JP | 9127994 | 5/1997 |
| JP | 9-127995 | 5/1997 |
| JP | 9130260 | 5/1997 |
| JP | 9-281995 | 10/1997 |
| JP | 10-11094 | 1/1998 |
| JP | 10-63297 | 3/1998 |

OTHER PUBLICATIONS

GSM 06.60 version 6.0.1 Release 1997, "Digital Cellular Telecommunications System (Phase 2+); Enhanced Full Rate (EFR) Speech Transcoding" (ETSI EN 300 726, 2000) pp. 23–26.

K. Ozawa and M. Serizawa, "High Quality Multi–Pulse Based CELP Speech Coding at 6.4 kbit/s and Its Subjective Evaluation" (Proceeding of ICASSP, pp. 153–156, 1998).

R.E. Crochiere and L.R. Rabiner "Multirate Digital Signal Processing" (Prentice–Hall Signal Processing Series, pp. 26–43, 1983).

(List continued on next page.)

*Primary Examiner*—Susan McFadden
*Assistant Examiner*—Huyen X. Vo
(74) *Attorney, Agent, or Firm*—Dickstein, Shapiro, Morin & Oshinsky, LLP.

(57) ABSTRACT

It is an object of the invention to excellently code a speech and music signal over all of bands in a speech and music signal code decoding apparatus having a band divided constitution. In order to achieve the object, a residue vector is generated by using an inverse filter (230 of FIG. 3) from a difference vector outputted from a first differencer (180 of FIG. 3). A band selecting circuit (250 of FIG. 3) generates n pieces of subvectors by using a component included in an arbitrary band in the residue vector subjected to orthogonal transformation. An orthogonal transformation coefficient quantizing circuit (260 of FIG. 3) quantizes n pieces of the subvectors.

24 Claims, 32 Drawing Sheets

OTHER PUBLICATIONS

M.R. Schroeder and Bishnu S. Atal "Code excited linear prediction (CELP): High quality speech at very low bit rates" (Proceeding of ICASSP, pp. 937–940, 1985).
A. Ubale and Allen Gersho "Multi–band CELP Coding of Speech and Music" (Proceeding of IEEE Workshop on Speech Coding for Telecommunications, pp. 101–102, 1997.
ITU–T Recommendation G.729, "Coding of Speech at 8 kbits/s Using Conjugate–Structure Algebraic–Code–Excited Linear–Prediction (CS–ACSLP)", pp. 9–22, 1996.
Japanese Office Action dated May 21, 2002 (w/ English translation of relevant portion).
Japanese Office Action issued Jun. 3, 2003 (w/ English translation of relevant portion.
Atsushi Murashima, et al., "Wideband Audio Coding Based on a Subband CELP with Pulse Excitations Using Common Pulse Positions," C&C Media Research Laboratories, NEC Corporation (1998), p. 235.
Atsushi Murashima, et al., "Wideband Audio Coding Based on a Subband CELP with Frequency–domain Excitation Coding," C&C Media Research Laboratories, NEC Corporation, Proceedings of the 1998 Information and Systems Society Conference of IEICE, (1998), p. 322.

* cited by examiner

SPEECH AND MUSIC SIGNAL CODER/DECODER

TECHNICAL FIELD

The present invention relates to a coder and a decoder for transmitting a speech and music signal at a low bit rate.

BACKGROUND OF THE INVENTION

As a method for coding a speech signal at medium and low bit rates at a high efficiency, there is widely used a method for coding a speech signal by separating the speech signal into a linear prediction filter and a drive sound source signal (sound source signal) thereof.

CELP (Code Excited Linear Prediction) is one of the representative methods. In CELP, a synthesized speech signal (reproduction signal) is generated by driving a linear prediction filter set with a linear prediction coefficient calculated by subjecting input speech to a linear prediction analysis by a sound source signal represented as a sum of a signal representative of a pitch period of speech and a noise-like signal.

With regard to CELP, a description is given in M. R. Schroeder and Bishnu A tal "Code excited linear prediction (CELP): High quality speech at very low bit rates" (Proceeding of ICASSP, pp. 937–940, 1985) (Reference 1). Further, a coding performance with regard to a music signal can be improved by constructing CELP, mentioned above, by a band division constitution. According to the constitution, a reproduction signal is generated by driving a linear prediction synthesis filter by an excitation signal provided by adding sound source signals in correspondence with respective bands.

With regard to CELP having the band division constitution, a description is given in A. Ubale and Allen Gersho "Multi-band CELP Coding of Speech and Music" (Proceeding of IEEE Workshop on Speech Coding for Telecommunications, pp. 101–102, 1997 (Reference 2).

FIG. 1 is a block diagram showing an example of a conventional speech and music signal coder. Here, for simplicity, a number of bands is set to 2. An input signal (input vector) generated by sampling speech or music signals and summarizing a plurality of the samples in one vector as one frame, is inputted from an input terminal 10.

A linear prediction coefficient calculating circuit 170 is inputted with the input vector from the input terminal 10. The linear prediction coefficient calculating circuit 170 carries out a linear prediction analysis with regard to the input vector and calculates a linear prediction coefficient. Further, the linear prediction coefficient calculating circuit 170 quantizes the linear prediction coefficient and calculates a quantized linear prediction coefficient. The linear prediction coefficient is outputted to a weighting filter 140 and a weighting filter 141. An index in correspondence with the quantized linear prediction coefficient is outputted to a linear prediction synthesis filter 130, a linear prediction synthesis filter 131 and a code outputting circuit 190.

A first sound source generating circuit 110 is inputted with an index outputted from a first minimizing circuit 150. The first sound source generating circuit 110 reads a first sound source vector in correspondence with the index from a table stored with a plurality of sound source vectors and outputs the first sound source vector to a first gain circuit 160.

A second sound source generating circuit 111 is inputted with an index outputted from a second minimizing circuit 151. A second sound source vector in correspondence with the index is read from a table stored with a plurality of sound source vectors and is outputted to a second gain circuit 161.

The first gain circuit 160 is inputted with the index outputted from the first minimizing circuit 150 and the first sound source vector outputted from the first sound source generating circuit 110. The first gain circuit 160 reads a first gain in correspondence with the index from a table stored with a plurality of values of gains. Thereafter, the first gain circuit 160 multiplies the first gain by the first sound source vector and generates a third sound source vector and outputs the third sound source vector to a first band pass filter 120.

The second gain circuit 161 is inputted with the index outputted from the second minimizing circuit 151 and the second sound source vector outputted from the second sound source generating circuit 111. The second gain circuit 161 reads a second gain in correspondence with the index from a table stored with a plurality of values of gains. Thereafter, the second gain circuit 161 multiplies the second gain by the second sound source vector and generates a fourth sound source vector and outputs the fourth sound source vector to a second band pass filter 121.

The first band pass filter 120 is inputted with the third sound source vector outputted from the first gain circuit 160. A band of the third sound source vector is restricted to a first band by the filter to thereby generate a first excitation vector. The first band pass filter 120 outputs the first excitation vector to the linear prediction synthesis filter 130.

The second band pass filter 121 is inputted with the fourth sound source vector outputted from the second gain circuit 161. A band of the fourth sound source vector is restricted to a second band by the filter to thereby generate a second excitation vector. The second band pass filter 121 outputs the second excitation vector to the linear prediction synthesis filter 131.

The linear prediction synthesis filter 130 is inputted with the first excitation vector outputted from the first band pass filter 120 and an index in correspondence with the quantized linear prediction coefficient outputted from the linear prediction coefficient calculating circuit 170. The linear prediction synthesis filter 130 reads the quantized linear prediction coefficient in correspondence with the index from a table stored with a plurality of the quantized linear prediction coefficients. By driving the filter set with the quantized linear prediction coefficient by the first excitation vector, a first reproduction signal (reproduced vector) is generated. The first reproduced vector is outputted to a first differencer 180.

The linear prediction synthesis filter 131 is inputted with the second excitation vector outputted from the second band pass filter 121 and an index in correspondence with the quantized linear prediction coefficient outputted from the linear prediction coefficient calculating circuit 170. The linear prediction synthesis filter 131 reads the quantized linear prediction coefficient in correspondence with the index from a table stored with a plurality of quantized linear prediction coefficients. By driving the filter set with the quantized linear prediction coefficient by the second excitation vector, a second reproduced vector is generated. The second reproduced vector is outputted to a second differencer 181.

The first differencer 180 is inputted with the input vector via the input terminal 10 and is inputted with the first reproduced vector outputted from the linear prediction synthesis filter 130. The first differencer 180 calculates a difference between the input vector and the first reproduced vector. The difference is outputted to the weighting filter 140 and the second differencer 181 as a first difference vector.

The second differencer 181 is inputted with the first difference vector from the first differencer 180 and is inputted with the second reproduced vector outputted from the linear prediction synthesis filter 131. The second differencer 181 calculates a difference between the first difference vector and the second reproduced vector. The difference is outputted to the weighting filter 141 as a second difference vector.

The weighting filter 140 is inputted with the first difference vector outputted from the first differencer 180 and the linear prediction coefficient outputted from the linear prediction coefficient calculating circuit 170. The weighting filter 140 generates a weighting filter in correspondence with an auditory characteristic of human being by using the linear prediction coefficient and drives the above-described weighting filter by the first difference vector. By the above-described operation of the weighting filter 140, a first weighted difference vector is generated. The first weighted difference vector is outputted to the first minimizing circuit 150.

The weighting filter 141 is inputted with the second difference vector outputted from the second differencer 181 and the linear prediction coefficient outputted from the linear prediction coefficient calculating circuit 170. The weighting filter 141 generates a weighting filter in correspondence with the auditory characteristic of human being by using the linear prediction coefficient and drives the above-described weighting filter by the second difference vector. By the above-described operation of the weighting filter 141, a second weighted difference vector is generated. The second weighted difference vector is outputted to the second minimizing circuit 151.

The first minimizing circuit 150 successively outputs indexes in correspondence with all of the first sound source vectors stored in the first sound source generating circuit 110 to the first sound source generating circuit 110 and successively outputs indexes in correspondence with all of the first gains stored in the first gain circuit 160 to the first gain circuit 160. Further, the first minimizing circuit 150 is successively inputted with the first weighted difference vector outputted from the weighting filter 140. The first minimizing circuit 150 calculates a norm thereof. The first minimizing circuit 150 selects the first sound source vector and the first gain to minimize the norm and outputs an index in correspondence with these to the code outputting circuit 190.

The second minimizing circuit 151 successively outputs indexes in correspondence with all of the second sound source vectors stored in the second sound source generating circuit 111 to the second sound source generating circuit 111 and successively outputs indexes in correspondence with all of the second gains stored in the second gain circuit 161 to the second gain circuit 161. Further, the second minimizing circuit 151 is successively inputted with the second weighted difference vector outputted from the weighting filter 141. The second minimizing circuit 151 calculates a norm thereof. The second gain circuit 161 selects the second sound source vector and the second gain to minimize the norm and outputs an index in correspondence with these to the code outputting circuit 190.

The code outputting circuit 190 is inputted with an index in correspondence with the quantized linear prediction coefficient outputted from the linear prediction coefficient calculating circuit 170, inputted with indexes outputted from the first minimizing circuit 150 in correspondence with respectives of the first sound source vector and the first gain and inputted with indexes outputted from the second minimizing circuit 151 in correspondence with respectives of the second sound source vector and the second gain. The code outputting circuit 190 converts the respective indexes into codes of bit series and outputs the respective indexes after conversion via an output terminal 20.

FIG. 2 is a block diagram showing an example of a conventional speech and music signal decoding apparatus. A code inputting circuit 310 is inputted with a code in a bit series from an input terminal 30.

The code input circuit 310 converts the code in the bit series inputted from the input terminal 30 into indexes. An index in correspondence with a first sound source vector is outputted to a first sound source generating circuit 110. An index in correspondence with a second sound source vector is outputted to a second sound source generating circuit 111. An index in correspondence with a first gain is outputted to a first gain circuit 160. An index in correspondence with a second gain is outputted to a second gain circuit 161. An index in correspondence with a quantized linear prediction coefficient is outputted to a linear prediction synthesis filter 130 and a linear prediction synthesis filter 131.

The first sound source generating circuit 110 is inputted with the index outputted from the code inputting circuit 310. The first sound source generating circuit 110 reads the first sound source vector in correspondence with the index from a table stored with a plurality of sound source vectors and outputs the sound source vector to the first gain circuit 160.

The second sound source generating circuit 111 is inputted with the index outputted from the code inputting circuit 310. The second sound source generating circuit 111 reads the second sound source vector in correspondence with the index from a table stored with a plurality of sound source vectors and outputs the second sound source vector to the second gain circuit 161.

The first gain circuit 160 is inputted with the index outputted from the code inputting circuit 310 and the first sound source vector outputted from the first sound source generating circuit 110. The first gain circuit 160 reads a first gain in correspondence with the index from a table stored with a plurality of values of gains. The first gain circuit 160 generates a third sound source vector by multiplying the first gain by the first sound source vector. The third sound source vector is outputted to a first band pass filter 120.

The second gain circuit 161 is inputted with the index outputted from the code inputting circuit 310 and the second sound source vector outputted from the second sound source generating circuit 111. The second gain circuit 161 reads a second gain in correspondence with the index from a table stored with a plurality of values of gains. Thereafter, the second gain circuit 161 generates a fourth sound source vector by multiplying the second gain by the second sound source vector. The fourth sound source vector is outputted to a second band pass filter 121.

The first band pass filter 120 is inputted with the third sound source vector outputted from the first gain circuit 160. A band of the third sound source vector is restricted to a first band by the filter and the third sound source vector generates a first excitation vector. The first band pass filter 120 outputs the first excitation vector to the linear prediction synthesis filter 130.

The second band pass filter 121 is inputted with the fourth sound source vector outputted from the second gain circuit 161. A band of the fourth sound source vector is restricted to a second band by the filter and accordingly, the second band pass filter 121 generates a second excitation vector. The second band pass filter 121 outputs the second excitation vector to the linear prediction synthesis filter 131.

The linear prediction synthesizing vector 130 is inputted with the first excitation vector outputted from the first band pass filter 120 and the index in correspondence with the quantized linear prediction coefficient outputted from the code inputting circuit 310. The quantized linear prediction coefficient in correspondence with the index is read from a table stored with a plurality of quantized linear prediction coefficients. Thereafter, the linear prediction synthesis filters 130 generates a first reproduced vector by driving the filter set with the quantized linear prediction coefficient by the first excitation vector. The first reproduced vector is outputted to an adder 182.

The linear prediction synthesis filter 131 is inputted with the second excitation vector outputted from the second band pass filter 121 and the index in correspondence with the quantized linear prediction coefficient outputted from the code inputting circuit 310. The quantized linear prediction coefficient in correspondence with the index is read from a table stored with a plurality of quantized linear prediction coefficients. The linear prediction synthesis filter 131 generates a second reproduced vector by driving the filter set with the quantized linear prediction coefficient by the second excitation vector. The second reproduced vector is outputted to the adder 182.

The adder 182 is inputted with the first reproduced vector outputted from the linear prediction synthesis filter 130 and the second reproduced vector outputted from the linear prediction synthesis filter 131. A sum of these is calculated. The adder 182 outputs the sum of the first reproduced vector and the second reproduced vector as a third reproduced vector via an output terminal 40.

According to the above-described conventional speech and music signal coder, there is constructed the constitution in which the reproduction signal is generated by driving the linear prediction synthesis filters calculated from the input signal by the excitation signal provided by adding the excitation signal having a band characteristic in correspondence with a low region of the input signal and the excitation signal having a band characteristic in correspondence with a high region of the input signal and accordingly, a coding operation based on CELP is carried out in a band belonging to a high frequency region and accordingly, coding performance is deteriorated in the band belonging to the high frequency region and therefore, coding quality of the speech and music signal in all of bands is deteriorated.

The reason is that a signal in the band belonging to the high frequency region is provided with a property significantly different from speech and therefore, according to CELP modeling a procedure of generating speech, the signal in the band belonging to the high frequency region cannot be generated with a high accuracy.

It is an object of the invention to provide a speech and music signal coder capable of resolving the above-described problem and coding a speech and music signal over all of bands.

DISCLOSURE OF THE INVENTION

An apparatus of coding a speech and music signal according to the invention (apparatus of the invention 1) generates a first reproduction signal by driving a linear prediction synthesis filter calculated from an input signal by an excitation signal in correspondence with a first band, generates a residual signal by driving an inverse filter of the linear prediction synthesis filter by a differential signal of the input signal and the first reproduction signal and codes a component in correspondence with a second band in the residual signal after subjecting the component to orthogonal transformation.

Specifically the apparatus of the invention 1 includes means (110, 160, 120, 130 of FIG. 3) for generating a first reproduction signal by driving the linear prediction synthesis filter by the excitation signal in correspondence with the first band, means (180, 230 of FIG. 3) for generating a residual signal by driving an inverse filter of the linear prediction synthesis filter by a differential signal of the input signal and the first reproduction signal, and means (240, 250, 260 of FIG. 3) for coding a component in correspondence with the second band in the residual signal after subjecting the component to orthogonal transformation.

An apparatus of coding of a speech and music signal according to the invention (apparatus of the invention 2) generates a first and a second reproduction signal by driving a linear prediction synthesis filter calculated from an input signal by excitation signals in correspondence with a first and a second band, generates a residual signal by driving an inverse filter of the linear prediction synthesis filter by a differential signal of a signal produced by adding the first and the second reproduction signals and the input signal and codes a component in correspondence with a third band in the residual signal after subjecting the component to orthogonal transformation.

Specifically, the apparatus of the invention 2 includes means (1001, 1002 of FIG. 10) for generating a first and a second reproduction signal by driving the linear prediction synthesis filter by the excitation signals in correspondence with a first one and a second one of the bands, and means (1003 of FIG. 10) for generating a residual signal by driving an inverse filter of the linear prediction synthesis filter by a differential signal of a signal produced by adding the first and the second reproduction signals and the input signal and coding a component in correspondence with a third one of the bands in the residual signal after subjecting the component to orthogonal transformation.

An apparatus of coding a speech and music signal according to the invention (apparatus of the invention 3) generates a first through an (N−1)-th reproduction signal by driving a linear prediction synthesis filter calculated from an input signal by excitation signals in correspondence with a first through an (N−1)-th band, generates a residual signal by driving an inverse filter of the linear prediction synthesis filter by a differential signal of a signal produced by adding a first through an (N−1)-th reproduction signal and the input signal and codes a component in correspondence with an N-th band in the residual signal after subjecting the component to orthogonal transformation.

Specifically, the apparatus of the invention 3 includes means (1001, 1004 of FIG. 11) for generating a first through an (N−1)-th reproduction signal by driving the linear prediction synthesis filter by excitation signals in correspondence with a first through an (N−1)-th band, and means (1005 of FIG. 11) for generating a residual signal by driving an inverse filter of the linear prediction synthesis filter by a differential signal of a signal produced by adding the first through the (N−1)-th reproduction signals and the input signal and coding a component in correspondence with an N-th band in the residual signal after subjecting the component to orthogonal transformation.

An apparatus of coding a speech and music signal according to the invention (apparatus of the invention 4) generates, in second coding operation, a residual signal by driving an inverse filter of a linear prediction synthesis filter calculated from an input signal by a differential signal of a first coded decoding signal and the input signal and codes a component in correspondence with an arbitrary band in the residual signal after subjecting the component to orthogonal transformation.

Specifically, the apparatus of the invention 4 includes means (180 of FIG. 13) for calculating a difference of a first coded decoding signal and the input signal and means (1002 of FIG. 13) for generating a residual signal by driving an inverse filter of the linear prediction synthesis filter calculated from the input signal by the differential signal and coding a component in correspondence with an arbitrary one of the bands in the residual signal after subjecting the component to orthogonal transformation.

An apparatus of coding a speech and music signal according to the invention (apparatus of the invention 5) generates, in third coding operation, a residual signal by driving an inverse filter of a linear prediction synthesis filter calculated from an input signal by a differential signal of a signal produced by adding a first and a second coded decoding signal and the input signal and codes a component in correspondence with an arbitrary band in the residual signal after subjecting the component to orthogonal transformation.

Specifically, the apparatus of the invention 5 includes means (1801, 1802 of FIG. 14) for calculating a differential signal of a signal produced by adding a first and a second coded decoding signal and the input signal, and means (1003 of FIG. 14) for generating a residual signal by driving an inverse filter of the linear prediction synthesis filter calculated from the input signal by the differential signal and coding a component in correspondence with an arbitrary band in the residual signal after subjecting the component to orthogonal transformation.

An apparatus of coding a speech and music signal according to the invention (apparatus of the invention 6) generates, in N-th coding operation, a residual signal by driving an inverse filter of a linear prediction synthesis filter calculated from an input signal by a differential signal of a signal produced by adding a first through an (N−1)-th coded decoding signal and the input signal and codes a component in correspondence with an arbitrary band in the residual signal after subjecting the component to orthogonal transformation.

Specifically, the apparatus of the invention 6 includes means (1801, 1802 of FIG. 15) for calculating a differential signal of a signal produced by adding a first through an (N−1)-th coded decoding signals and the input signal, and means (1005 of FIG. 15) for generating a residual signal by driving an inverse filter of the linear prediction synthesis filter calculated from the input signal by the differential signal and coding a component in correspondence with an arbitrary band in the residual signal after subjecting the component to orthogonal transformation.

An apparatus of coding a speech and music signal according to the invention (apparatus of the invention 7) uses a pitch prediction filter in generating an excitation signal in correspondence with a first band of an input signal. Specifically, the apparatus of the invention 7 includes pitch predicting means (112, 162, 184, 510 of FIG. 16).

An apparatus of coding a speech and music signal according to the invention (apparatus of the invention 8) generates a second input signal by down-sampling a first input signal sampled at a first sampling frequency to a second sampling frequency, generates a first reproduction signal by driving a synthesis filter set with a first linear prediction coefficient calculated from the second input signal by an excitation signal, generates a second reproduction signal by up-sampling the first reproduction signal to a first sampling frequency, further, calculates a third linear prediction coefficient from a difference of a linear prediction coefficient calculated from the first input signal and a second linear prediction coefficient provided by subjecting the first linear prediction coefficient to the first sampling frequency by sampling frequency conversion, calculates a fourth linear prediction coefficient from a sum of the second linear prediction coefficient and the third linear prediction coefficient, generates a residual signal by driving an inverse filter set with the fourth linear prediction coefficient by a differential signal of the first input signal and the second reproduction signal and codes a component in correspondence with an arbitrary band in the residual signal after subjecting the component to orthogonal transformation.

Specifically, the apparatus of the invention 8 includes means (780 of FIG. 17) for generating a second input signal by down-sampling a first input signal sampled at a first sampling frequency to a second sampling frequency, means (770, 132 of FIG. 17) for generating a first reproduction signal by driving a synthesis filter set with a first linear prediction coefficient calculated from the second input signal by an excitation signal, means (781 of FIG. 17) for generating a second reproduction signal by up-sampling the first reproduction signal to the first sampling frequency, means (771, 772 of FIG. 17) for calculating a third linear prediction coefficient from a difference of a linear prediction coefficient calculated from the first input signal, the first linear prediction coefficient and a second linear prediction coefficient provided by converting a sampling frequency to the first sampling frequency, means (180, 730 of FIG. 17) for calculating a fourth linear prediction coefficient from a sum of the second linear prediction coefficient and the third linear prediction coefficient and generating a residual signal by driving an inverse filter set with the fourth linear prediction coefficient by a differential signal of the first input signal and the second reproduction signal and means (240, 250, 260 of FIG. 17) for coding a component in correspondence with an arbitrary band in the residual signal after subjecting the component to orthogonal transformation.

An apparatus of decoding a speech and music signal according to the invention (apparatus of the invention 9) generates an excitation signal in correspondence with a second band by subjecting a decoded orthogonal transformation coefficient to orthogonal inverse transformation, generates a second reproduction signal by driving a linear prediction synthesis filter by the excitation signal, further, generates a first reproduction signal by driving the linear prediction filter by an excitation signal in correspondence with a decoded first band and generates decoded speech and music by adding the first reproduction signal and the second reproduction signal.

Specifically, the apparatus of the invention 9 includes means (440, 460 of FIG. 18) for generating the excitation signal in correspondence with the second band by subjecting a decoding signal and an orthogonal transformation coefficient to orthogonal inverse transformation, means (131 of FIG. 18) for generating a second reproduction signal by driving the linear prediction synthesis filter by the excitation signal, means (110, 120, 130, 160 of FIG. 18) for generating a first reproduction signal by driving the linear prediction filter by the excitation signal in correspondence with the first band, and means (182 of FIG. 18) for generating decoded speech and music by adding the first reproduction signal and the second reproduction signal.

An apparatus of decoding a speech and music signal according to the invention (apparatus of the invention 10) generates an excitation signal in correspondence with a third band by subjecting a decoded orthogonal transformation coefficient to orthogonal inverse transformation, generates a third reproduction signal by driving a linear prediction synthesis filter by the excitation signal, further, generates a first and a second reproduction signal by driving the linear prediction filter by excitation signals in correspondence with decoded first and second bands and generates decoded speech and music signal by adding the first through the third reproduction signals.

Specifically, the apparatus of the invention 10 includes means (1053 of FIG. 24) for generating the excitation signal in correspondence with the third band by subjecting a decoded orthogonal transformation coefficient to orthogonal inverse transformation and generating a third reproduction signal by driving the linear prediction synthesis filter by the excitation signal, means (1051, 1052 of FIG. 24) for generating a first and a second reproduction signal by driving the linear prediction filter by the excitation signals in correspondence with the first and the second bands, and means (1821, 1822 of FIG. 24) for generating decoded speech and music by adding the first through the third reproduction signals.

An apparatus of decoding a vocal music signal according to the invention (apparatus of the invention 11) generates an excitation signal in correspondence with an N-th band by subjecting a decoded orthogonal transformation coefficient to orthogonal inverse transformation, generates an N-th reproduction signal by driving a linear prediction synthesis filter by the excitation signal, further, generates a first through an (N−1)-th reproduction signal by driving the linear prediction filter by excitation signals in correspondence with decoded first through (N−1)-th band and generates decoded vocal music by adding the first through the N-th reproduction signals.

Specifically, the apparatus of the invention 11 includes means (1055 of FIG. 25) for generating an excitation signal in correspondence with the N-th band by subjecting a decoded orthogonal transformation coefficient to orthogonal inverse transformation and generating an N-th reproduction signal by driving the linear prediction synthesis filter by the excitation signal, means (1051, 1054 of FIG. 25) for generating a first through an (N−1)-th reproduction signal by driving the linear prediction filter by the excitation signals in correspondence with the first through the (N−1)-th bands, and means (1821, 1822 of FIG. 25) for generating decoded vocal music by adding the first through the N-th reproduction signals.

An apparatus of decoding a vocal music signal according to the invention (apparatus of the invention 12) generates, in second decoding operation, an excitation signal by subjecting a decoded orthogonal transformation coefficient to orthogonal inverse transformation, generates a reproduction signal by driving a linear prediction synthesis filter by the excitation signal and generates decoded vocal music by adding the reproduction signal and the first decoded signal.

Specifically, the apparatus of the invention 12 includes means (1052 of FIG. 26) for generating an excitation signal by subjecting a decoded orthogonal transformation coefficient to orthogonal inverse transformation and generating a reproduction signal by driving a linear prediction synthesis filter by the excitation signal, and means (182 of FIG. 26) for generating decoded vocal music by adding the reproduction signal and a first decoding signal.

An apparatus of decoding a vocal music signal according to the invention (apparatus of the invention 13) generates, in third decoding operation, an excitation signal by subjecting a decoded orthogonal transformation coefficient to orthogonal inverse transformation, generates a reproduction signal by driving a linear prediction synthesis filter by the excitation signal and generates decoded vocal music by adding the reproduction signal and a first and a second decoding signal.

Specifically, the apparatus of the invention 13 includes means (1053 of FIG. 27) for generating the excitation signal by subjecting a decoded orthogonal transformation coefficient to orthogonal inverse transformation and generating a reproduction signal by driving the linear prediction synthesis filter by the excitation signal, and decoded vocal music generating means (1821, 1822 of FIG. 27) for generating decoded vocal music by adding the reproduction signal and a first and a second decoding signal.

An apparatus of decoding a vocal music signal according to the invention (apparatus of the invention 14) generates, in N-th decoding operation, an excitation signal by subjecting a decoded orthogonal transformation coefficient to orthogonal inverse transformation and generates a reproduction signal by driving a linear prediction synthesis filter by the excitation signal and generates decoded vocal music by adding the reproduction signal and a first through an (N−1)-th decoding signal.

Specifically, the apparatus of the invention 14 includes means (1055 of FIG. 28) for generating the excitation signal by subjecting a decoded orthogonal transformation coefficient to orthogonal inverse transformation and generating a reproduction signal by driving the linear prediction synthesis filter by the excitation signal, and means (1821, 1822 of FIG. 28) for generating decoded vocal music by adding the reproduction signal and a first through an (N−1)-th decoding signal.

An apparatus of decoding a vocal music signal according to the invention (apparatus of the invention 15) uses a pitch prediction filter in generating an excitation signal in correspondence with a first band. Specifically, the apparatus of the invention 15 further includes pitch predicting means (112, 162, 184, 510 of FIG. 29).

An apparatus of decoding a vocal music signal according to the invention (apparatus of the invention 16) generates a first reproduction signal by up-sampling a signal provided by driving a first linear prediction synthesis filter by a first excitation signal in correspondence with a first band to a first sampling frequency, generates a second excitation signal in correspondence with a second band by subjecting a decoded orthogonal transformation coefficient to orthogonal inverse transformation, generates a second reproduction signal by driving a second linear prediction synthesis filter by the second excitation signal and generates decoded vocal music by adding the first reproduction signal and the second reproduction signal.

Specifically, the apparatus of the invention 16 includes means (132, 781 of FIG. 30) for generating a first reproduction signal by up-sampling a signal provided by driving a first linear prediction synthesis filter by a first excitation signal in correspondence with a first band to a first sampling frequency, means (440, 831 of FIG. 30) for generating a second excitation signal in correspondence with a second band by subjecting a decoded orthogonal transformation coefficient to orthogonal inverse transformation and generating a second reproduction signal by driving a second linear prediction synthesis filter by the second excitation signal, and means (182 of FIG. 30) for generating decoded vocal music by adding the first reproduction signal and the second reproduction signal.

An apparatus of decoding a code of a vocal music signal according to the invention (apparatus of the invention 17) decodes a code outputted from the apparatus of the invention 1 by the apparatus of the invention 9. Specifically, the apparatus of the invention 17 includes the vocal music signal coding means (FIG. 3) and the vocal music signal decoding means (FIG. 18).

An apparatus of decoding a code of a vocal music signal according to the invention (apparatus of the invention 18) decodes a code outputted from the apparatus of the invention 2 by the apparatus of the invention 10. Specifically, the apparatus of the invention 18 includes the vocal music signal coding means (FIG. 10) and the vocal music signal decoding means (FIG. 24).

An apparatus of decoding a code of a vocal music signal according to the invention (apparatus of the invention 19) decodes a code outputted from the apparatus of the invention 3 by the apparatus of the invention 11. Specifically, the apparatus of the invention 19 includes the vocal music signal coding means (FIG. 11) and the vocal music signal decoding means (FIG. 25).

An apparatus of decoding a code of a vocal music signal according to the invention (apparatus of the invention 20) decodes a code outputted from the apparatus of the invention 4 by the apparatus of the invention 12. Specifically, the apparatus of the invention 20 includes the vocal music signal coding means (FIG. 13) and the vocal music signal decoding means (FIG. 26).

An apparatus of decoding a code of a vocal music signal according to the invention (apparatus of the invention 21) decodes a code outputted from the apparatus of the invention 5 by the apparatus of the invention 13. Specifically, the apparatus of the invention 21 includes the vocal music signal coding means (FIG. 14) and the vocal music signal decoding means (FIG. 27).

An apparatus of decoding a code of a vocal music signal according to the invention (apparatus of the invention 22) decodes a code outputted from the apparatus of the invention 6 by the apparatus of the invention 14. Specifically, the apparatus of the invention 22 includes the vocal music signal coding means (FIG. 15) and the vocal music signal decoding means (FIG. 28).

An apparatus of decoding a code of a vocal music signal according to the invention (apparatus of the invention 23) decodes a code outputted from the apparatus of the invention 7 by the apparatus of the invention 15. Specifically, the apparatus of the invention 23 includes the vocal music signal coding means (FIG. 16) and the vocal music signal decoding means (FIG. 29).

An apparatus of decoding a code of a vocal music signal according to the invention (apparatus of the invention 24) decodes a code outputted from the apparatus of the invention 8 by the apparatus of the invention 16. Specifically, the apparatus of the invention 24 includes the vocal music signal coding means (FIG. 17) and the vocal music signal decoding means (FIG. 30).

According to the invention, a first reproduction signal is generated by driving a linear prediction synthesis filter calculated from an input signal by an excitation signal having a band characteristic in correspondence with a low region of the input signal, generates a residual signal by driving an inverse filter of the linear prediction synthesis filter by a differential signal of the input signal and the first reproduction signal and codes a high region component of the residual signal by using a coding system based on orthogonal transformation. That is, with regard to a signal having a property different from that of speech in a band belonging to a high frequency region, there is carried out coding operation based on orthogonal transformation in place of CELP. According to the coding operation based on the orthogonal transformation, coding performance with respect to a signal having property different from that of speech is higher than that of CELP. Therefore, the coding performance with regard to a high region component of the input signal is improved. As a result, a vocal music signal can excellently be coded over all of bands.

BEST MODE FOR CARRYING OUT THE INVENTION

Figure 1:
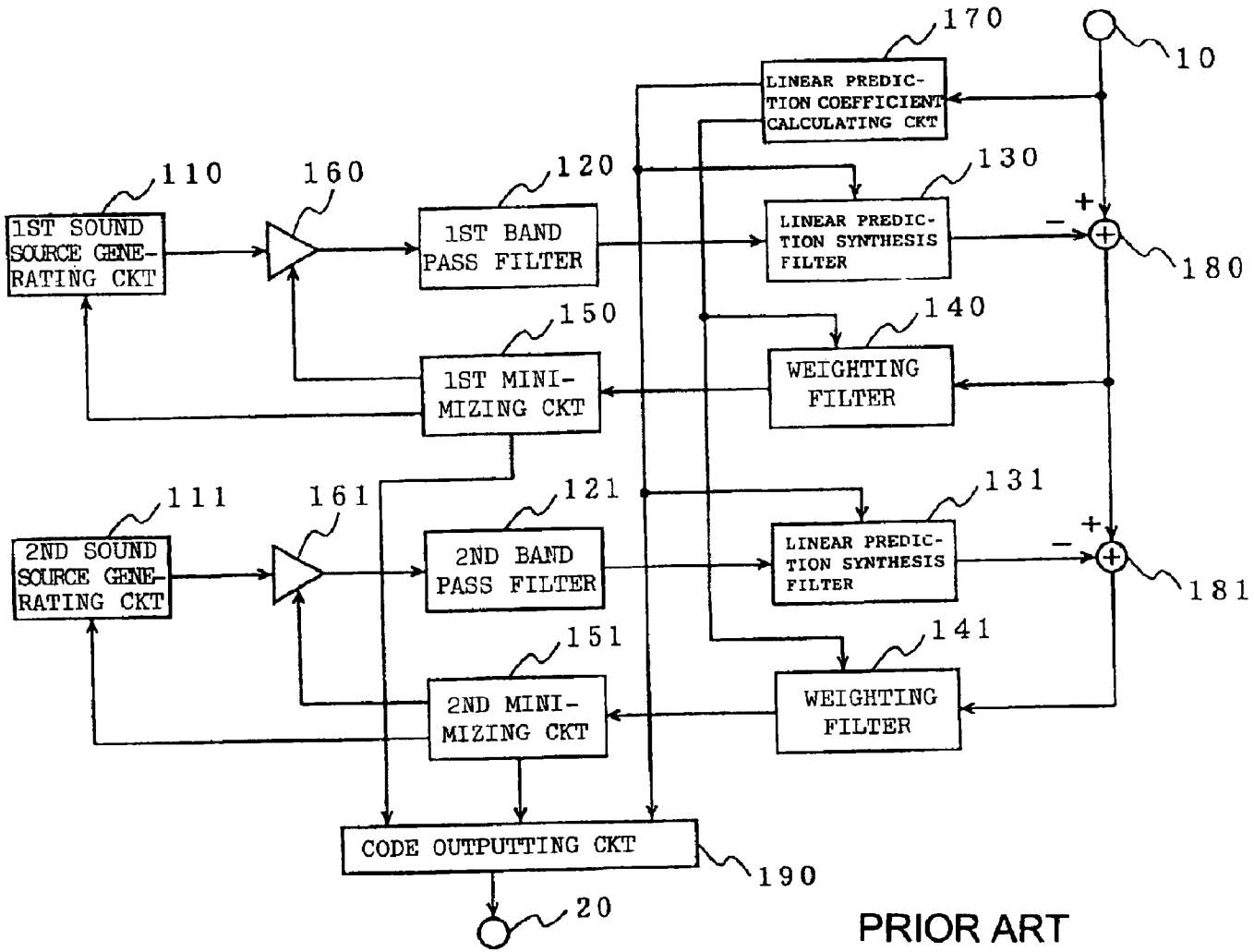
PRIOR ART FIG. 1
FIG. 1 is a block diagram showing an embodiment of a speech and music signal coder according to a conventional method.
Figure 2:
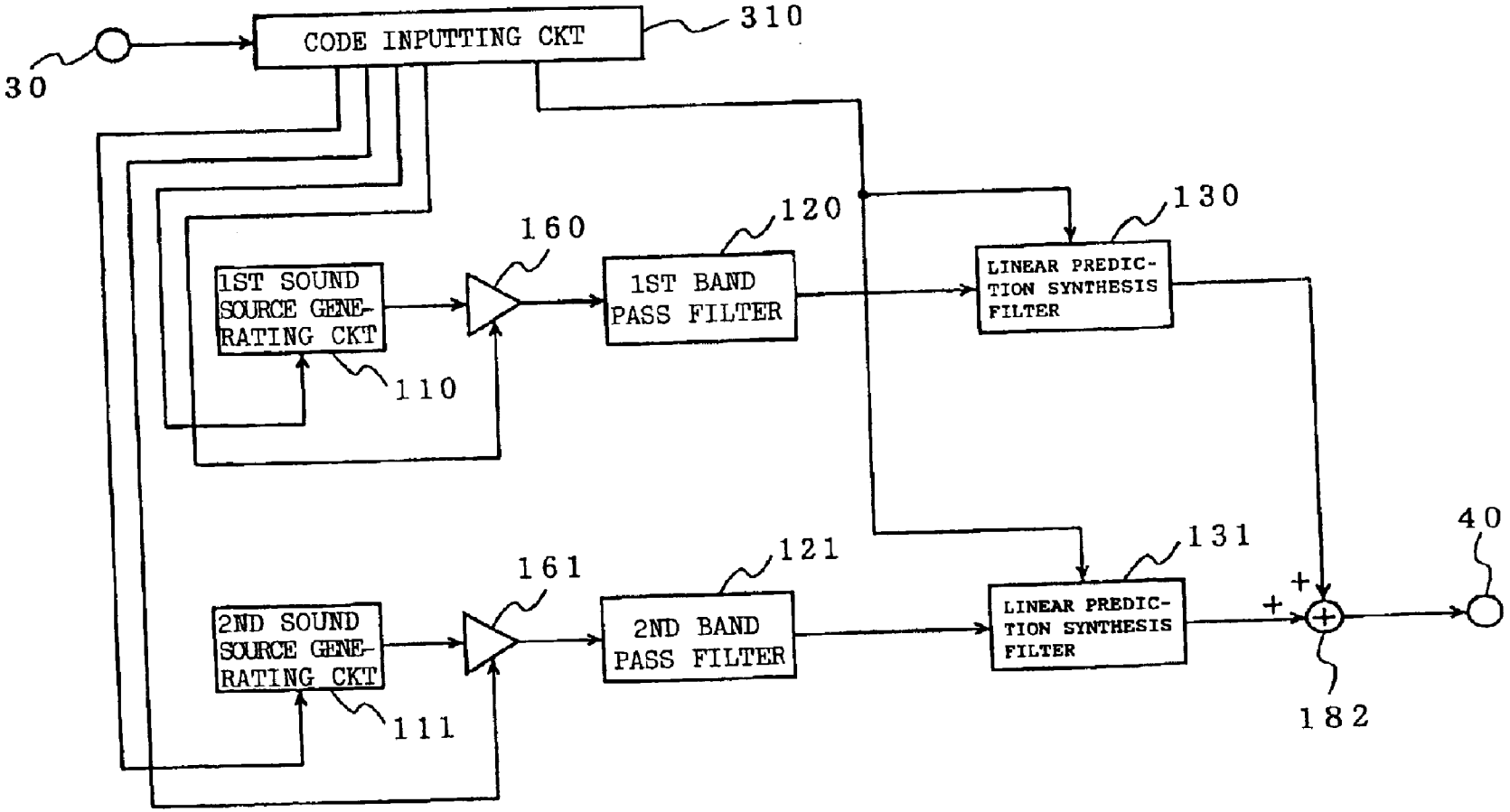
FIG. 2 PRIOR ART
FIG. 2 is a block diagram showing an embodiment of a vocal music signal decoding apparatus according to a conventional method.
Figure 3:
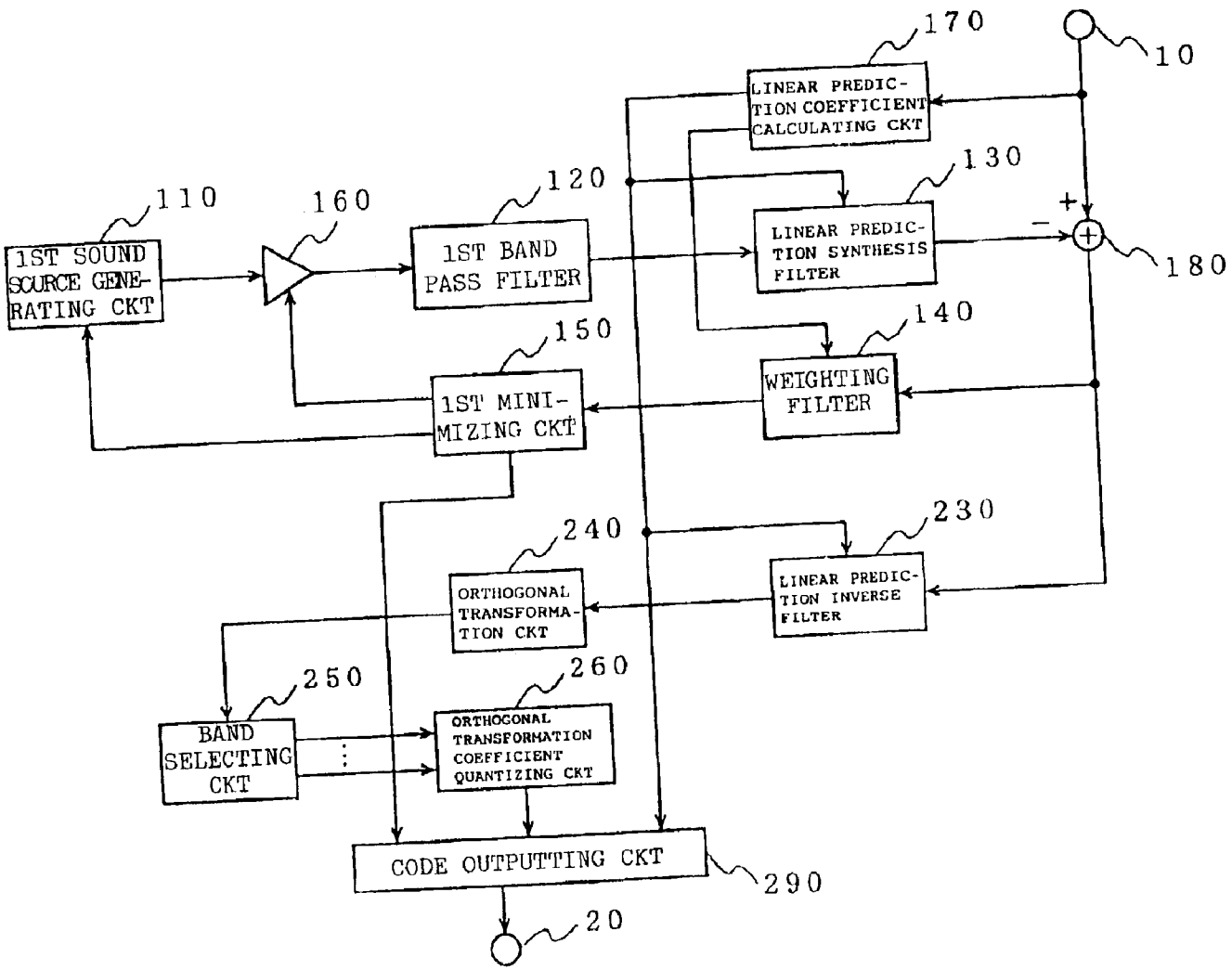
FIG. 3 is a block diagram showing a constitution of a speech and music signal coder according to a first embodiment of the invention.

FIG. 3 is a block diagram showing a constitution of a speech and music signal coder according to a first embodiment of the invention. Here, an explanation will be given thereof with a number of bands as 2. An input signal (input vector) generated by sampling a speech or music signal and summarizing a plurality of the samples in one vector as one frame, is inputted from an input terminal 10. The input vector is represented as x(n), n=0, . . . , L−1. Incidentally, notation L designates a vector length. A band of the input signal is restricted to Fs0 [Hz] through Fe0 [Hz]. For example, a sampling frequency is set to 16 [kHz] and Fs0 and Fe0 are set as Fs0=50 [Hz] and Fe0=7000 [Hz].

A linear prediction coefficient calculating circuit 170 inputs the input vector from the input terminal 10, carries out linear prediction analysis with regard to the input vector, calculates linear prediction coefficients $\alpha i$, i=1, . . . , Np, further, quantizes the linear prediction coefficients and calculates quantized linear prediction coefficients $\alpha i'$, i=1, . . . , Np. Here, notation Np designates a linear prediction degree, for example, 16. Further, the linear prediction coefficient calculating circuit 170 outputs the linear prediction coefficients to a weighting filter 140 and outputs indexes in correspondence with the quantized linear prediction coefficients to a linear prediction synthesis filter 130, a linear prediction inverse filter 230 and a code outputting circuit 290. With regard to quantization of the linear prediction coefficient, there is, for example, a method of converting the linear prediction coefficient to a line spectrum pair (LSP) and quantizing the converted linear prediction coefficient. With regard to conversion of the linear prediction coefficient into LSP, a description is given by paragraph 3.2.3 of ITU-T Recommendation G.729, "Coding of Speech at 8 kbits/s Using Conjugate-Structure Algebraic-Code-Excited Linear-Prediction (CS-ACSLP)", 1996 (Reference 3). With regard to quantization of LSP, a description is given by paragraph 3.2.4 of the Reference 3.

A first sound source generating circuit 110 inputs an index outputted from a first minimizing circuit 150. A first sound source vector in correspondence with the index is read from a table stored with a plurality of sound source signals (sound source vectors) and is outputted to a first gain circuit 160. Here, a description will be given of a constitution of the first sound source generating circuit 110 in reference to FIG. 4. A table 1101 provided by the first sound source generating circuit 110 is stored with Ne pieces of sound source vectors. For example, Ne is 256. A switch 1102 is inputted with an index "i" outputted from the first minimizing circuit 150 via an input terminal 1103. The switch 1102 selects a sound source vector in correspondence with the index from the table and outputs the sound source vector as a first sound source vector to the first gain circuit 160 via an output terminal 1104.

Further, with regard to coding of a sound source signal, there can be used a method of efficiently expressing a sound source signal by a multiple pulse signal comprising a plurality of pulses and prescribed by positions of the pulses and amplitudes of the pulses. With regard to coding of a sound source signal using a multiple pulse signal, a description is given by paragraph 3.8.1 of the Reference 3, or paragraph 5.7 of GSM 06.60 version 6.0.1 Release 1997, "Digital Cellular Telecommunications System (Phase 2+); Enhanced Full Rate (EFR) Speech Transcoding" (ETSI EN 300 726, 2000) (Reference 4), or K. Ozawa and M. Serizawa, "High Quality Multi-Pulse Based CELP Speech Coding at 6.4 kbit/s and Its Subjective Evaluation" (Proceeding of ICASSP, pp. 153–156, 1998) (Reference 5). By the above described, an explanation of the first sound source generating circuit 110 is finished.

Returning to the explanation of FIG. 3, the first gain circuit 160 is provided with a table stored with values of gains. The first gain circuit 160 is inputted with the index outputted from the first minimizing circuit 150 and the first sound source vector outputted from the first sound source generating circuit 110. A first gain in correspondence with the index is read from the table and the first gain is multiplied by the first sound source vector to thereby form a second sound source vector. The generated second sound source vector is outputted to a first band pass filter 120.

The first band pass filter 120 is inputted with the second sound vector outputted from the first gain circuit 160. A band of the second sound source vector is restricted to a first band by this filter to thereby provide a first excitation vector. The first band pass filter 120 outputs the first excitation vector to the linear prediction synthesis filter 130. Here, the first band is set to Fs1 [Hz] through Fe1 [Hz]. Incidentally, Fs0≦Fs1≦Fe1≦Fe0. For example, Fs1=50 [Hz], Fe1=4000 [Hz]. Further, the first band pass filter 120 is provided with a characteristic of restricting a band to the first band and can also be realized by a higher degree linear prediction filter 1/B(z) characterized in having a linear prediction degree of about 100 degree. In this case, when notation Nph designates a linear prediction degree and the linear prediction coefficient is βi, i=1, . . . , Nph, a transfer function 1/B(z) of the higher degree linear prediction filter is represented by Equation (1) as follows. With regard to the higher degree linear prediction filter, a description is given in Reference 2, mentioned above.

$$1/B(z) = 1\Big/\left(1 - \sum_{i=1}^{N_{ph}} \beta_i z^i\right) \quad \text{Equation (1)}$$

The linear prediction synthesis filter 130 is provided with a table stored with quantized linear prediction coefficients. The linear prediction synthesis filter 130 is inputted with the first excitation vector outputted from the first band pass filter 120 and an index in correspondence with the quantized linear prediction coefficient outputted from the linear prediction coefficient calculating circuit 170. Further, the linear prediction synthesis filter 130 reads the quantized linear prediction coefficient in correspondence with the index from the table. By driving a synthesis filter 1/A(z) set with the quantized linear prediction coefficient by the first excitation vector, a first reproduction signal (reproduced vector) is generated. The first reproduced vector is outputted to a first differencer 180. In this case, a transfer function 1/A(z) of the synthesis filter is expressed by Equation (2) as follows.

$$1/A(z) = 1\Big/\left(1 - \sum_{i=1}^{N_p} \alpha_i' z^i\right) \quad \text{Equation (2)}$$

The first differencer 80is inputted with the input vector via the input terminal 10 and the first reproduced vector outputted from the linear prediction synthesizing vector 130. The first differencer 180 calculates a difference therebetween and outputs a difference value thereof as a first difference vector to the weighting filter 140 and the linear prediction inverse filter 230.

The first weighting filter 140 is inputted with the first difference vector outputted from the first differencer 180 and the linear prediction coefficient outputted from the linear prediction coefficient calculating circuit 170. The first weighting filter 140 generates a weighting filter W(z) in correspondence with an auditory characteristic of a human being by using the linear prediction coefficient and drives the weighting filter by the first difference vector. Thereby, a first weighted difference vector is provided. Further, the first weighted difference vector is outputted to the first minimizing circuit 150. In this case, a transfer function W(z) of the weighting filter is expressed as W(z)=Q(z/γ1)/Q(z/γ2). Incidentally, Q(z/γ1) is expressed by Equation (3) as follows. γ1 and γ2 are constants and, for example, γ1=0.9, γ2=0.6. Further, with regard to details of the weighting filter, a description is given in Reference 1, mentioned above.

$$Q(z/\gamma_1) = 1 - \sum_{i=1}^{N_p} \alpha_i \gamma_1^i z^i,\ Q(z/\gamma_2) = 1 - \sum_{i=1}^{N_p} \alpha_i \gamma_2^i z^i \quad \text{Equation (3)}$$

The first minimizing circuit 150 successively outputs indexes in correspondence with all of the first sound source vectors stored in the first sound source generating circuit 110 to the first sound source generating circuit 110 and successively outputs indexes in correspondence with all of the first gains stored in the first gain circuit 160 to the first gain circuit 160. Further, the first minimizing circuit 150 receives the first weighted difference vectors successively outputted from the weighting filter 140, calculates a norm thereof, selects the first sound source vector and the first gain minimizing the norm and outputs an index in correspondence therewith to the code outputting circuit 290.

The linear prediction inverse filter 230 is provided with a table stored with quantized linear prediction coefficients. The linear prediction inverse filter 230 is inputted with the index in correspondence with the quantized linear prediction coefficient outputted from the linear prediction coefficient calculating circuit 170 and the first difference vector outputted from the first differencer 180. Further, the linear prediction inverse filter 230 reads a quantized linear prediction coefficient in correspondence with the index from the table. By driving an inverse filter A(z) set with the quantized linear prediction coefficient by the first difference vector, a first residue vector is provided. Further, the first residue vector is outputted to an orthogonal transformation circuit 240. A transfer function A(z) of the inverse filter is expressed by Equation (4) as follows.

$$A(z) = 1 - \sum_{i=1}^{N_p} \alpha_j' z^i \quad \text{Equation (4)}$$

The orthogonal transformation circuit 240 is inputted with the first residue vector outputted from the linear prediction inverse filter 230. The orthogonal transformation circuit 240 subjects the first residue vector to orthogonal transformation and generates a second residue vector. The second residue vector is outputted to a band selecting circuit 250. Here, as the orthogonal transformation, discrete cosine transform (DCT) can be used.

The band selecting circuit 250 is inputted with the second residue vector outputted from the orthogonal transformation circuit 240. As shown by FIG. 3, in the second residue vector, there are generated Nsbv pieces of subvectors using components included in a second band. Although an arbitrary band can be set as the second band, in this case, the second band is constituted by a band of Fs2 [Hz] through Fe2 [Hz]. Incidentally, Fs0≦Fs2≦Fe2≦Fe0. IN this case, the first band and the second band do not overlap, that is, Fe1≦Fs2. For example, Fs2=4000 [Hz], Fe2=7000 [Hz]. The band selecting circuit 250 outputs Nsbv pieces of the subvectors to an orthogonal transformation coefficient quantizing circuit 260.

The orthogonal transformation coefficient quantizing circuit 260 is inputted with Nsvb pieces of the subvectors outputted from the band selecting circuit 250. The orthogonal transformation coefficient quantizing circuit 260 is provided with a table stored with quantized values (shape code vectors) in correspondence with shapes of the subvectors and a table stored with quantized values (quantization gains) in correspondence with gains of the subvectors. Quantization errors are minimized with regard to respectives of Nsbv pieces of the inputted subvectors. The orthogonal transformation coefficient quantizing circuit 260 selects the quantized values of the shapes and the quantized values of the gains from the tables and outputs corresponding indexes to the code outputting circuit 290.

Figure 4:
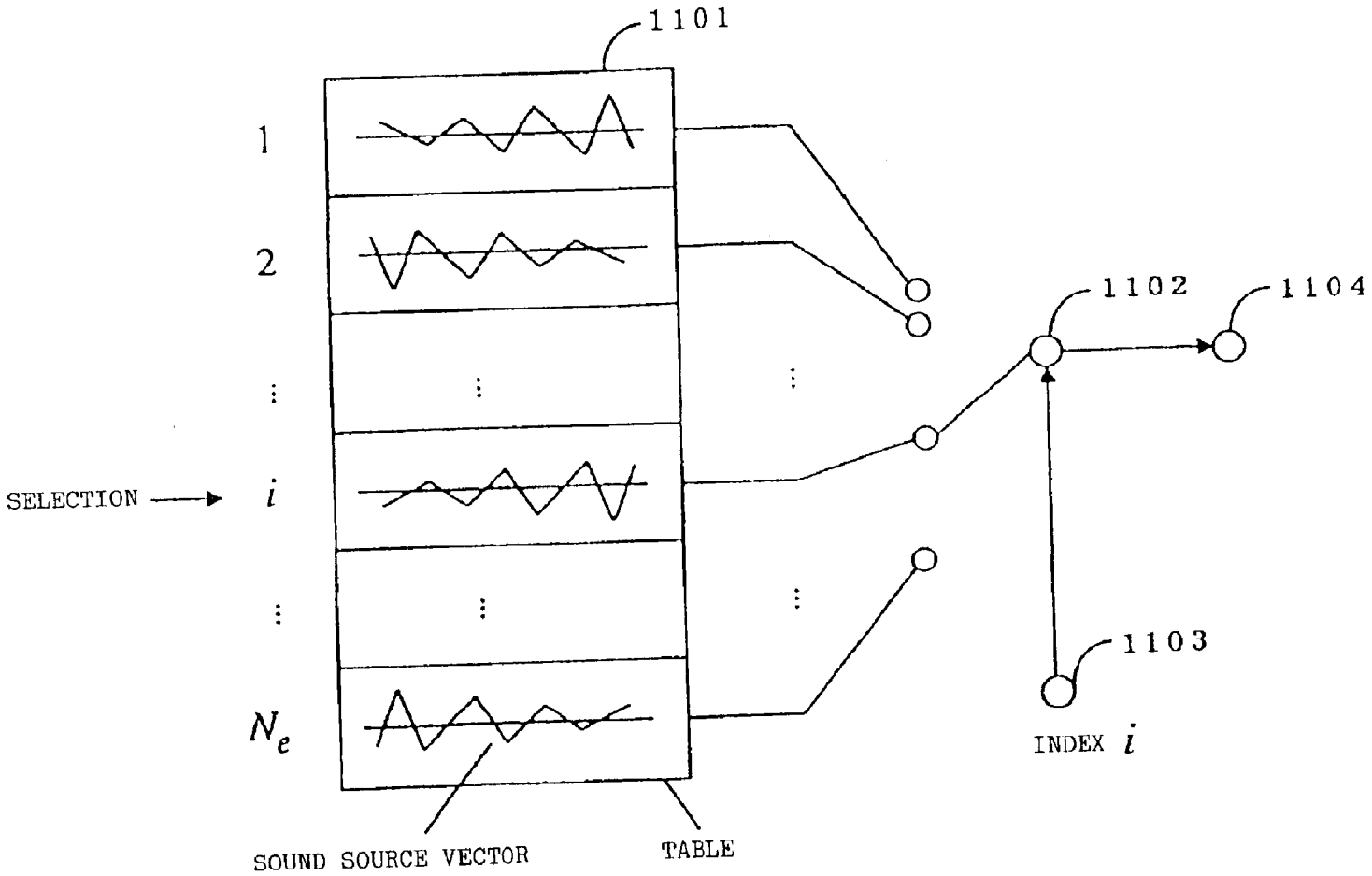
FIG. 4 is a block diagram showing a constitution of a first sound source generating circuit 110.
Figure 5:
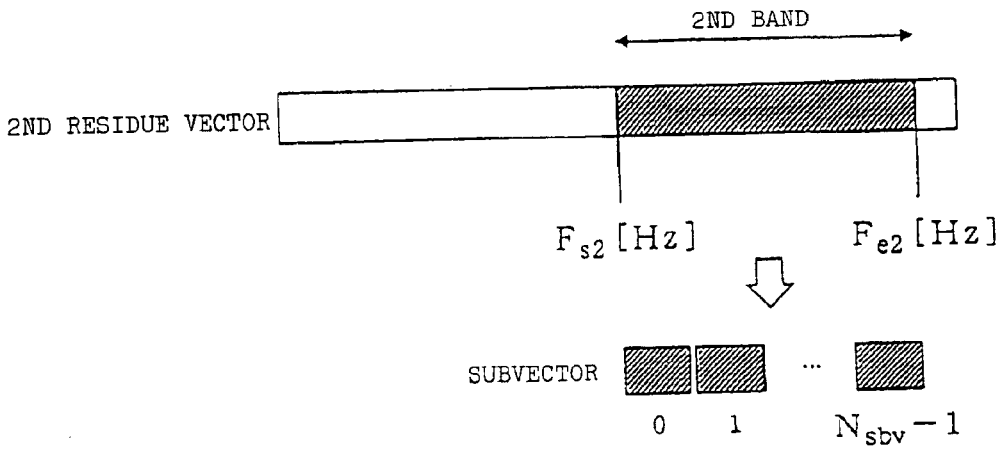
FIG. 5 is a view for explaining a method of generating a subvector in a band selecting circuit 250.
Figure 6:
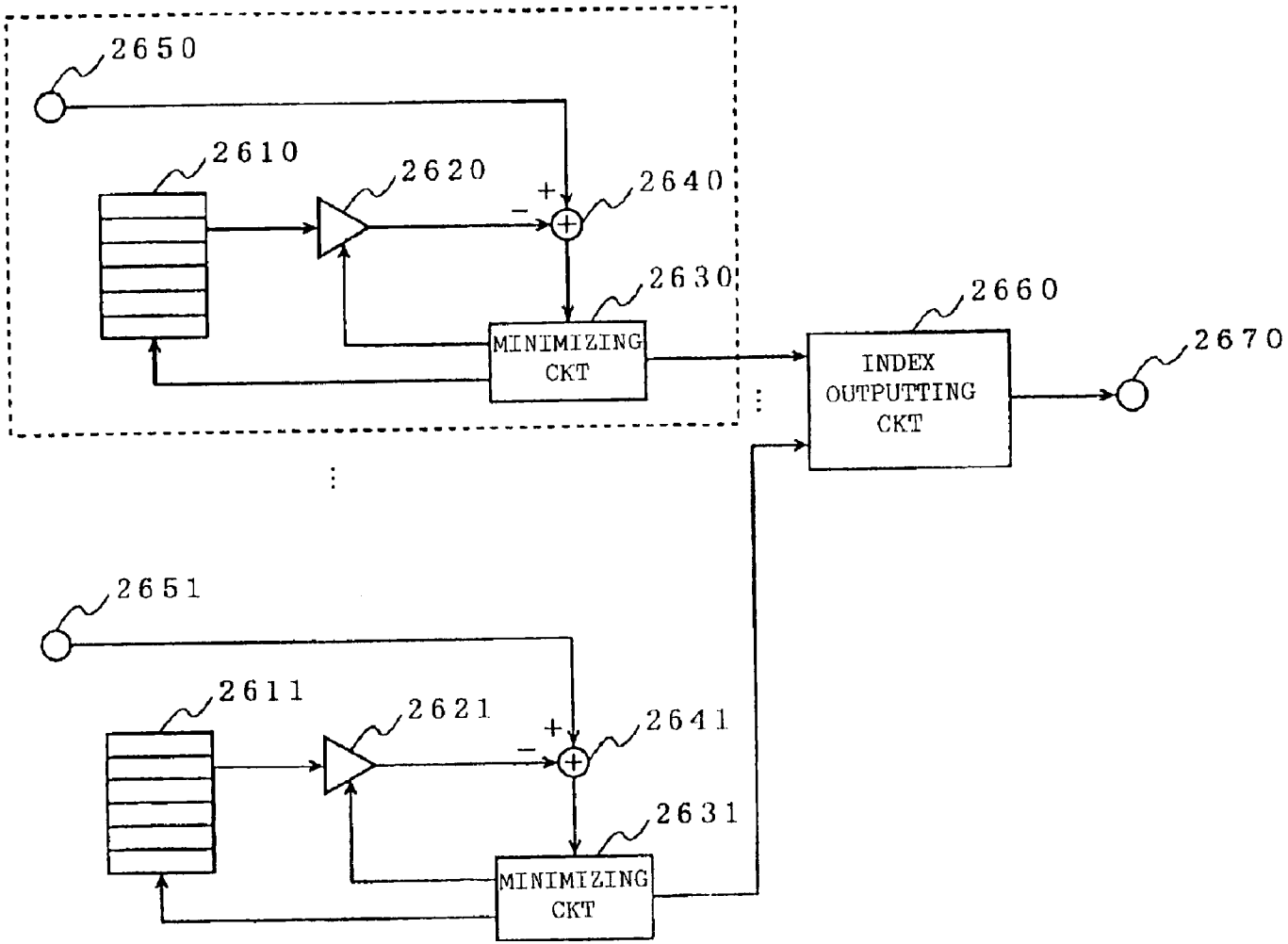
FIG. 6 is a block diagram showing a constitution of an orthogonal transformation coefficient quantizing circuit 260.

Here, a supplementary explanation will be given of a constitution of the orthogonal transformation coefficient quantizing circuit 260 in reference to FIG. 4. In FIG. 4, there are Nsbv pieces of blocks surrounded by dotted lines. In the respective blocks, Nsbv pieces of the subvectors are quantized. Nsbv pieces of the subvectors are expressed by Equation (5) as follows.

$$e_{sb,0}(n), \ldots, e_{sb,N_{sbv}}-1(n), n=0, \ldots, L-1 \quad \text{Equation (5)}$$

Processing with regard to the respective subvectors is common. An explanation will be given of a processing with regard to e sb,0 (n), n=0, . . . , L−1.

Subvectors e sb.0 (n), n=0, . . . , L−1 are inputted via an input terminal 2650. A table 2610 is stored with Nc,0 pieces of shape code vectors c0[j] (n), n=0, . . . , L−1, j=0, . . . , Nc,0−1. Here, notation L designates a vector length and notation "j" designates an index. The table 2610 inputs indexes outputted from a minimizing circuit 2630 and outputs the shape code vectors c0[j] (n), n=0, . . . , L−1 in correspondence with the indexes to a gain circuit 2620. A table provided by the gain circuit 2620 is stored with Ng,0 pieces of quantization gains g0[k], k=0, . . . , Ng,0−1. Here, notation "k" designates an index.

The gain circuit 2620 is inputted with the shape code vectors c0[j] (n), n=0, . . . , L−1 outputted from the table 2610 and is inputted with the indexes outputted from the minimizing circuit 2630. The quantization gain g0[k] in correspondence with index is read from the table. Quantized subvectors e' sb,0 (n), n=0, . . . , L−1 provided by multiplying the quantization gains g0[k] by the shape code vectors c0[j] (n), n=0, . . . , L−1 are outputted to a differencer 2640. The differencer 2640 calculates differences between the subvectors e sb,0 (n), n=0, . . . , L−1 inputted via an input terminal 2650 and the quantized subvectors e' sb,0 (n), n=0, . . . , L−1 inputted from the gain circuit 2620. Difference values thereof are outputted to the minimizing circuit 2630 as difference vectors. The minimizing circuit 2630 successively outputs indexes in correspondence with all of the shape code vectors c0[j], (n), n=0, . . . , L−1 and j=0, . . . , Nc,0−1 stored in the table 2610 to the table 2610. Indexes in correspondence with all of the quantization gains g0[k] k=0, . . . , Ng,0−1 stored in the gain circuit 2620 are successively outputted to the gain circuit 2620. Further, the difference vectors are successively inputted from the differencer 2640 and norms DO thereof are calculated. The minimizing circuit 2630 selects the shape code vectors c0[j] (n), n=0, . . . , L−1 and the quantization gains g0[k] minimizing the norms D0. Indexes in correspondence therewith are outputted to an index outputting circuit 2660. Similar processing is carried out with respect to subvectors shown by Equation (6) as follows.

$$e_{sb,1}(n), \ldots, e_{sb,N_{sbv}}-1(n), n=0, \ldots, L-1 \quad \text{Equation (6)}$$

The index outputting circuit 2660 is inputted with Nsbv pieces of the indexes outputted from the minimizing circuit. A set of the indexes summarizing these are outputted to the code outputting circuit 290 via an output terminal 2670. Further, with regard to determination of the shape code vectors c0[j] (n), n=0, . . . , L−1 and the quantization gains g0[k] minimizing the norm D0, the following method can also be used. The norm D0 is expressed by Equation (7) as follows.

$$D_0 = \sum_{n=0}^{L-1} (e_{sb,0}(n) - e'_{sb,0}(n))^2 = \sum_{n=0}^{L-1} \left(e_{sb,0}(n) - g_0^{[k]} \cdot c_0^{[j]}(n)\right)^2, \quad \text{Equation (7)}$$

$$j = 0, \ldots, N_{c,0} - 1, k = 0, \ldots N_{g,0} - 1$$

$$j=0, \ldots, N_{c,0}-1, k=0, \ldots, N_{g,0}-1$$

Here, when an optimum gain g' 0 is set as shown by Equation (8) as follows, the norm D0 can be modified as shown by Equation (8) or Equation (9) as follows.

$$g'_0 = \frac{\sum_{n=0}^{L-1} e_{sb,0}(n) \cdot c_0^{[j]}(n)}{\sum_{n=0}^{L-1} c_0^{[j]}(n)^2}, \quad \text{Equation (8)}$$

$$j = 0, \ldots, N_{c,0} - 1$$

$$D_0 = \sum_{n=0}^{L-1} e_{sb,0}(n)^2 - \frac{\left(\sum_{n=0}^{L-1} e_{sb,0}(n) \cdot c_0^{[j]}(n)\right)^2}{\sum_{n=0}^{L-1} c_0^{[j]}(n)^2}, \quad \text{Equation (9)}$$

$$j = 0, \ldots, N_{c,0} - 1$$

$$j=0, \ldots, N_{c,0}-1$$

Therefore, calculation of c0[j] (n), n=0, . . . , L−1, j=0, . . . , Nc,0−1 minimizing D0, is equivalent to calculation of c0[j] (n), n=0, . . . , L−1, j=0, . . . , Nc,0−1 maximizing a second term of an equation shown by above Equation (9). Hence, after calculating c0[j] (n), n=0, . . . , L−1, j=j opt maximizing the second term of the equation shown by above Equation (9), g0[k], k=k opt minimizing an equation shown by above Equation (7) is calculated with respect to c0[j] (n), n=0, . . . , L−1, j=j opt. Here, as c0[j] (n), n=0, . . . , L−1, j=j opt, a plurality of candidates are selected successively from larger values of the second term of the equation shown by above Equation (9). g0[k], k=k opt minimizing the equation shown by above Equation (7) is calculated for respectives thereof. c0[j] (n), n=0, . . . , L−1, j=j opt and g0[k], k=k opt minimizing the norm D0 can also be selected finally from these. A similar method is applicable to subvectors shown by Equation (10) as follows.

$$e_{sb,1}(n), \ldots, e_{sb,N_{sbv}}-1(n), n=0, \ldots, L-1 \quad \text{Equation (10)}$$

By the above-described, an explanation of the orthogonal transformation coefficient quantizing circuit 260 in reference to FIG. 4 is finished. In the following, the explanation in reference to FIG. 3 will be given again.

Figure 31:
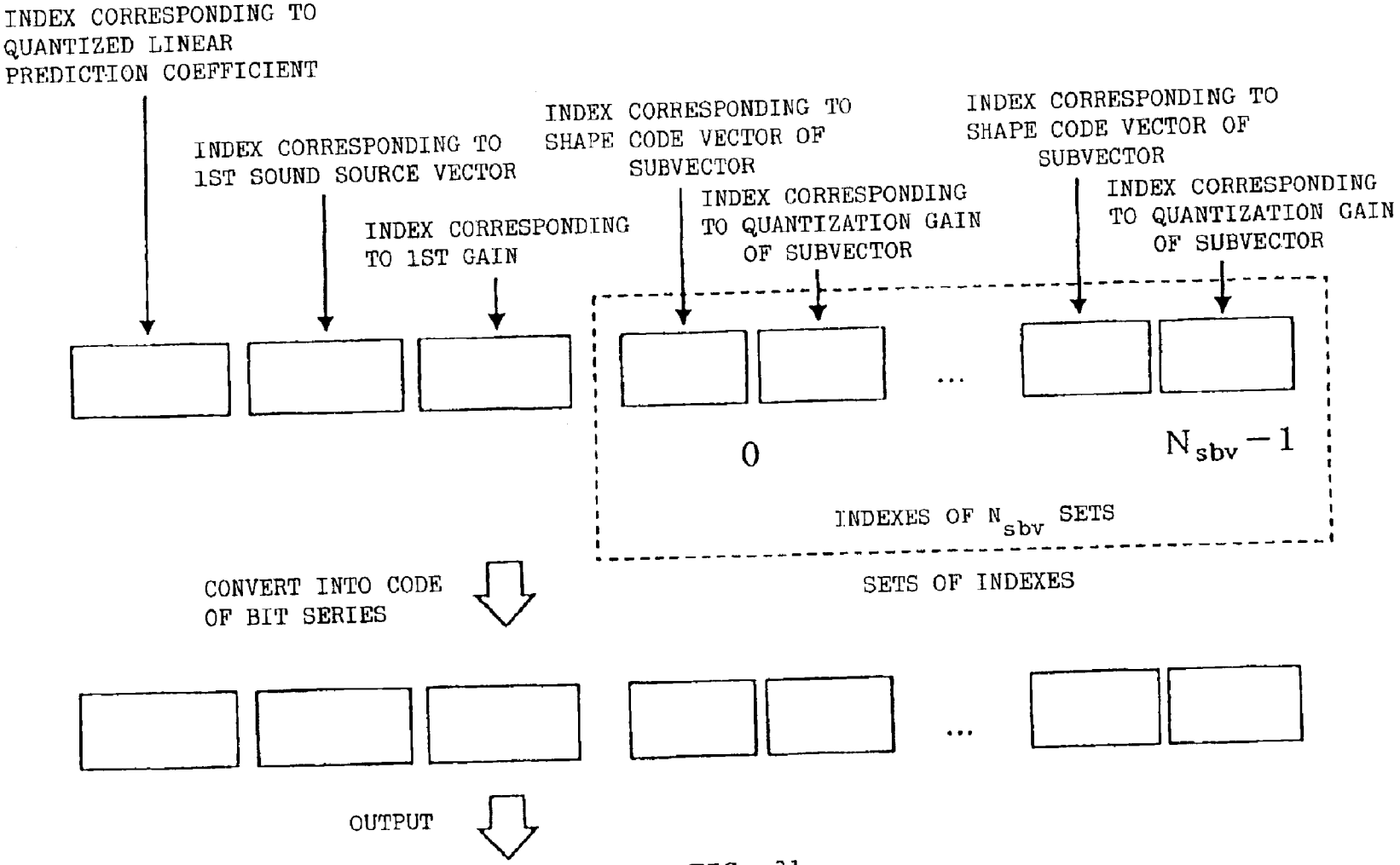
FIG. 31 is a view for explaining a correspondence between an index and a code of a bit series in a code outputting circuit 290.

The code outputting circuit 290 is inputted with indexes in correspondence with the quantized linear prediction coefficients outputted from the linear prediction coefficient calculating circuit 170. Further, the code outputting circuit 290 is inputted with indexes outputted from the first minimizing circuit 150 and in correspondence with respectives of the first sound source vectors and the first gains. Further, the code outputting circuit 290 is inputted with a set of indexes outputted from the orthogonal transformation coefficient quantizing circuit 260 and constituted by indexes of the shape code vectors and the quantization gains with respect to Nsbv pieces of subvectors. Further, as schematically shown by FIG. 31, the respective indexes are converted into codes of bit series and are outputted via an output terminal 20.

Although the first embodiment explained in reference to FIG. 3 shows the case in which the number of bands is 2, an explanation will be given of a case in which the number of bands is expanded to 3 or more as follows.

Figure 7:
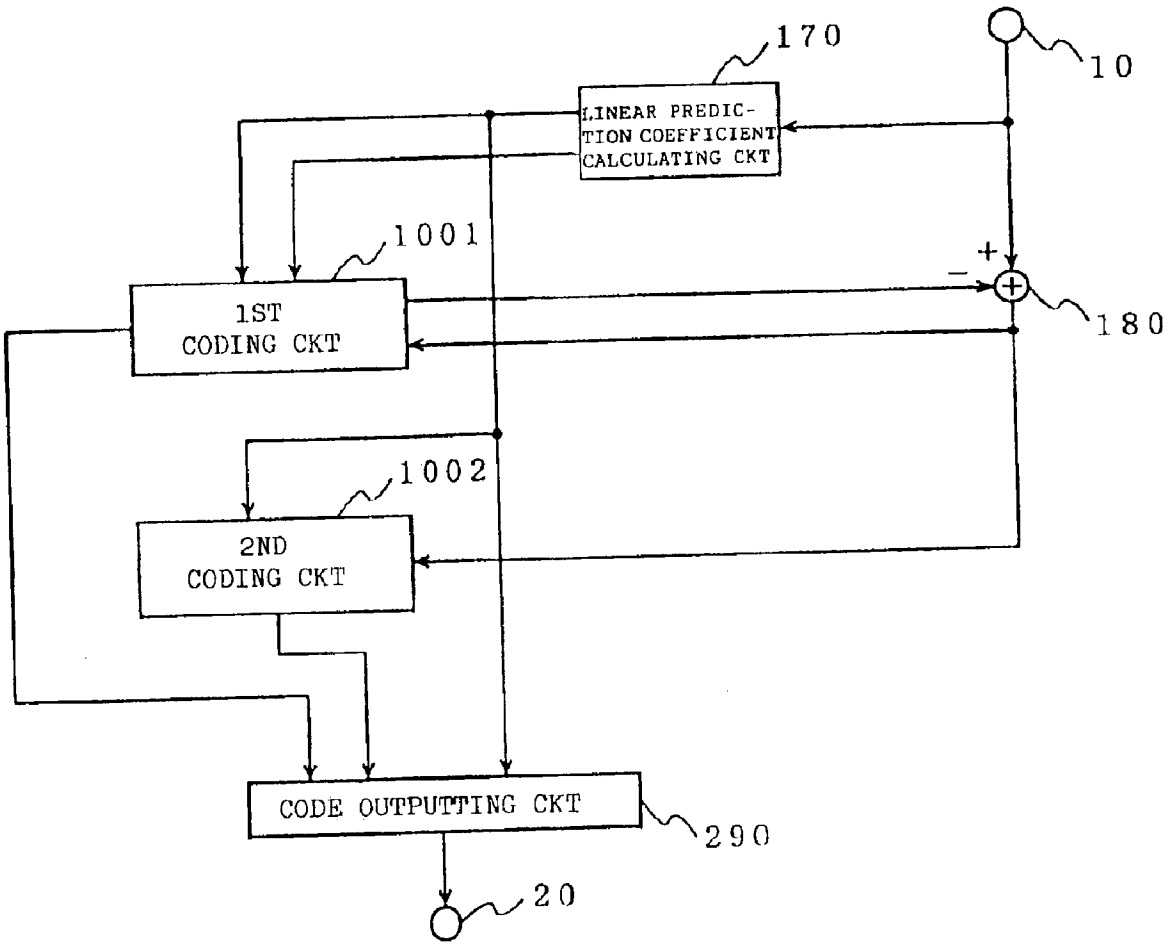
FIG. 7 is a block diagram equivalent to FIG. 3 showing the constitution of the speech and music signal coder according to the first embodiment of the invention.
Figure 8:
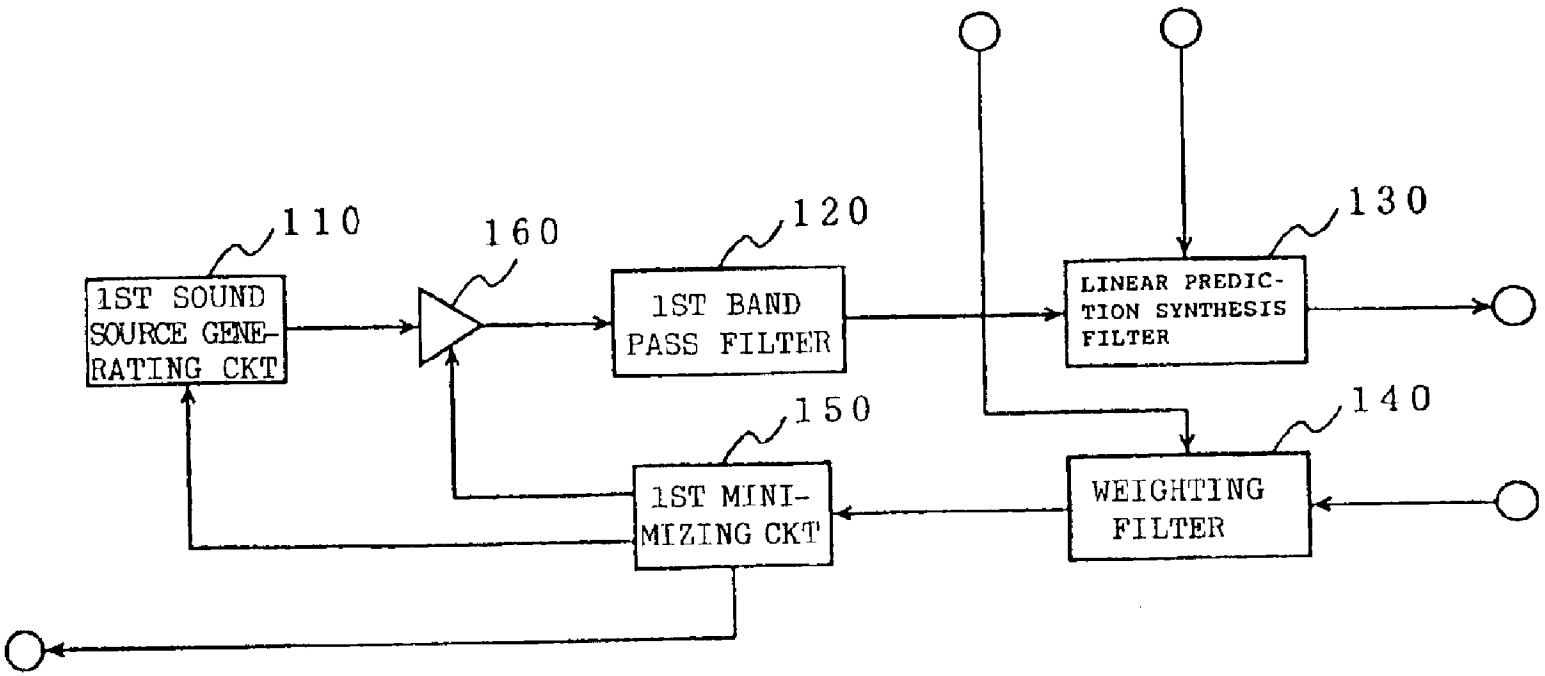
FIG. 8 is a block diagram showing a constitution of a first coding circuit 1001 in FIG. 5.
Figure 9:
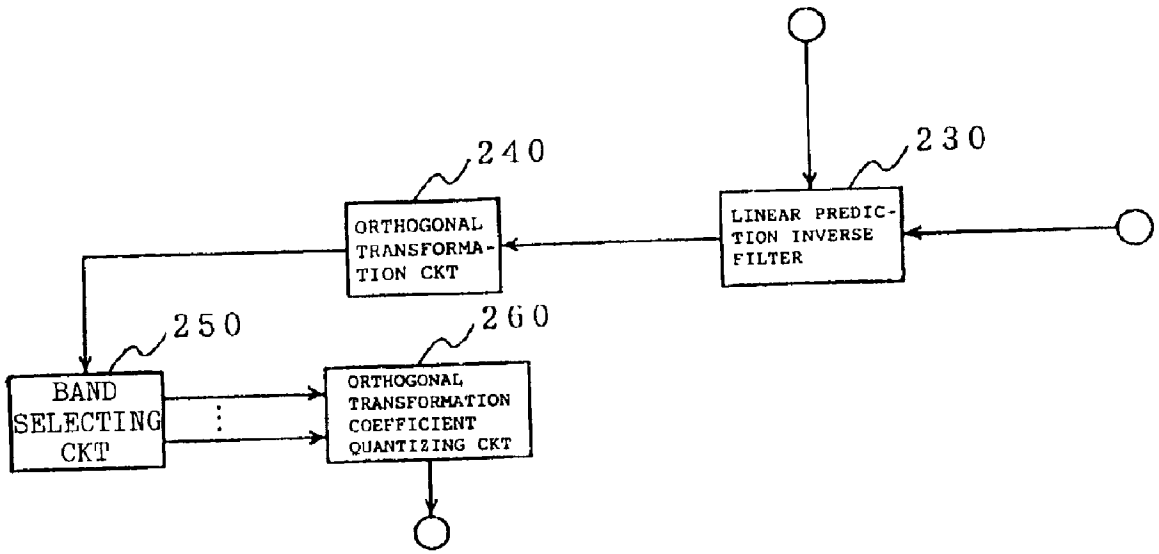
FIG. 9 is a block diagram showing a constitution of a second coding circuit 1002 in FIG. 5.

FIG. 3 can be rewritten as shown by FIG. 7. Here, a first coding circuit 1001 of FIG. 7 is equivalent to FIG. 8. A second coding circuit 1002 of FIG. 7 is equivalent to FIG. 9. Respective blocks constituting FIG. 8 and FIG. 9 are the same as respective blocks explained in FIG. 3.

Figure 10:
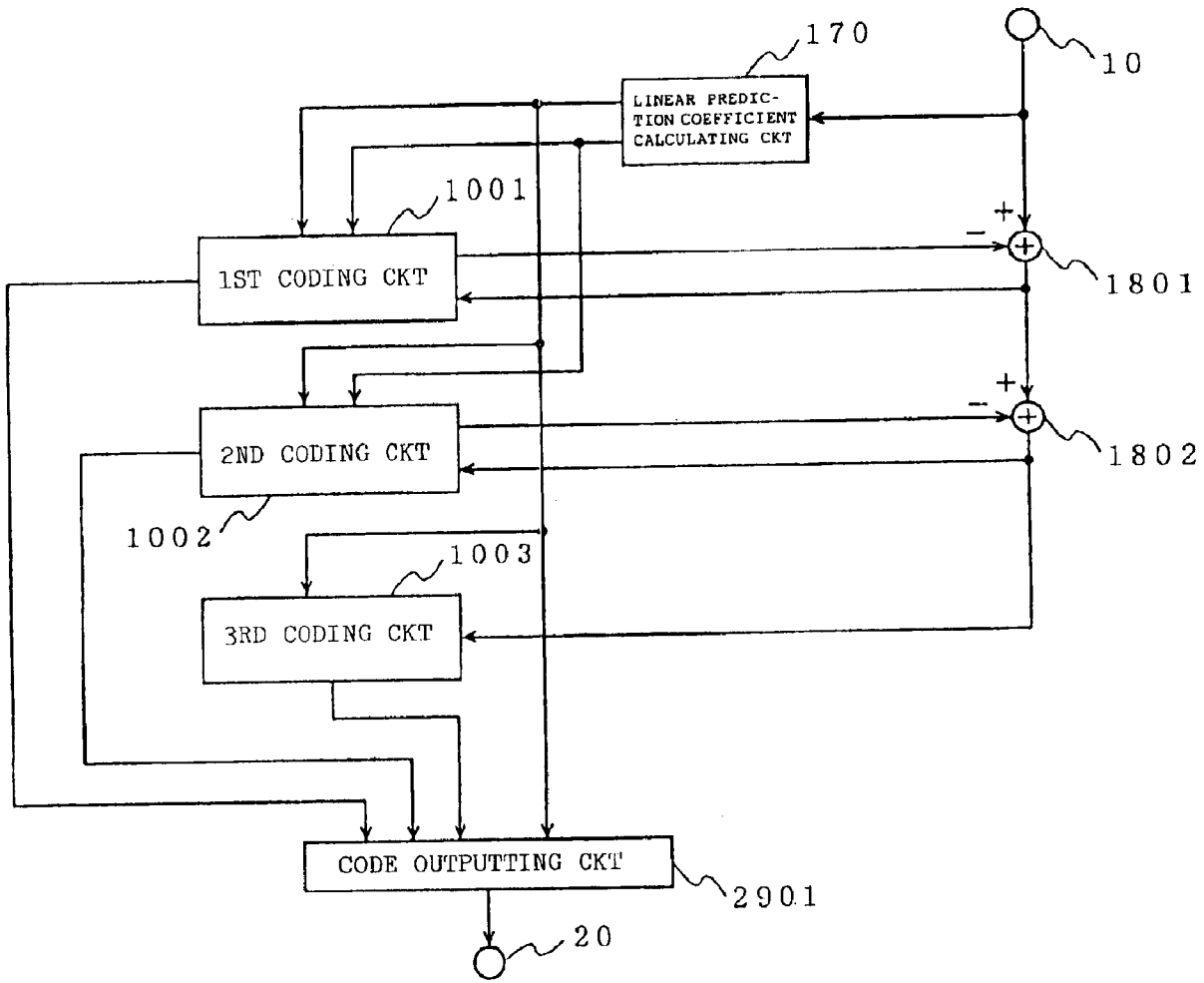
FIG. 10 is a block diagram showing a constitution of a speech and music signal coder according to a second embodiment of the invention.

The second embodiment according to the invention is realized by expanding the number of bands to 3 in the first embodiment. A constitution of a speech and music signal coder according to the second embodiment can be represented by a block diagram shown in FIG. 10. In the drawing, the first coding circuit 1001 is equivalent to FIG. 8, the second coding circuit 1002 is equivalent to FIG. 8 and the third coding circuit 1003 is equivalent to FIG. 9. A code outputting circuit 2901 is inputted with an index outputted from the linear prediction coefficient calculating circuit 170, inputted with an index outputted from the first coding circuit 1001, inputted with an index outputted from the second coding circuit 1002 and inputted with a set of indexes outputted from the third coding circuit 1003. The respective indexes are converted into codes of bit series and outputted via the input terminal 20.

Figure 11:
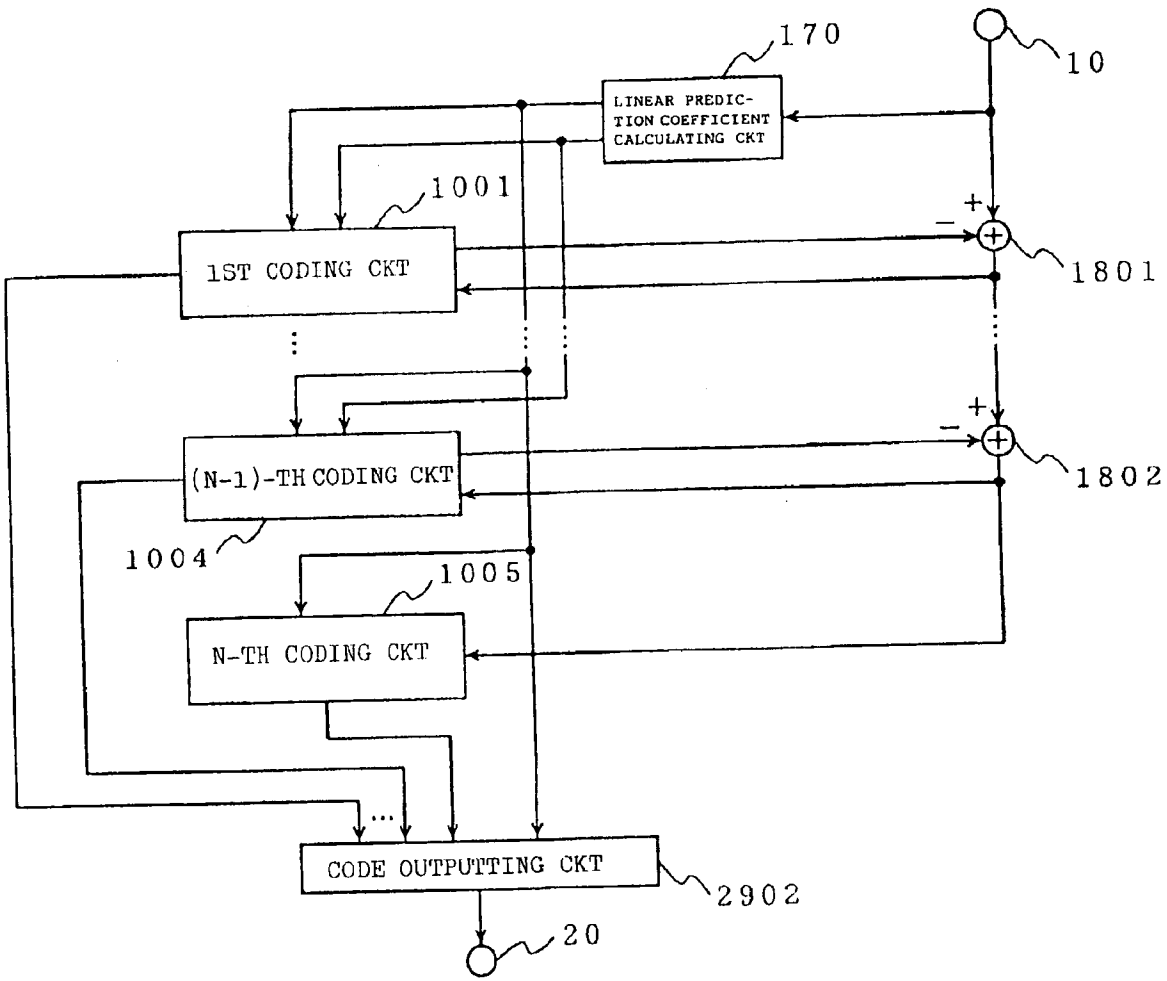
FIG. 11 is a block diagram showing a constitution of a speech and music signal coder according to a third embodiment of the invention.

A third embodiment of the invention is realized by expanding the number of bands to N in the first embodiment. A constitution of a speech and music signal coder according to the third embodiment can be represented by a block diagram shown in FIG. 11. Here, the first coding circuit 1001 through an (N−1)-th coding circuit 1004 are equivalent to FIG. 8. An N-th coding circuit 1005 is equivalent to FIG. 9. A code outputting circuit 2902 is inputted with an index outputted from the linear prediction coefficient calculating circuit 170, inputted with indexes outputted from respectives of the first coding circuit 1001 through the (N−1)-th coding circuit 1004 and inputted with a set of indexes outputted from the N-th coding circuit 1005. Further, the respective indexes are converted into codes of bit series and outputted via the output terminal 20.

According to the first embodiment, the first coding circuit 1001 shown in FIG. 7 is based on a coding system using an A-b-S (Analysis-by-Synthesis) method. However, according to the first embodiment, a coding system other than the A-b-S method is also applicable to the first coding circuit 1001. In the following, an explanation will be given of a case in which a coding system using time frequency conversion is applied to the first coding circuit 1001 as a coding system other than the A-b-S method.

Figure 12:
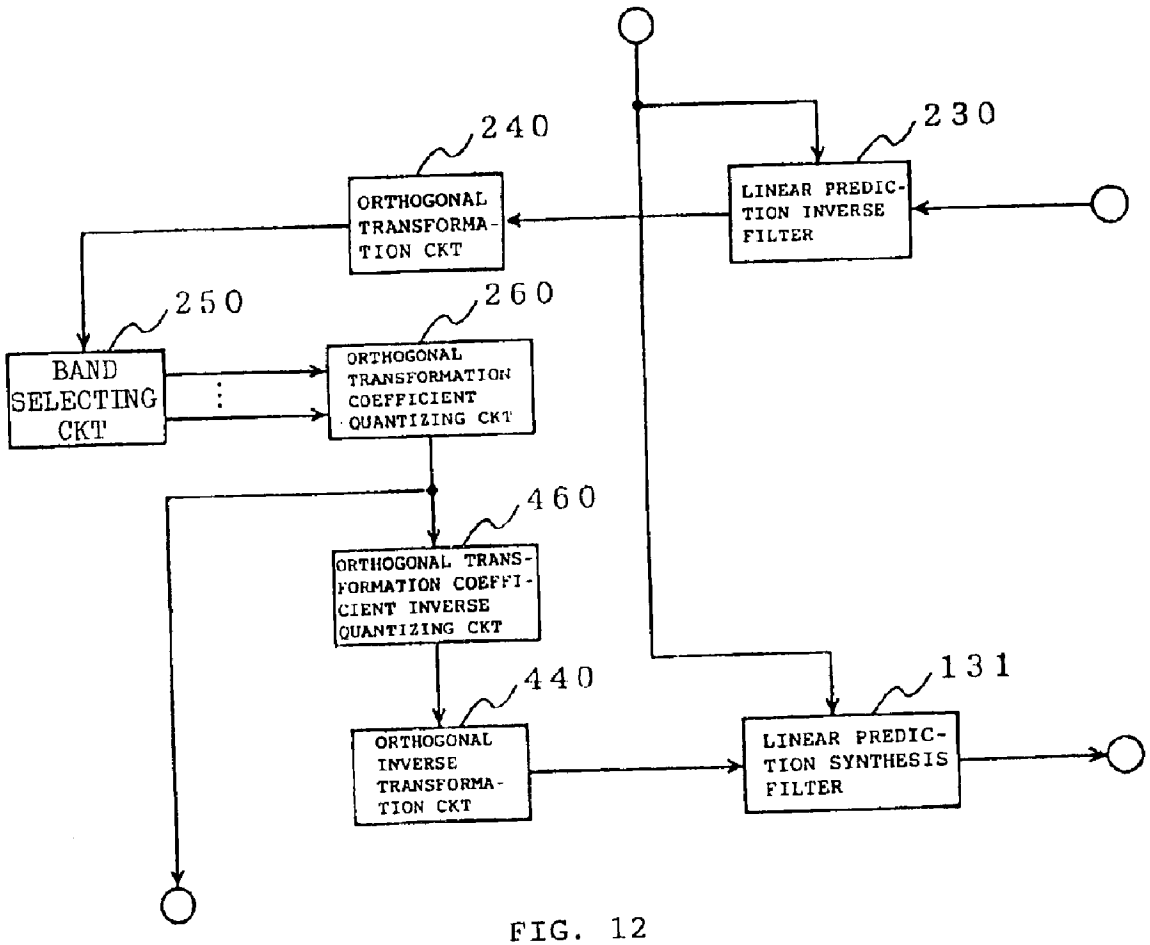
FIG. 12 is a block diagram showing a constitution of a first coding circuit 1011 in FIG. 31.
Figure 13:
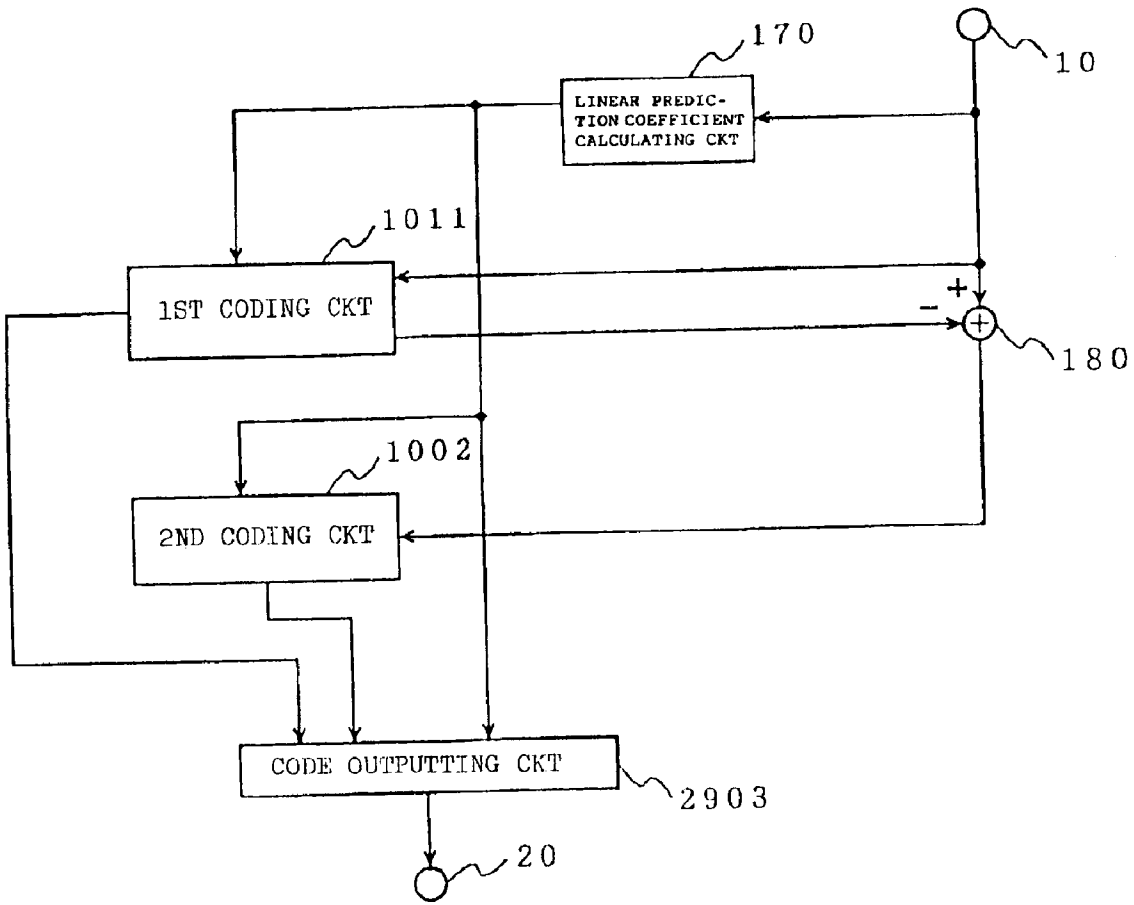
FIG. 13 is a block diagram showing a constitution of a speech and music signal coder according to a fourth embodiment of the invention.

A fourth embodiment of the invention is realized by applying the coding system using time frequency conversion in the first embodiment. A constitution of a speech and music signal coder according to the fourth embodiment of the invention can be represented by a block diagram shown in FIG. 13. In this case, a first coding circuit 1011 is equivalent to FIG. 12. A second coding circuit 1002 is equivalent to FIG. 9. Among blocks constituting FIG. 12, the linear prediction inverse filter 230, the orthogonal transformation circuit 240, the band selecting circuit 250 and the orthogonal transformation coefficient quantizing circuit 260 are the same as the respective blocks explained in FIG. 3. Further, an orthogonal transformation coefficient inverse quantizing circuit 460 and an orthogonal inverse transformation circuit 440 and the linear prediction synthesis filter 131 are the same as blocks constituting a vocal music decoding apparatus in correspondence with the first embodiment by a ninth embodiment, mentioned later.

Figure 15:
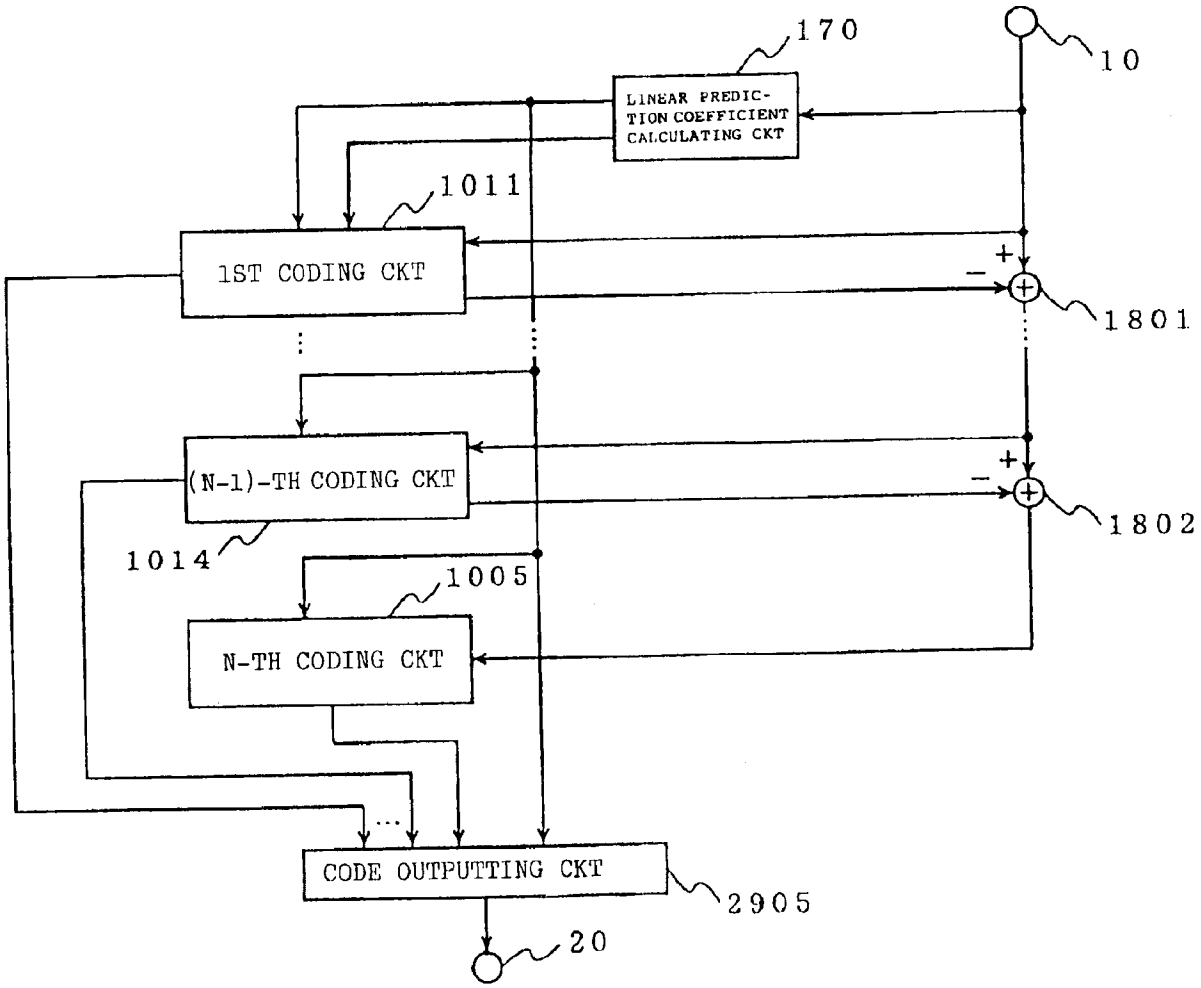
FIG. 15 is a block diagram showing a constitution of a speech and music signal coder according to a sixth embodiment of the invention.

An explanation of the orthogonal transformation coefficient inverse quantizing circuit 460, the orthogonal inverse transformation circuit 440 and the linear prediction synthesis filter 131 will be omitted here since an explanation thereof will be given in the ninth embodiment in reference to FIG. 15. A code outputting circuit 2903 is inputted with an index outputted from the linear prediction coefficient calculating circuit 170, inputted with a set of indexes outputted from the first coding circuit 1011 and inputted with a set of indexes outputted from the second coding circuit 1002. Further, the respective indexes are converted into codes of bit series and outputted via the output terminal 20.

Figure 14:
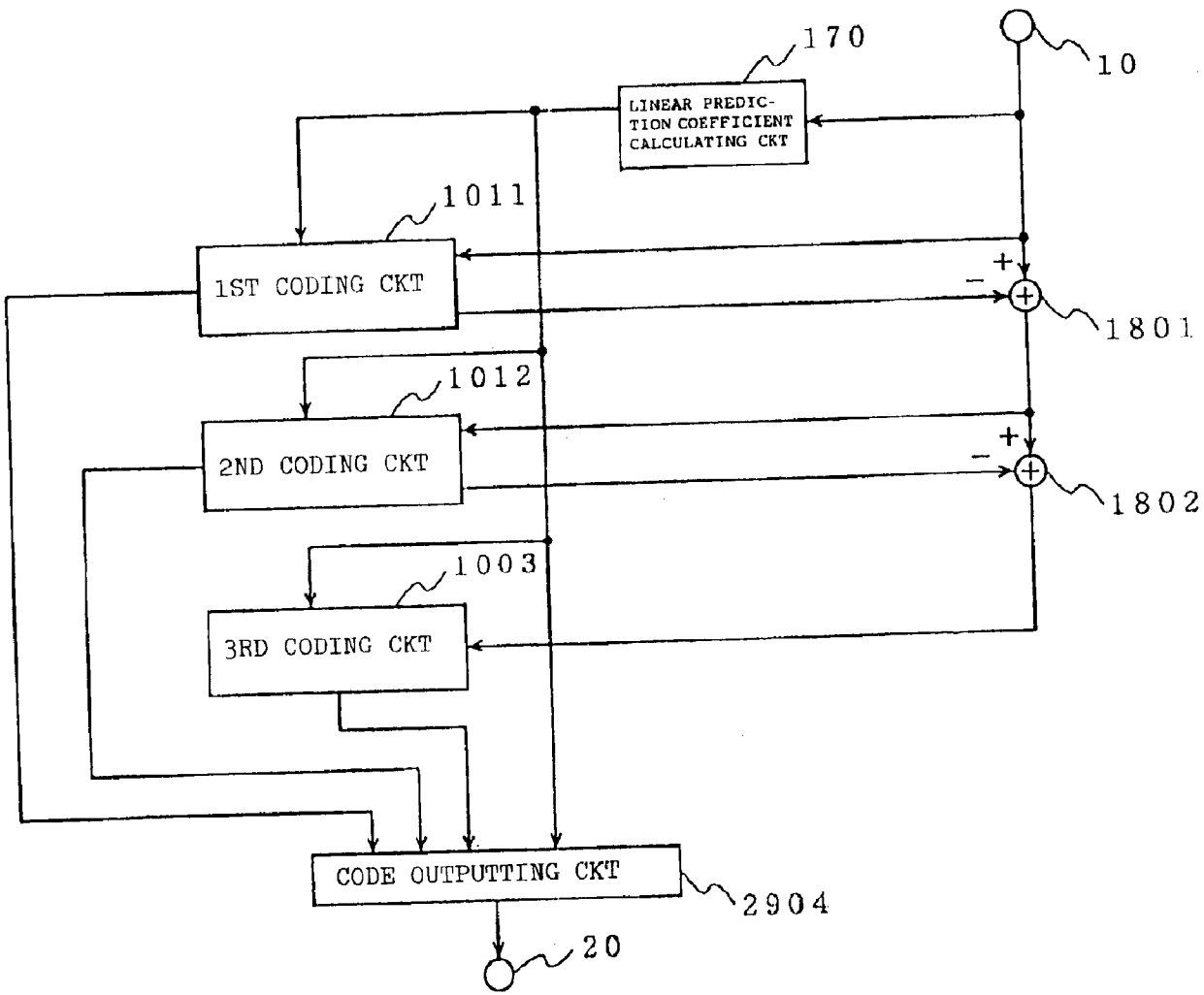
FIG. 14 is a block diagram showing a constitution of a speech and music signal coder according to a fifth embodiment of the invention.

A fifth embodiment of the invention is realized by expanding a number of bands to 3 in the fourth embodiment. A constitution of a speech and music signal coder according to the fifth embodiment of the invention can be represented by a block diagram shown in FIG. 14. In this case, the first coding circuit 1011 is equivalent to FIG. 12, a second coding circuit 1012 is equivalent to FIG. 12 and the third coding circuit 1003 is equivalent to FIG. 9. A code outputting circuit 2904 is inputted with an index outputted from the linear prediction coefficient calculating circuit 170, inputted with a set of indexes outputted from the first coding circuit 1011, inputted with a set of indexes outputted from the second coding circuit 1012 and inputted with a set of indexes outputted from the third coding circuit 1003. The respective indexes are converted into codes of bit series and outputted via the output terminal 20.

A sixth embodiment of the invention is realized by expanding the number of bands to N in the fourth embodiment. A constitution of a speech and music signal coder according to the sixth embodiment of the invention can be represented by a block diagram shown in FIG. 15. In this case, respectives of the first coding circuit 1011 through an (N−1)-th coding circuit 1014 are equivalent to FIG. 12. An N-th coding circuit 1005 is equivalent to FIG. 9. A code outputting circuit 2905 is inputted with an index outputted from the linear prediction coefficient calculating circuit 170, inputted with sets of indexes outputted from respectives of the first coding circuit 1011 through the (N−1)-th coding circuit 1014 and inputted with a set of indexes outputted from the N-th coding circuit 1005. Further, the respective indexes are converted into codes of bit series and outputted via the output terminal 20.

Figure 16:
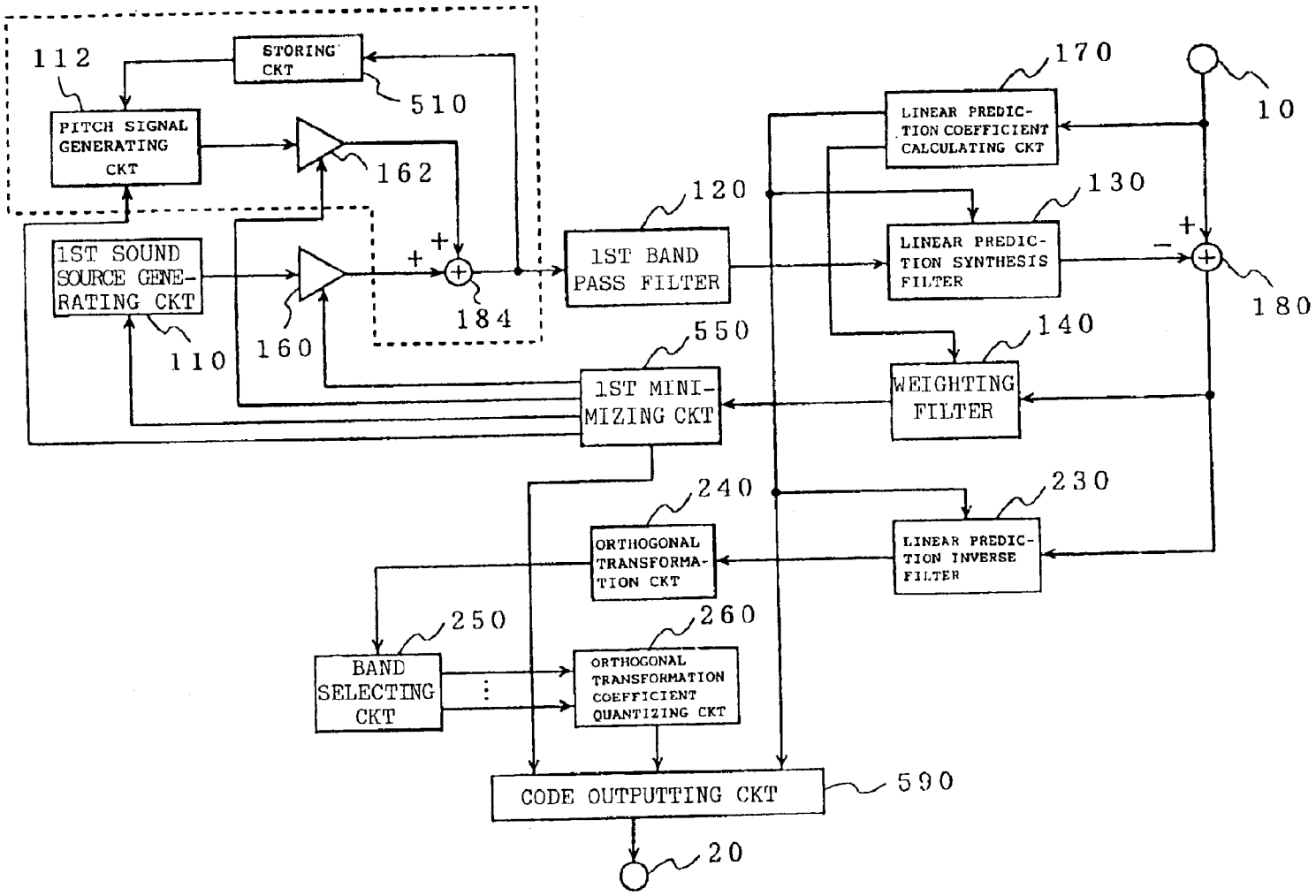
FIG. 16 is a block diagram showing a constitution of a speech and music signal coder according to a seventh embodiment of the invention.

FIG. 16 is a block diagram showing a constitution of a speech and music signal coder according to a seventh embodiment of the invention. A block surrounded by dotted lines in the drawing is referred to as a pitch prediction filter. FIG. 16 is provided by adding the pitch prediction filter to FIG. 3. In the following, an explanation will be given of a storing circuit 510, a pitch signal generating circuit 112, a third gain circuit 162, an adder 184, a first minimizing circuit 550 and a code outputting circuit 590 which are blocks different from those in FIG. 3.

The storing circuit 510 inputs a fifth sound source signal from the adder 184 and holds the fifth sound source signal. The storing circuit 510 outputs the fifth sound source signal which has been inputted in the past and held to the pitch signal generating circuit 112.

Figure 32:
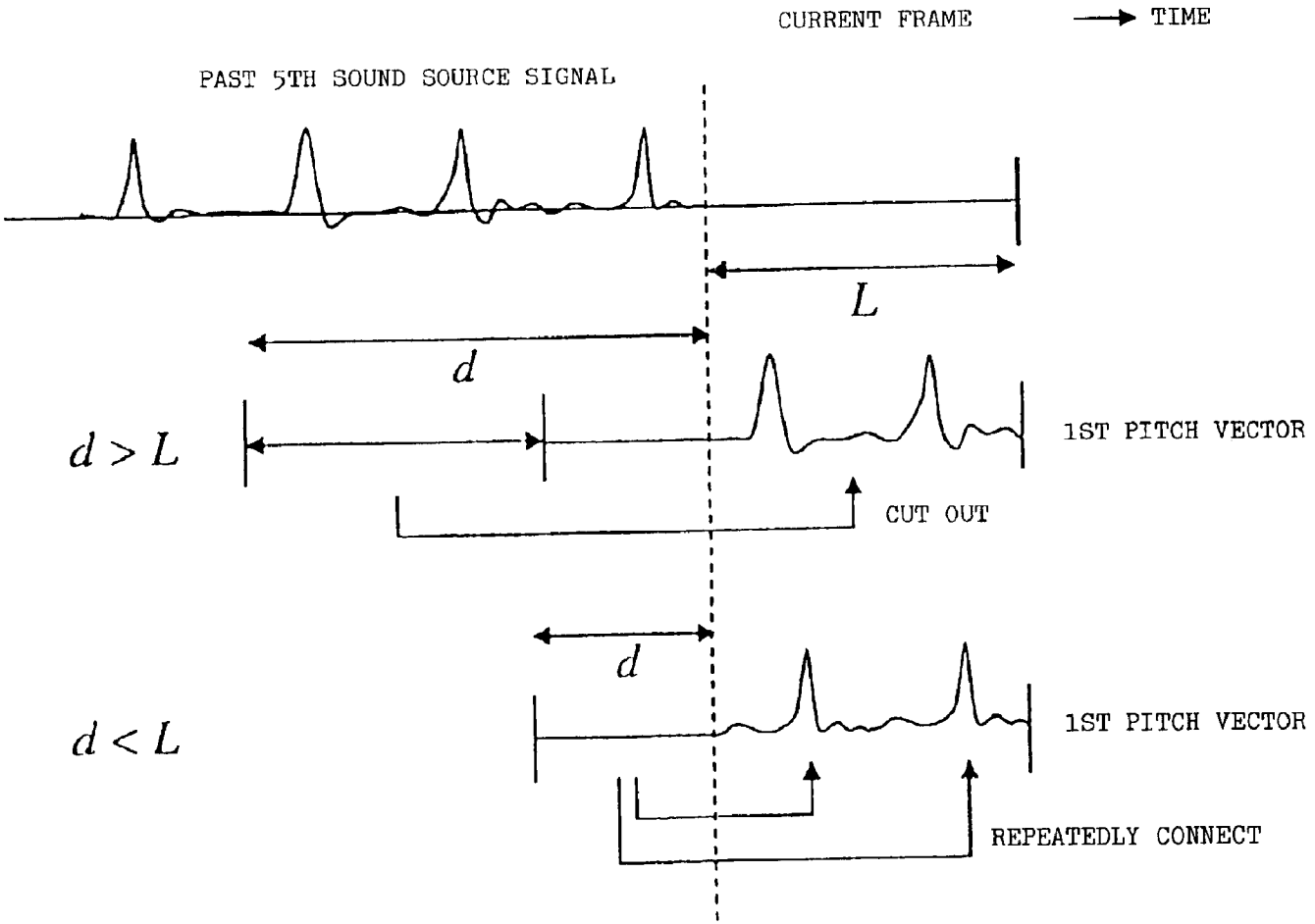
FIG. 32 is a view for explaining a method of generating a first pitch vector in a pitch signal generating circuit 112.

The pitch signal generating circuit 112 is inputted with the past fifth sound source signal held in the storing circuit 510 and an index outputted from the first minimizing circuit 550. The index designates a delay "d". Further, as shown in FIG. 32, in the past fifth sound source signal, a first pitch vector is generated by cutting out a signal of L sample in correspondence with a vector length from a point which is past from a start point of a current frame by d sample. In this case, in the case of d<L, a signal of d sample is cut out, the cut-out d sample is repeatedly connected and the first pitch vector having the vector length of L sample is generated. The pitch signal generating circuit 112 outputs the first pitch vector to the third gain circuit 162.

The third gain circuit 162 is provided with a table stored with values of gains. The third gain circuit 162 is inputted with an index outputted from the first minimizing circuit 550 and the first pitch vector outputted from the pitch signal generating circuit 112. A third gain in correspondence with the index is read from the table, the third gain is multiplied by the first pitch vector to thereby form a second pitch vector and the generated second pitch vector is outputted to the adder 184.

The adder 184 is inputted with the second sound source vector outputted from the first gain circuit 160 and the second pitch vector outputted from the third gain circuit 162. The adder 184 calculates a sum of the second sound source vector and the second pitch vector, constitutes a fifth sound source vector by the value and outputs the sound source vector to the first band pass filter 120.

In the first minimizing circuit 550, indexes in correspondence with all of the first sound source vectors stored in the first sound source generating vector 110 are successively outputted to the first sound source generating circuit 110. Indexes in correspondence with all of the delays "d" in a range prescribed in the pitch signal generating circuit 112, are successively outputted to the pitch signal generating circuit 112. Indexes in correspondence with all of the first gains stored in the first gain circuit 160 are successively outputted to the first gain circuit 160. Indexes in correspondence with all of third gains stored in the third gain circuit 162 are successively outputted to the third gain circuit 162. Further, the first minimizing circuit 550 successively inputs the first weighted difference vectors outputted from the weighting filter 140 and calculates the norm. The first minimizing circuit 550 selects the first sound source vector, the delay "d", the first gain and the third gain minimizing the norm, summarizes indexes in correspondence therewith and outputs the indexes to the code outputting circuit 590.

The code outputting circuit 590 is inputted with an index in correspondence with the quantized linear prediction coefficient outputted from the linear prediction coefficient calculating circuit 170. The code outputting circuit 590 is inputted with the indexes outputted from the first minimizing circuit 550 and in correspondence with respectives of the first sound source vector, the delay "d", the first gain and the third gain. The code outputting circuit 590 is inputted with a set of indexes outputted from the orthogonal transformation coefficient quantizing circuit 260 and constituted by indexes of shape code vectors and quantization gains in correspondence with Nsbv pieces of subvectors. Further, the respective indexes are converted into codes in bit series and outputted via the output terminal 20.

Figure 17:
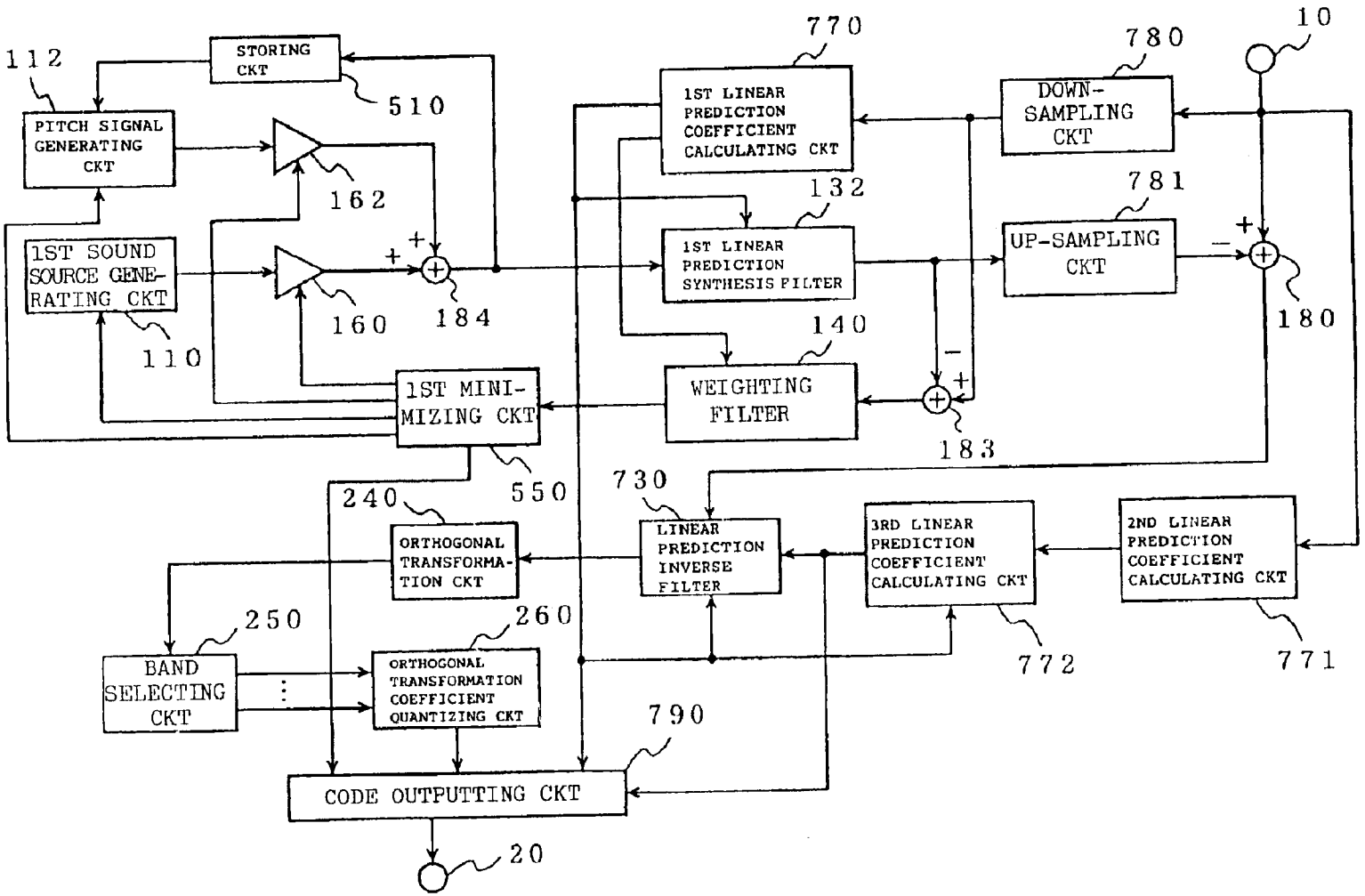
FIG. 17 is a block diagram showing a constitution of a speech and music signal coder according to an eighth embodiment of the invention.

FIG. 17 is a block diagram showing a constitution of a speech and music signal coder according to an eighth embodiment of the invention. In the following, an explanation will be given of a down-sampling circuit 780, a first linear prediction coefficient calculating circuit 770, a first linear prediction synthesis filter 132, a third differencer 183, an up-sampling circuit 781, a first differencer 180, a second linear prediction coefficient calculating circuit 771, a third linear prediction coefficient calculating circuit 772, a linear prediction inverse filter 730 and a code outputting circuit 790 which are blocks different from those in FIG. 16.

The down-sampling circuit 780 receives an input vector from the input terminal 10 and outputs a second input vector provided by down-sampling the input vector and having a first band to the first linear prediction coefficient calculating circuit 770 and the third differencer 183. Here, the first band is set to Fs1 [Hz] through Fe1 [Hz] similar to the first embodiment and a band of the input vector is set to Fs0 [Hz] through Fe0 [Hz] (third band). With regard to a constitution of the down-sampling circuit, a description is given to paragraph 2.3.2 of a document titled as "Multirate Digital Signal Processing" (Prentice-Hall Signal Processing Series, 1983) by R. E. Crochiere and L. R. Rabiner (Reference 6).

The first linear prediction coefficient calculating circuit 770 receives the second input vector from the down-sampling circuit.780, carries out linear prediction analysis with regard to the second input vector, calculates a first linear prediction coefficient having the first band, further, quantizes the first linear prediction coefficient and calculates a first quantized linear prediction coefficient. The first linear prediction coefficient calculating circuit 770 outputs the first linear prediction coefficient to the first weighting filter 140 and outputs an index in correspondence with the first quantized linear prediction coefficient to the first linear prediction synthesis filter 132, the linear prediction inverse filter 730 and the third linear prediction coefficient calculating circuit 772 and the code outputting circuit 790.

The first linear prediction synthesis filter 132 is provided with a table stored with first quantized linear prediction coefficients. The first linear prediction synthesis filter 132 is inputted with the fifth sound source vector outputted from the adder 184 and the index in correspondence with the first quantized linear prediction coefficient outputted from the first linear prediction coefficient calculating circuit 770. Further, the first linear prediction synthesis filter 132 reads a first quantized linear prediction coefficient in correspondence with the index from the table and drives the synthesis filter set with the first quantized linear prediction coefficient by the fifth sound source vector to thereby form a first reproduced vector having the first band. Further, the first reproduced vector is outputted to the third differencer 183 and the up-sampling circuit 781.

The third differencer 183 receives the first reproduced vector outputted from the first linear prediction synthesis filter 132 and the second input vector outputted from the down-sampling circuit 780, calculates a difference therebetween and outputs the difference as a second difference vector to the weighting filter 140.

The up-sampling circuit 781 receives the first reproduced vector outputted from the first linear prediction synthesis filter 132, up-samples the first reproduced vector and generates a third reproduced vector having a third band. In this case, the third band falls in a range of Fs0 [Hz] through Fe0 [Hz]. The up-sampling circuit 781 outputs the third reproduced vector to the first differencer 180. With regard to a constitution of the up-sampling circuit, a description is given to paragraph 2.3.2 of a document titled as "Multirate Digital Signal Processing" (Prentice-Hall Signal Processing Series, 1983) by R. E. Crochiere and L. R. Rabiner (Reference 6).

The first differencer 180 receives the input vector via the input terminal 10 and the third reproduced vector outputted from the up-sampling circuit 781, calculates a difference therebetween and outputs the difference as a first difference vector to the linear prediction inverse filter 730.

The second linear prediction coefficient calculating circuit 771 receives the input vector from the input terminal 10, carries out linear prediction analysis with respect to the input vector, calculates a second linear prediction coefficient having the third band and outputs the second linear prediction coefficient to the third linear prediction coefficient calculating circuit 772.

The third linear prediction coefficient calculating circuit 772 is provided with a table stored with first quantized linear prediction coefficients. The third linear prediction coefficient calculating circuit 772 is inputted with the second linear prediction coefficient outputted from the second linear prediction coefficient calculating circuit 771 and the index in correspondence with the first quantized linear prediction coefficient outputted from the first linear prediction coefficient calculating circuit 770. The third linear prediction coefficient calculating circuit 772 reads a first quantized linear prediction coefficient in correspondence with the index from the table, converts the first quantized linear prediction coefficient into LSP, further and subjects LSP to sampling frequency conversion to thereby form first LSP in correspondence with a sampling frequency of the input signal. Further, the third linear prediction coefficient calculating circuit 772 converts the second linear prediction coefficient into LSP and generates a second LSP. The third linear prediction coefficient calculating circuit 772 calculates a difference between second LSP and first LSP. A difference value thereof is defined as third LSP. Here, with regard to the sampling frequency conversion of LSP, a description is given to Japanese Unexamined Patent Publication (JP-A) No. 030997/1999 (Reference 7). The third LSP is quantized and the quantized third LSP is converted into a linear prediction coefficient and a third quantized linear prediction coefficient having the third band is generated. Further, the index in correspondence with the third quantized linear prediction coefficient is outputted to the linear prediction inverse filter 730 and the code outputting circuit 790.

The linear prediction inverse filter 730 is provided with a first table stored with first quantized linear prediction coefficients and a second table stored with third quantized linear prediction coefficients. The linear prediction inverse filter 730 is inputted with a first index in correspondence with the first quantized linear prediction coefficient outputted from the first linear prediction coefficient calculating circuit 770 and a second index in correspondence with the third quantized linear prediction coefficient outputted from the third linear prediction coefficient calculating circuit 772 and the first difference vector outputted from the first differencer 180. The linear prediction inverse filter 730 reads a first quantized linear prediction coefficient in correspondence with the first index from the first table, converts the first quantized linear prediction coefficient into LSP, further, subjects LSP to sampling frequency conversion to thereby generate first LSP in correspondence with the sampling frequency of the input signal. Further, the third quantized linear prediction coefficient in correspondence with the second index is read from the second table and converted into LSP to thereby generate third LSP. Next, the first LSP and the third LSP are added together to thereby generate second LSP. The linear prediction inverse filter 730 converts the second LSP into a linear prediction coefficient and generates a second quantized linear prediction coefficient. The linear prediction inverse filter 730 generates a first residue vector by driving the inverse filter set with the second quantized linear prediction coefficient by the first difference vector. The first residue vector is outputted to the orthogonal transformation circuit 240.

The code outputting circuit 790 is inputted with the index in correspondence with the first quantized linear prediction coefficient outputted from the first linear prediction coefficient calculating circuit 770, the index in correspondence with the third quantized linear prediction coefficient outputted from the third linear prediction coefficient calculating circuit 772, the index outputted from the first minimizing circuit 550 and in correspondence with respectives of the first sound source vector, the delay "d", the first gain and the third gain and the set of indexes outputted from the orthogonal transformation coefficient quantizing circuit 260 and constituted by indexes of the shape code vectors and the quantization gains in correspondence with Nsbv pieces of the subvectors. The respective indexes are converted into codes in bit series and outputted via the output terminal 20.

Figure 18:
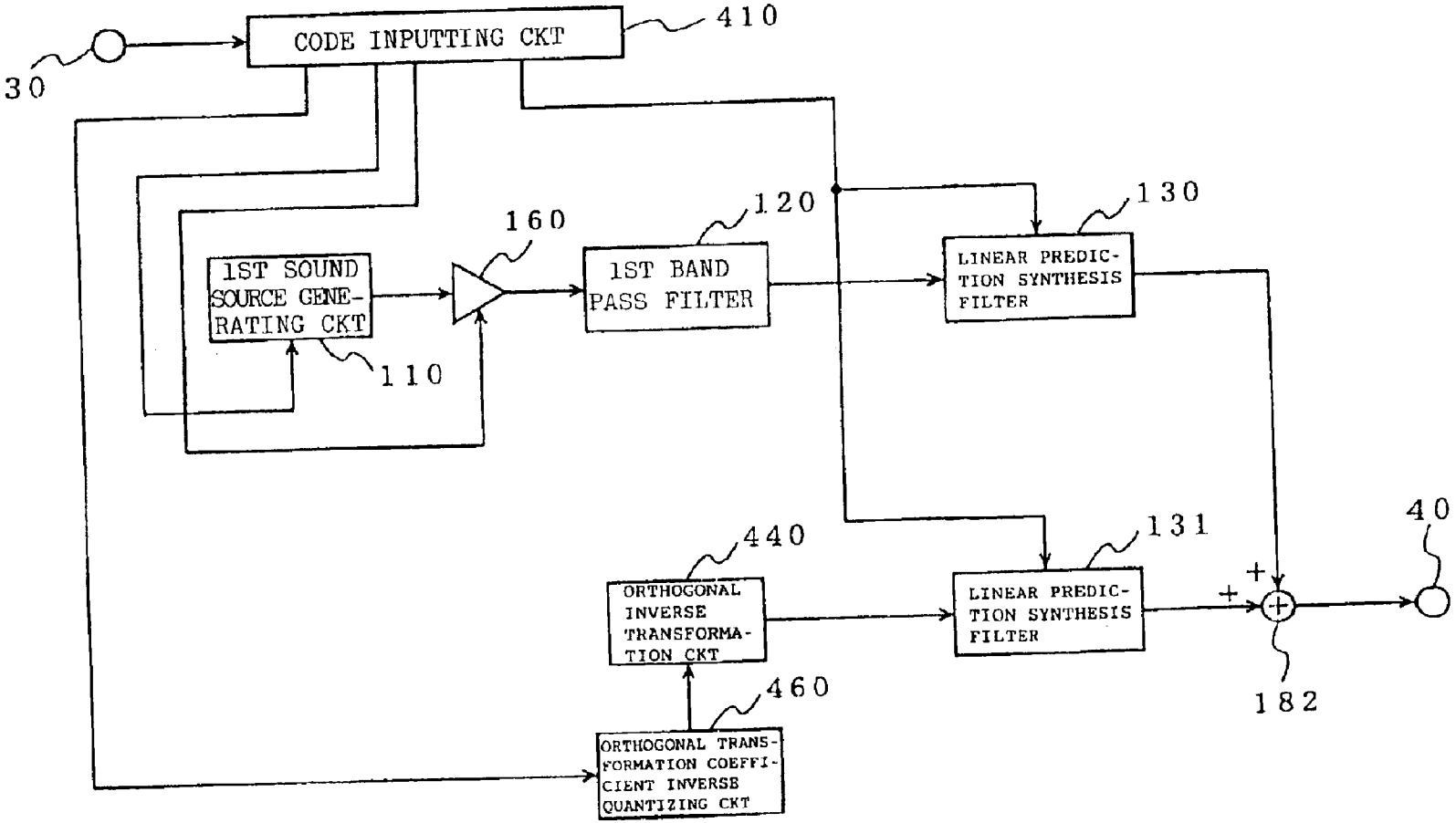
FIG. 18 is a block diagram showing a constitution of a vocal music signal decoding apparatus according to a ninth embodiment of the invention.

FIG. 18 is a block diagram showing a constitution of a vocal music signal decoding apparatus in correspondence with the first embodiment by the ninth embodiment of the invention. The decoding apparatus is inputted with codes in bit series from the input terminal 30.

A code inputting circuit 410 converts codes in bit series inputted from the input terminal 30 into indexes. An index in correspondence with the first sound source vector is outputted to the first sound source generating circuit 110. An index in correspondence with the first gain is outputted to the first gain circuit 160. An index in correspondence with the quantized linear prediction coefficient is outputted to the linear prediction synthesis filter 130 and the linear prediction synthesis filter 131. A set of indexes summarizing indexes in correspondence with respectives of the shape code vectors and the quantized gains with regard to the subvectors for Nsbv pieces of the subvectors is outputted to the orthogonal transformation coefficient inverse quantizing circuit 460.

The first sound source generating circuit 110 receives the index outputted from the code inputting circuit 410, reads the first sound source vector in correspondence with the index from a table stored with a plurality of sound source vectors and outputs the first sound source vector to the first gain circuit 160.

The first gain circuit 160 is provided with a table stored with quantized gains. The first gain circuit 160 receives the index outputted from the code inputting circuit 410 and the first sound source vector outputted from the first sound source generating circuit 110, reads the first gain in correspondence with the index from the table, multiplies the first gain by the first sound source vector and generates the second sound source vector. The generated second sound source vector is outputted to the first band pass filter 120.

The first band pass filter 120 is inputted with the second sound source vector outputted from the first gain circuit 160. The band of the second sound source vector is restricted to the first band by the filter to thereby generate the first excitation vector. The first band pass filter 120 outputs the first excitation vector to the linear prediction synthesis filter 130.

Figure 20:
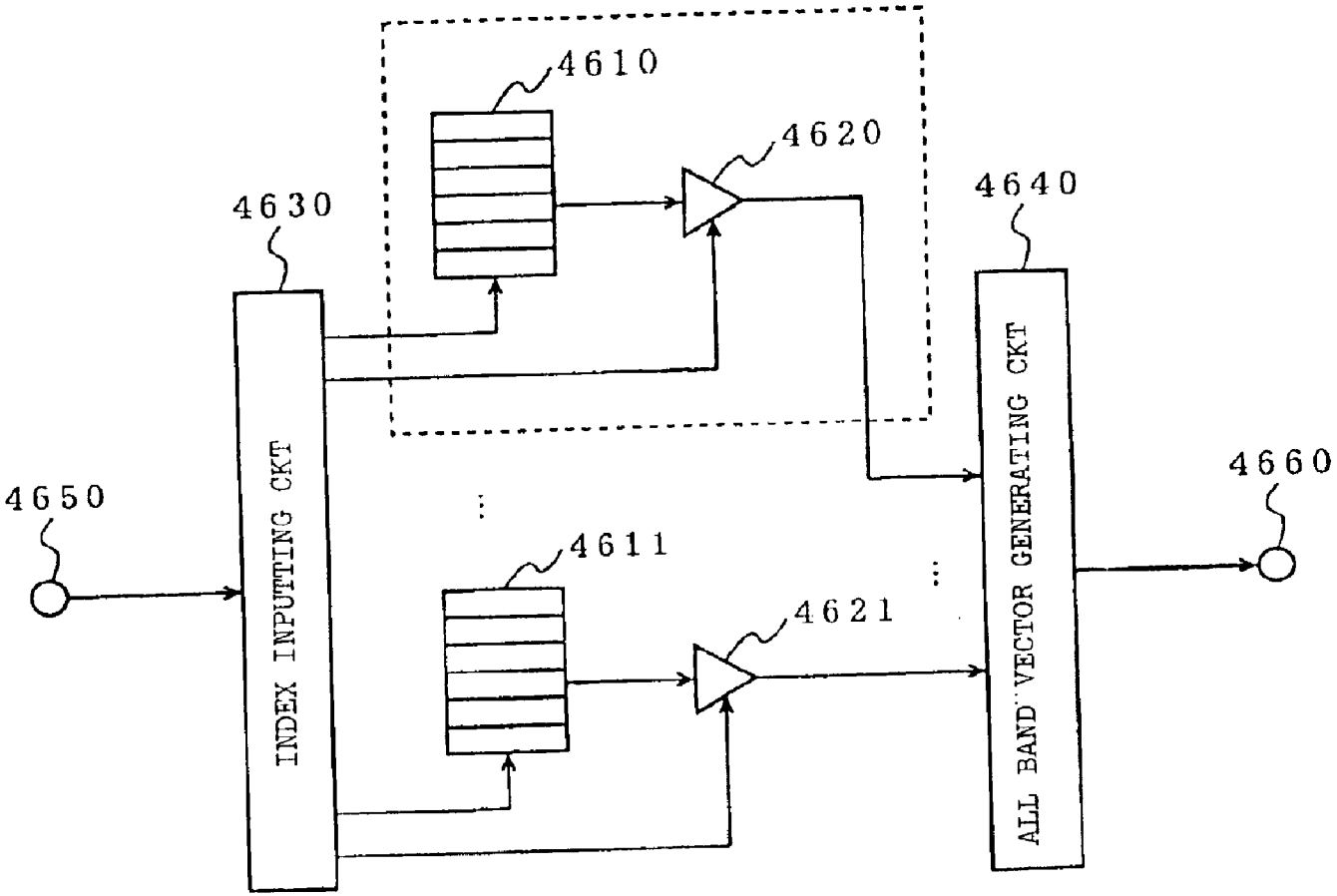
FIG. 20 is a block diagram showing a constitution of the orthogonal transformation coefficient inversely quantizing circuit 460.

An explanation will be given of a constitution of the orthogonal transformation coefficient inverse quantizing circuit 460 in reference to FIG. 20. In FIG. 20, there are Nsbv pieces of blocks surrounded by dotted lines. Nsbv pieces of quantized subvectors prescribed at the band selecting circuit 250 of FIG. 3 by the respective blocks, are represented by Equation (11) as follows. Nsbv pieces of the quantized subvectors are decoded.

$$e_{sb,0}(n), \ldots, e'_{sb,N_{sbv}-1}(n), n=0, \ldots, L-1 \qquad \text{Equation (11)}$$

A decoding processing with regard to the respective quantized subvectors is common. In the following, an explanation will be given of a processing with respect to e' sb,0 (n), n=0, . . . , L−1. Similar to the processing at the orthogonal transformation coefficient quantizing circuit 260 in FIG. 3, the quantized subvectors e' sb,0 (n), n=0, . . . , L−1 is represented by a product of the shape code vector c0[j] (n) N=0, . . . , L−1 and the quantization gain g0[k]. Here, notations "j" and "k" represent indexes. An index inputting circuit 4630 inputs a set "if" of indexes constituted by indexes of the shape code vectors and the quantization gains with regard to Nsbv pieces of the quantized subvectors outputted from the code inputting circuit 410 via an input terminal 4650. Further, from the set "if" of indexes, an index i sbs,0 designating the shape code vector c0[j] (n), n=0, . . . , L−1 and an index i sbg,0 designating the quantization gain g0[k], are taken out, i sbs,0 is outputted to a table 4610 and i sbg,0 is outputted to a gain circuit 4620. The table 4610 is stored with c[j] (n), n=0, . . . , L−1, j=0, . . . , Nc,0−1. The table 4610 inputs the index i sbs,0 outputted from the index inputting circuit 4630 and outputs the shape code vector c0[j] (n), n=0, . . . , L−1, j=i sbs,0 in correspondence with i sbs,0 to the gain circuit 4620. A table provided to the gain circuit 4620 is stored with g0[k], k=0, . . . , Ng,0−1. The gain circuit 4620 receives c0[j] (n), n=0, . . . , L−1, j=i sbs,0 outputted from the table 4610 and the index i sbg,0 outputted from the index inputting circuit 4630, reads the quantization gain g0[k], k=i sbg,0 in correspondence with i sbg,0 from the table and outputs the quantized subvector e' sb,0 (n), n=0, . ., L−1 provided by multiplying c0[j] (n) n=0, . . . , L−1, j=i sbg,0 by g0[k], k=i sbg,0 to an all band vector generating circuit 4640. The all band vector generating circuit 4640 is inputted with the quantized subvectors e' sb,0 (n), n=0, . . . , L−1 outputted from the gain circuit 4620. Further, the all band vector generating circuit 4640 is inputted with vectors provided by a processing similar to that of e' sb,0 (n), n=0, . . . , L−1 and represented by Equation (12) as follows.

$$e'_{sb,1}(n), \ldots, e'_{sb,N_{sbv}-1}(n), n=0, \ldots, L-1 \qquad \text{Equation (12)}$$

Figure 19:
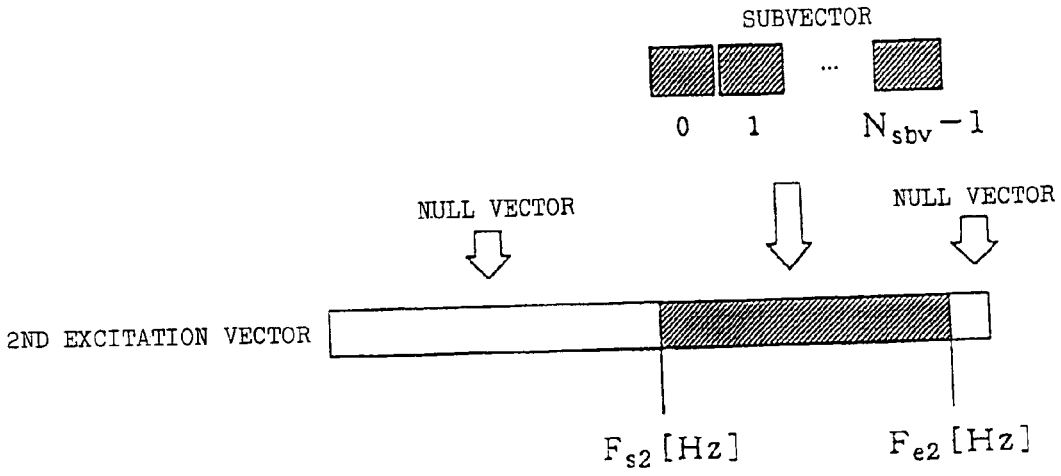
FIG. 19 is a view for explaining a method of generating a second excitation vector in an orthogonal transformation coefficient inversely quantizing circuit 460.

As shown by FIG. 19, by arranging Nsbv pieces of the quantized subvectors (Equation (11)) in the second band prescribed by the band selecting circuit 250 in FIG. 3 and arranging null vector to other than the second band, the second excitation vector in correspondence with all of the bands (for example, when sampling frequency of reproduction signal is 16 kHz, 8 kHz band), is generated and the second excitation vector is outputted to the orthogonal inverse transformation circuit 440 via an output terminal 4660.

The orthogonal inverse transformation circuit 440 receives the second excitation vector outputted from the orthogonal transformation coefficient inverse quantizing circuit 460 and subjects the second excitation vector to orthogonal inverse transformation to thereby provide the third excitation vector. Further, the third excitation vector is outputted to the linear prediction synthesis filter 131. In this case, as orthogonal inverse transformation, inverse discrete cosine transform (IDCT) can be used.

The linear prediction synthesis filter 130 is provided with a table stored with quantized linear prediction coefficients. The linear prediction synthesized filter 130 is inputted with the first excitation vector outputted from the first band pass filter 120 and the index in correspondence with the quantized linear prediction coefficient outputted from the code inputting circuit 410. Further, the linear prediction synthesis filter 130 reads the quantized linear prediction coefficient in correspondence with the index from the table and generates the first reproduced vector by driving the synthesized filter 1/A(z) set with the quantized linear prediction coefficient by the first excitation vector. Further, the first reproduced vector is outputted to the adder 182.

The linear prediction synthesis filter 131 is provided with a table stored with quantized linear prediction coefficients. The linear prediction synthesis filter 131 is inputted with the third excitation vector outputted from the orthogonal inverse transformation circuit 440 and the index in correspondence with the quantized linear prediction coefficient outputted from the code inputting circuit 410. Further, the linear prediction synthesis filter 131 reads the quantized linear prediction coefficient in correspondence with the index from the table and generates the second reproduced vector by driving the synthesis filter 1/A(z) set with the quantized linear prediction coefficient by the third excitation vector. The second reproduced vector is outputted to the adder 182.

The adder 182 receives the first reproduced vector outputted from the linear prediction synthesized filter 130 and the second reproduced vector outputted from the linear prediction synthesis filter 131, calculates a sum of these and outputs the sum as the third reproduced vector via the output terminal 40.

Although the ninth embodiment explained in reference to FIG. 18 shows the case in which the number of bands is 2, in the following, an explanation will be given of a case in which the number of bands is expanded to 3 or more.

Figure 21:
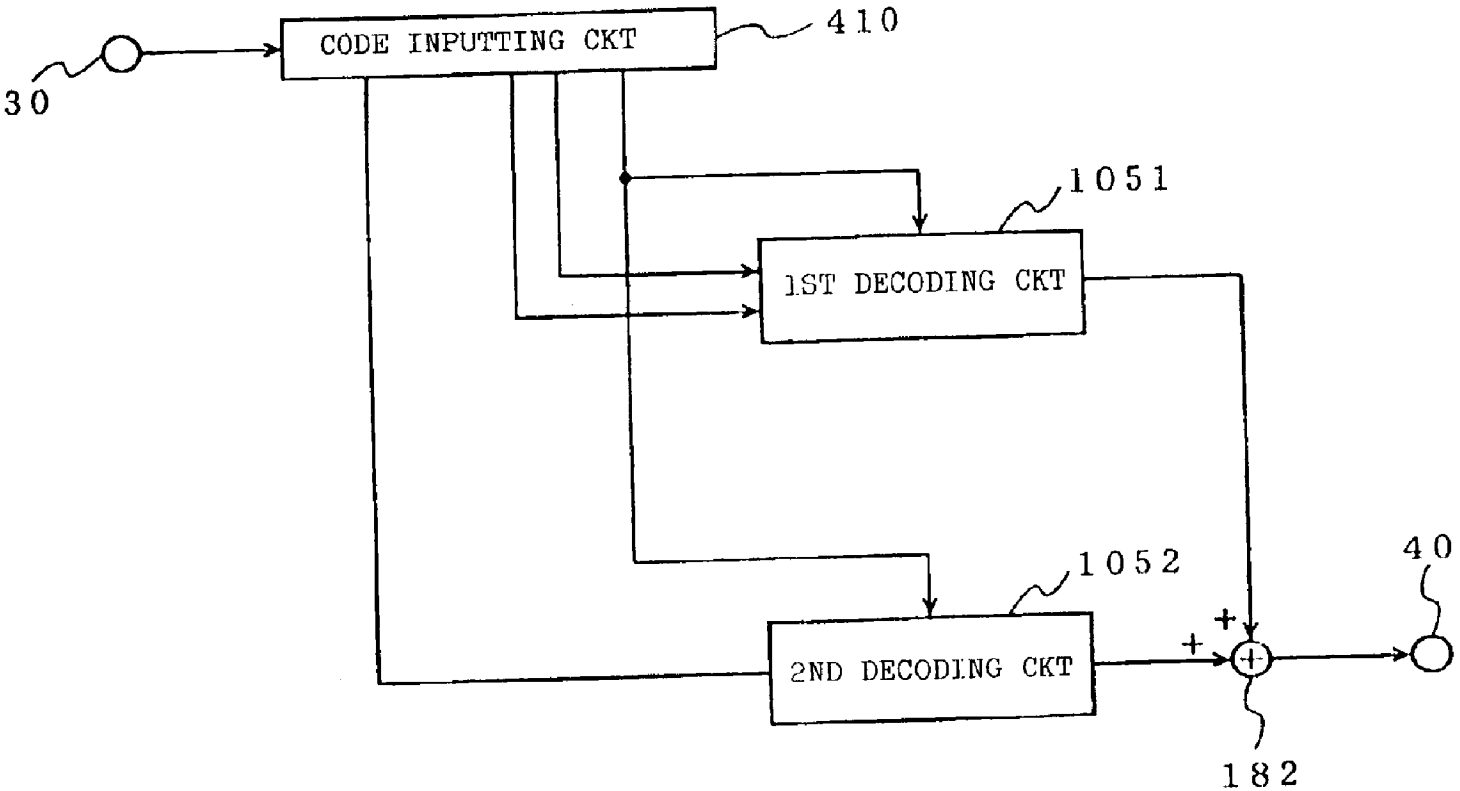
FIG. 21 is a block diagram equivalent to FIG. 36 showing the constitution of the vocal music signal decoding apparatus according to the ninth embodiment of the invention.
Figure 22:
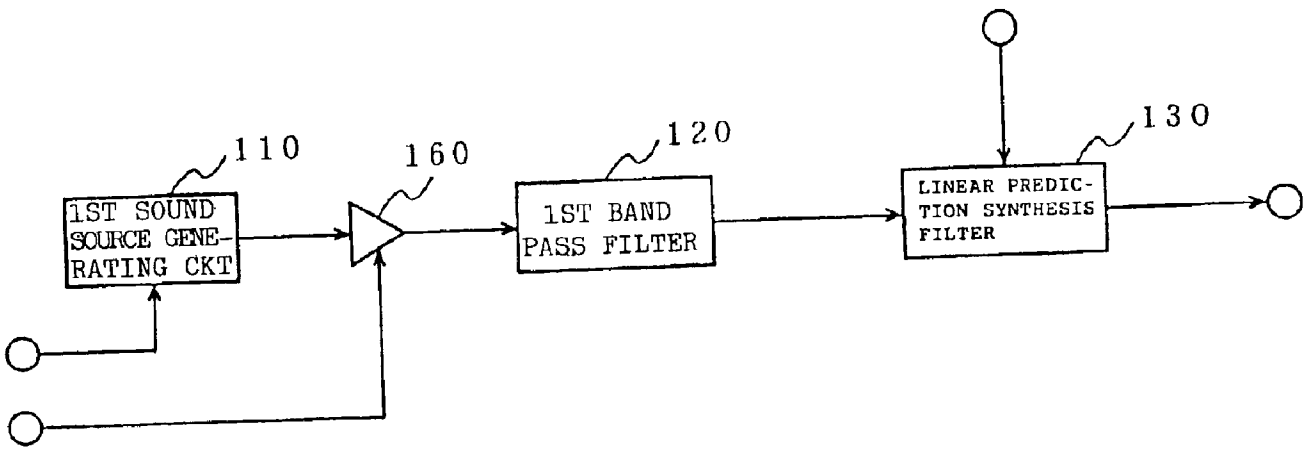
FIG. 22 is a block diagram showing a constitution of a first decoding circuit 1051 in FIG. 39.
Figure 23:
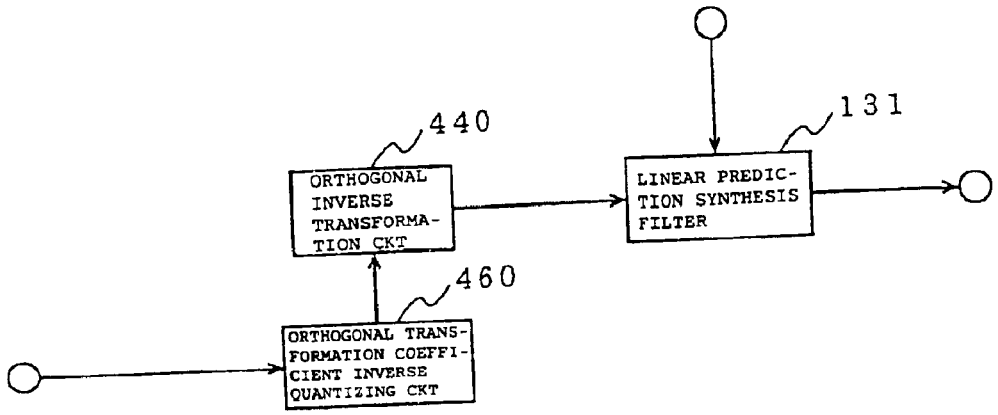
FIG. 23 is a block diagram showing a constitution of a second decoding circuit 1052 in FIG. 39.

FIG. 18 can be rewritten as shown by FIG. 21. In this case, a first decoding circuit 1061 of FIG. 21 is equivalent to FIG. 22, a second decoding circuit 1052 of FIG. 21 is equivalent to FIG. 23 and the respective blocks constituting FIG. 22 and. FIG. 23 are the same as respective blocks explained in reference to FIG. 18.

Figure 24:
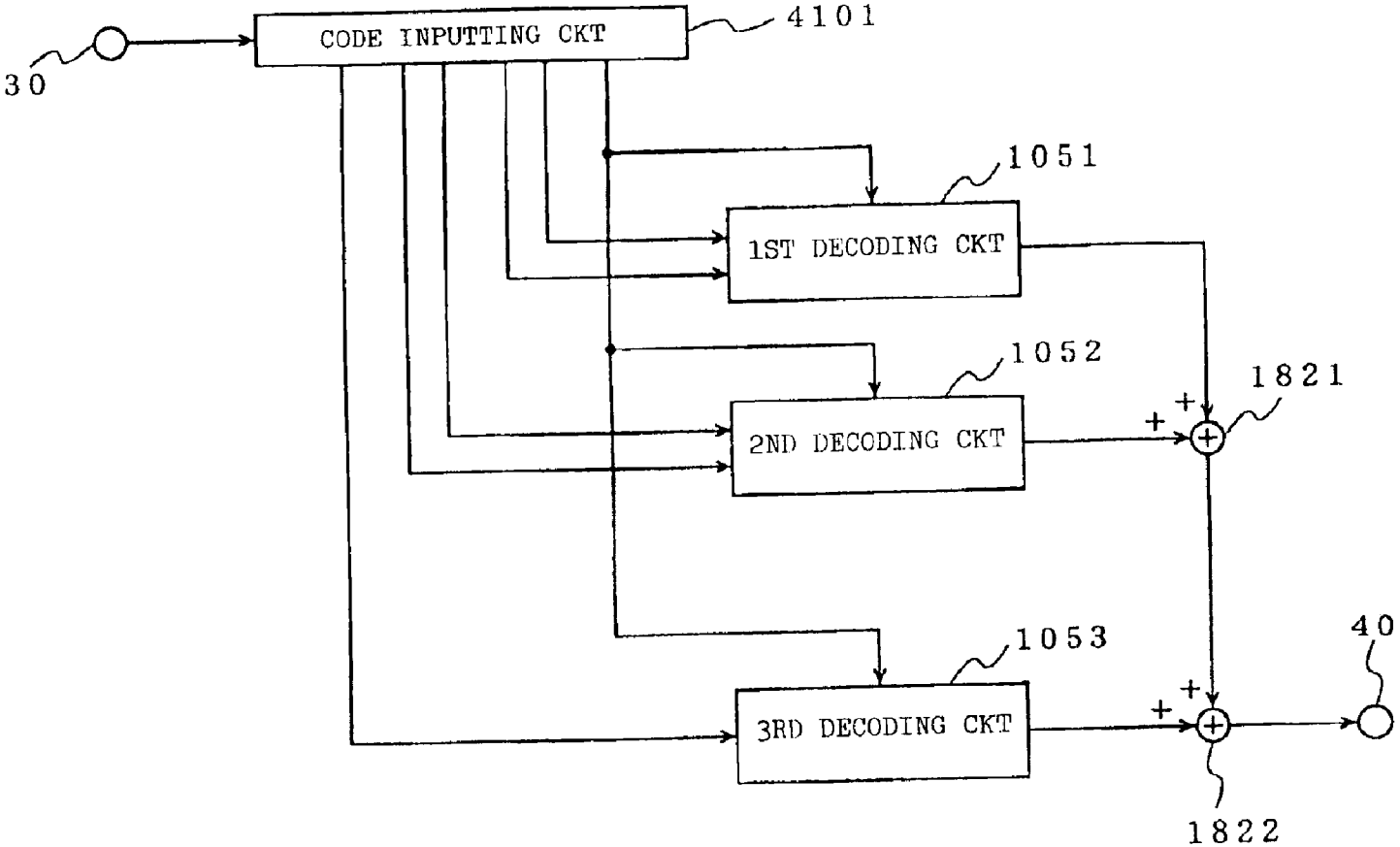
FIG. 24 is a block diagram showing a constitution of a vocal music signal decoding apparatus according to a tenth embodiment of the invention.

A tenth embodiment of the invention is realized by expanding the number of bands to 3 in the ninth embodiment. A constitution of a vocal music signal decoding apparatus according to the tenth embodiment of the invention can be represented by a block diagram shown in FIG. 24. In this case, the first decoding circuit 1051 is equivalent to FIG. 22, the second decoding circuit 1052 is equivalent to FIG. 22 and a third decoding circuit 1053 is equivalent to FIG. 23. The code input circuit 4101 converts codes in bit series inputted from the input terminal 30 into indexes, outputs an index in correspondence with the quantized linear prediction coefficient to the first decoding circuit 1051, the second decoding circuit 1052 and the third decoding circuit 1053, outputs indexes in correspondence with sound source vectors and gains to the first decoding circuit 1051 and the second decoding circuit 1052 and outputs a set of indexes in correspondence with the shape code vectors and the quantization gains with regard to the subvectors to the third decoding circuit 1053.

Figure 25:
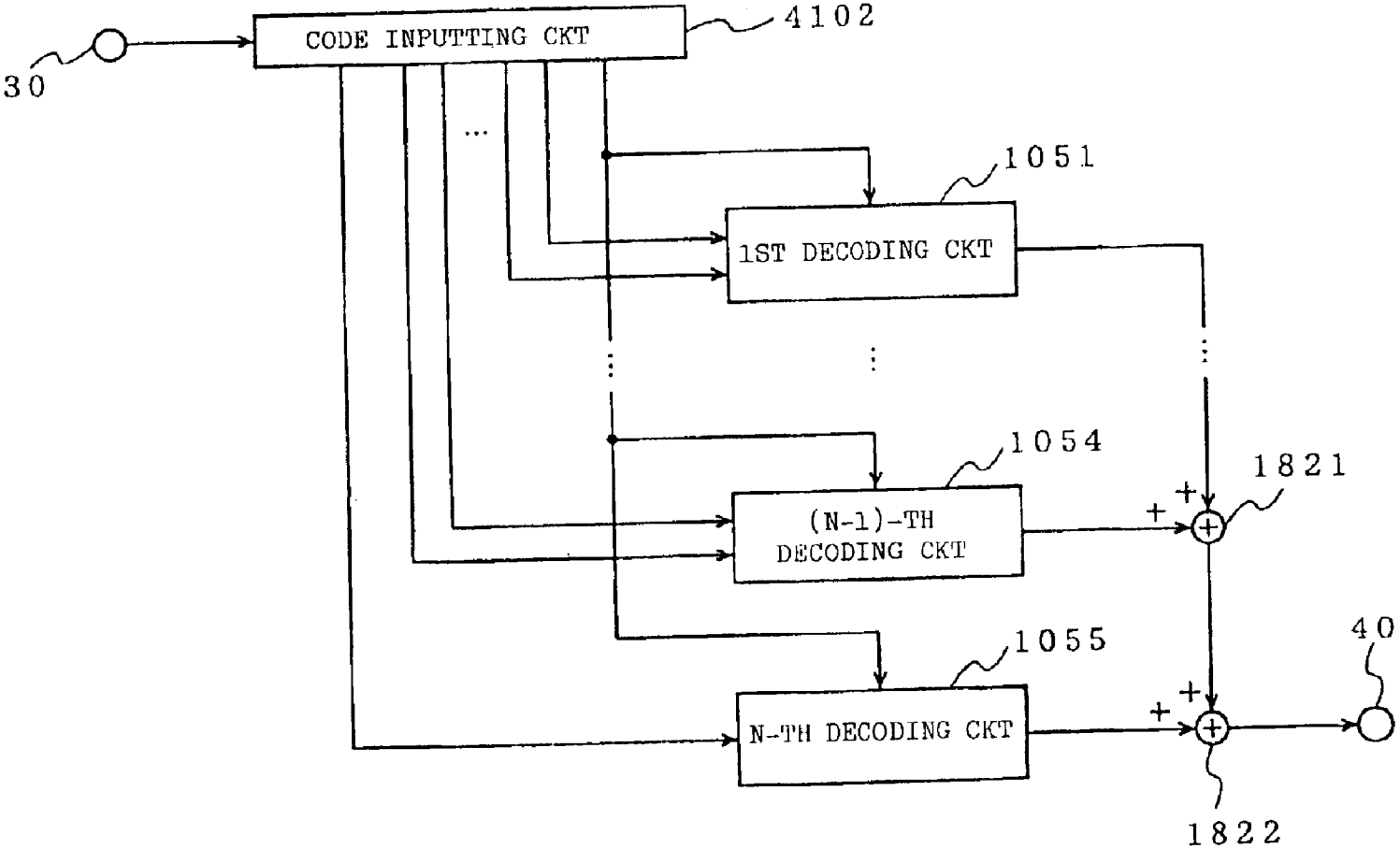
FIG. 25 is a block diagram showing a constitution of a vocal music signal decoding apparatus according to an eleventh embodiment of the invention.

An eleventh element of the invention is realized by expanding a number of bands to N in the ninth embodiment. A constitution of a vocal music signal decoding apparatus according to the eleventh embodiment of the invention can be represented by a block diagram shown in FIG. 25. In this case, respectives of the first decoding circuit 1051 through an (N−1)-th decoding circuit 1054 are equivalent to FIG. 22 and an N-th decoding circuit 1055 is equivalent to FIG. 23. The code inputting circuit 4102 converts codes in bit series inputted from the input terminal 30 into indexes, outputs an index in correspondence with the quantized linear prediction coefficient to respectives of the first decoding circuit 1051 through the (N−1)-th decoding circuit 1054 and the N-th decoding circuit 1055, outputs indexes in correspondence with the sound source vectors and the gains to respectives of the first decoding circuit 1051 through the (N−1)-th decoding circuit 1054 and outputs a set of indexes in correspondence with the shape code vectors and the quantization gains of the subvectors to the N-th decoding circuit 1055.

Although according to the ninth embodiment, the first decoding circuit 1051 in FIG. 21 is based on a decoding system in correspondence with the coding system using the A-b-S method, a decoding system in correspondence with a coding system other than the A-b-S method is applicable also to the first decoding circuit 1051. In the following, an explanation will be given of a case in which a decoding system in correspondence with the coding system using time frequency conversion is applied to the first decoding circuit 1051.

Figure 26:
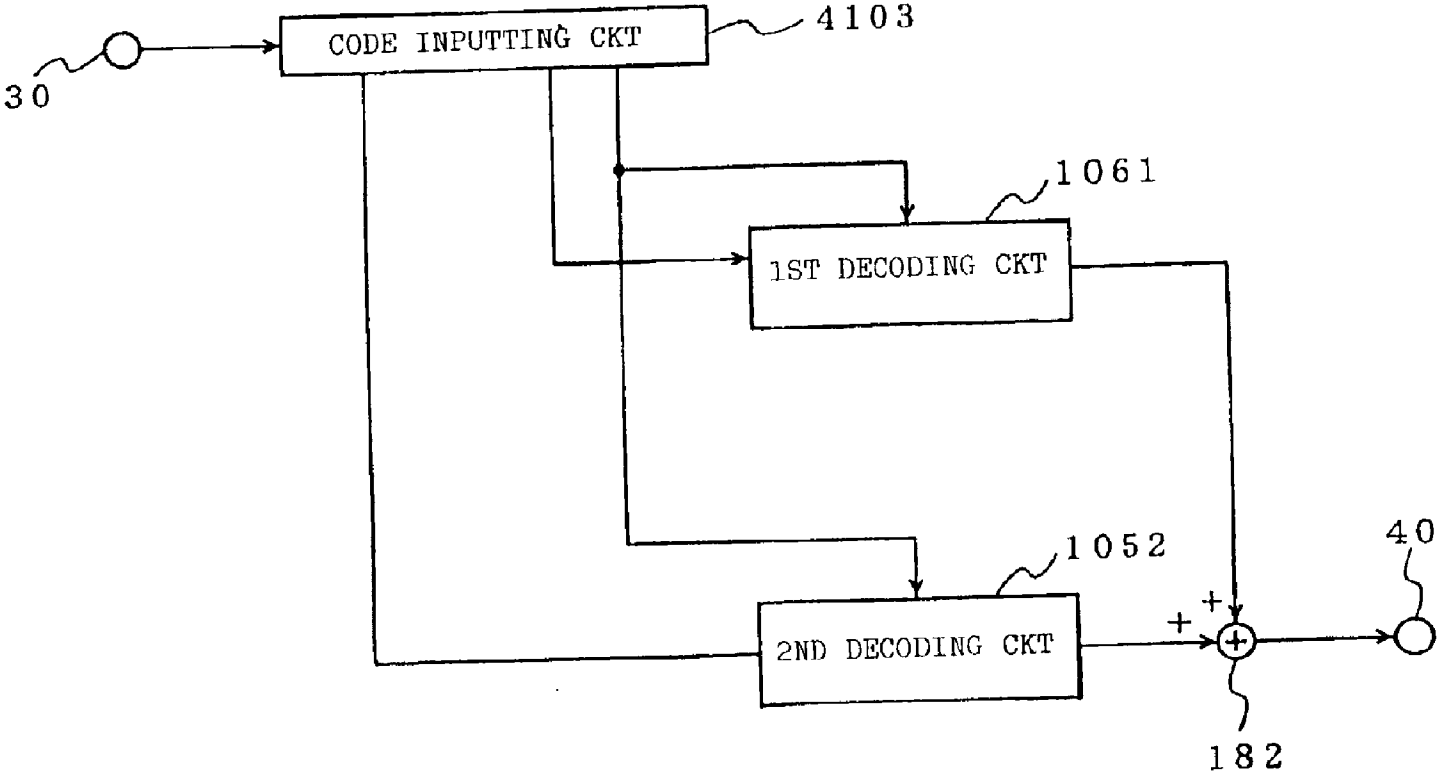
FIG. 26 is a block diagram showing a constitution of a vocal music signal decoding apparatus according to a twelfth embodiment of the invention.

A twelfth embodiment of the invention is realized by applying the decoding system in correspondence with the coding system using time frequency conversion in the ninth embodiment. A constitution of a vocal music signal decoding apparatus according to the twelfth embodiment of the invention can be represented by a block diagram shown in FIG. 26. In the drawing, a first decoding circuit 1061 is equivalent to FIG. 23 and the second decoding circuit 1052 is equivalent to FIG. 23. A code inputting circuit 4103 converts codes in bit series inputted from the input terminal 30 into indexes, outputs an index in correspondence with the quantized linear prediction coefficient to the first decoding circuit 1061 and the second decoding circuit 1052 and outputs a set of indexes in correspondence with the shape code vectors and the quantization gains with regard to the subvectors to the first decoding circuit 1061 and the second decoding circuit 1052.

Figure 27:
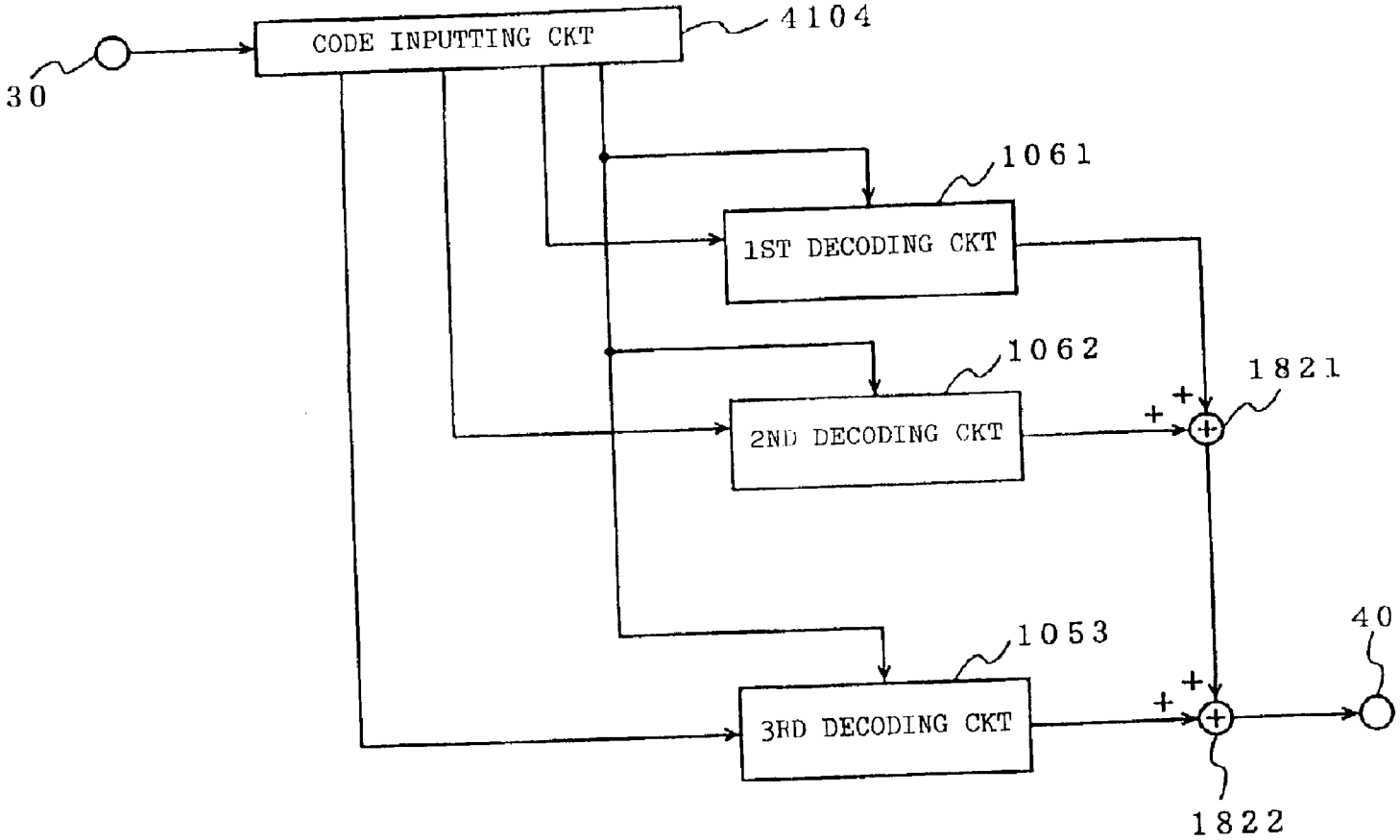
FIG. 27 is a block diagram showing a constitution of a vocal music signal decoding apparatus according to a thirteenth embodiment of the invention.

A thirteenth embodiment of the invention is realized by expanding the number of bands to 3 in the twelfth embodiment. A constitution of a vocal music signal decoding apparatus according to the thirteenth embodiment of the invention can be represented by a block diagram shown in FIG. 27. In this case, the first decoding circuit 1061 is equivalent to FIG. 23, the second decoding circuit 1062 is equivalent to FIG. 23 and a third decoding circuit 1053 is equivalent to FIG. 23. The code inputting circuit 4104 converts codes in bit series inputted from the input terminal 30 into indexes, outputs an index in correspondence with the quantized linear prediction coefficient to the first decoding circuit 1061, the second decoding circuit 1062 and the third decoding circuit 1053 and outputs a set of indexes in correspondence with the shape code vectors and the quantization gains with regard to the subvectors to the first decoding circuit 1061, the second decoding circuit 1062 and the third decoding circuit 1053.

Figure 28:
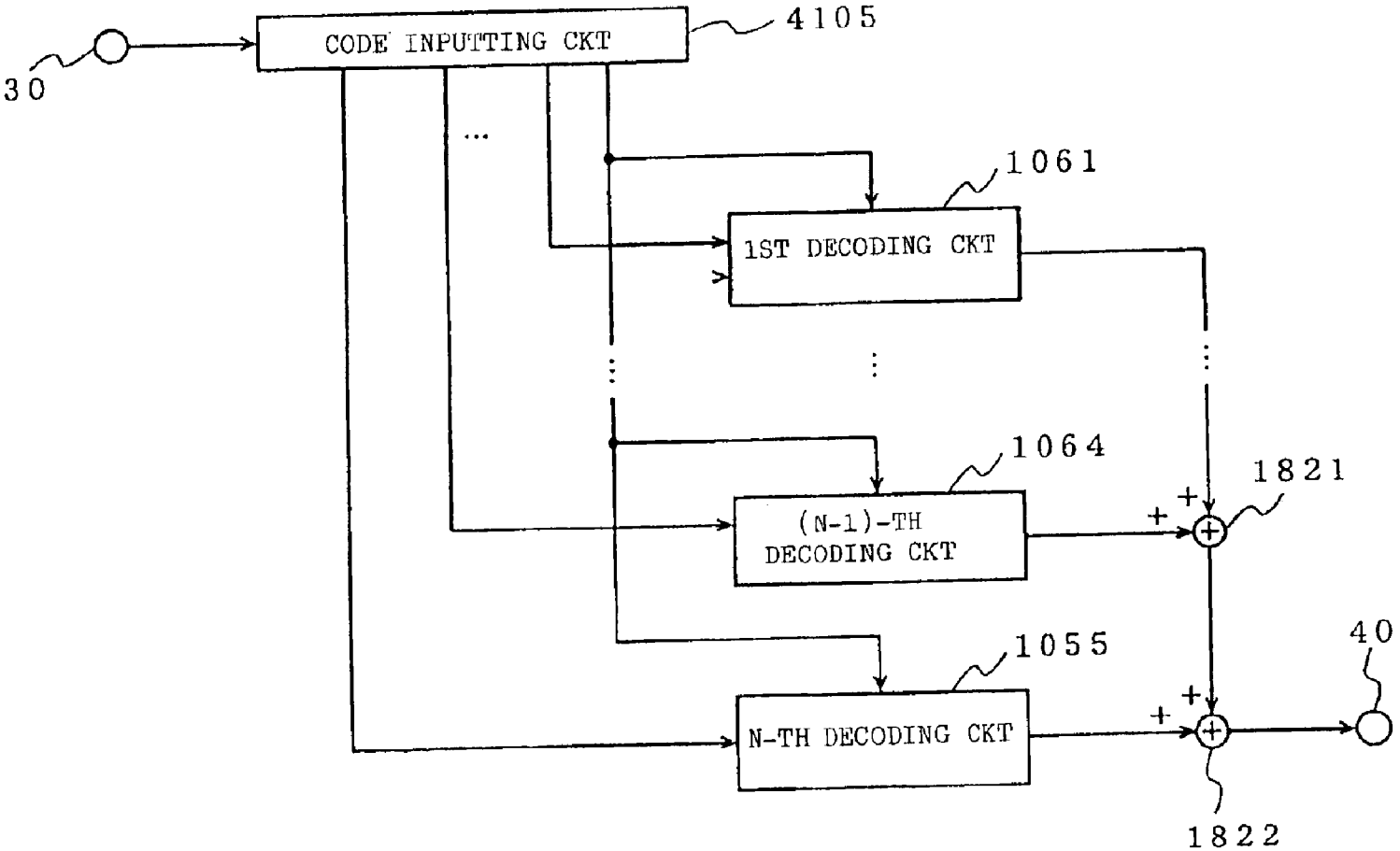
FIG. 28 is a block diagram showing a constitution of a vocal music signal decoding apparatus according to a fourteenth embodiment of the invention.

A fourteenth embodiment of the invention is realized by expanding the number of bands to N in the twelfth embodiment. A constitution of a vocal music signal decoding apparatus according to the fourteenth embodiment of the invention can be represented by a block diagram shown in FIG. 28. In this case, respectives of the first decoding circuit 1061 through an (N−1)-th decoding circuit 1064 are equivalent to FIG. 23 and an N-th decoding circuit 1055 is equivalent to FIG. 23. A code inputting circuit 4105 converts codes in bit series inputted from the input terminal 30 into indexes, outputs an index in correspondence with the quantized linear prediction coefficient to respectives of the first decoding circuit 1061 through the (N−1)-th decoding circuit 1064 and the N-th decoding circuit 1055 and outputs a set of indexes in correspondence with the shape code vectors and the quantization gains with regard to the subvectors to respectives of the first decoding circuit 1061 through the (N−1)-th decoding circuit 1064 and the N-th decoding circuit 1055.

Figure 29:
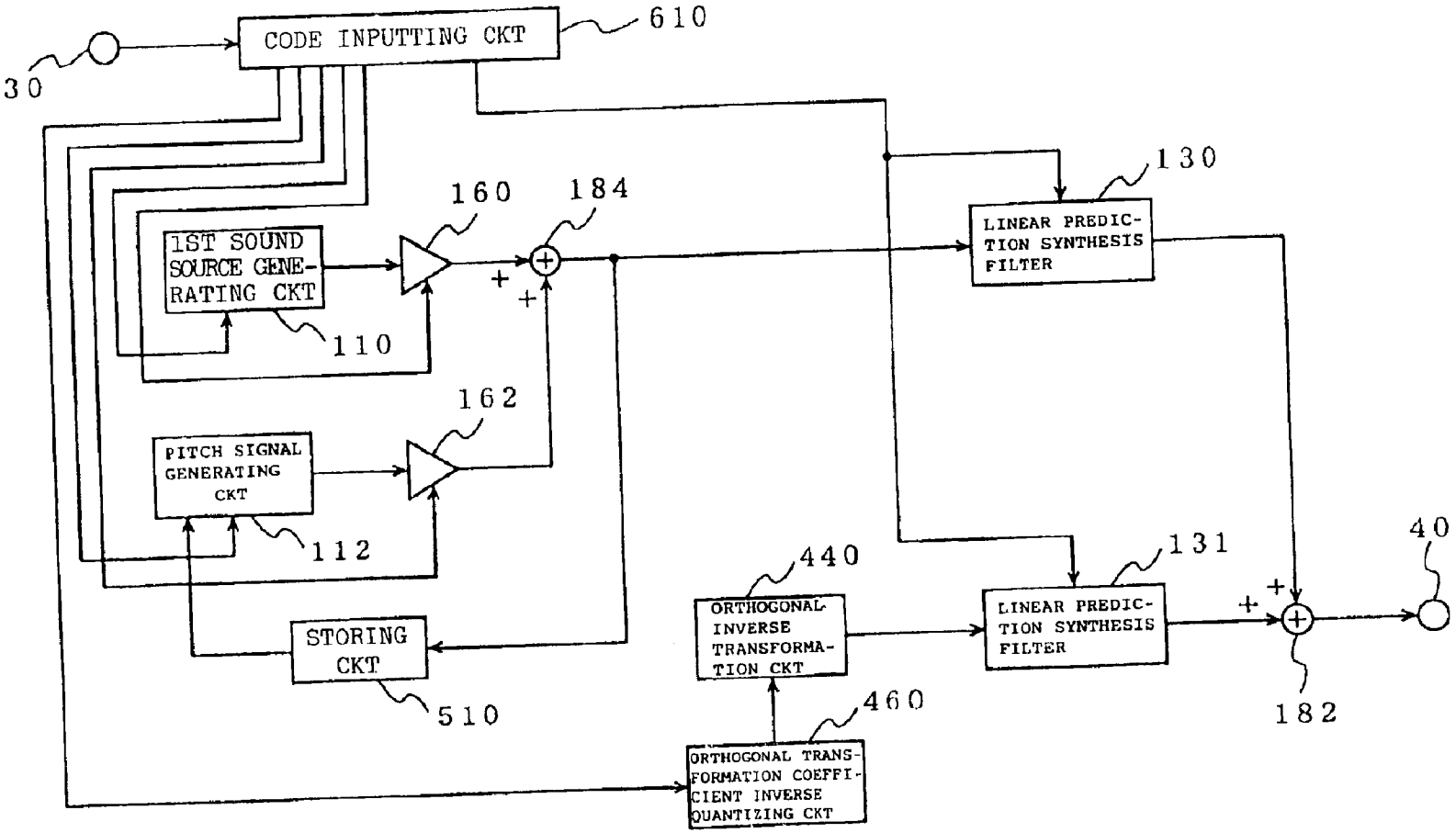
FIG. 29 is a block diagram showing a constitution of a vocal music signal decoding apparatus according to a fifteenth embodiment of the invention.

FIG. 29 is a block diagram showing a constitution of a vocal music signal decoding apparatus in correspondence with the seventh embodiment according to a fifteenth embodiment of the invention. In FIG. 29, blocks different from those in the ninth embodiment in FIG. 18 are the storing circuit 510, the pitch signal generating circuit 112, the third gain circuit 162, the adder 184 and a code inputting circuit 610, however, the storing circuit 510, the pitch signal generating circuit 112, the third gain circuit 162 and the adder 184 are similar to those in FIG. 16 and accordingly, an explanation thereof will be omitted and an explanation will be given of the coding inputting circuit 610.

The code inputting circuit 610 converts codes in bit series inputted from the input terminal 30 into indexes. An index in correspondence with the first sound source vector is outputted to the first sound source generating circuit 110. An index in correspondence with the delay "d" is outputted to the pitch signal generating circuit 112. An index in correspondence with the first gain is outputted to the first gain circuit 160. An index in correspondence with the third gain is outputted to the third gain circuit 162. An index in correspondence with the quantized linear prediction coefficient is outputted to the linear prediction synthesis filter 130 and the linear prediction synthesis filter 131. A set of indexes summarizing indexes in correspondence with respectives of the shape code vectors and the quantization gains with regard to the subvectors for Nsbv pieces of the subvectors, is outputted to the orthogonal transformation coefficient inverse quantizing circuit 460.

Figure 30:
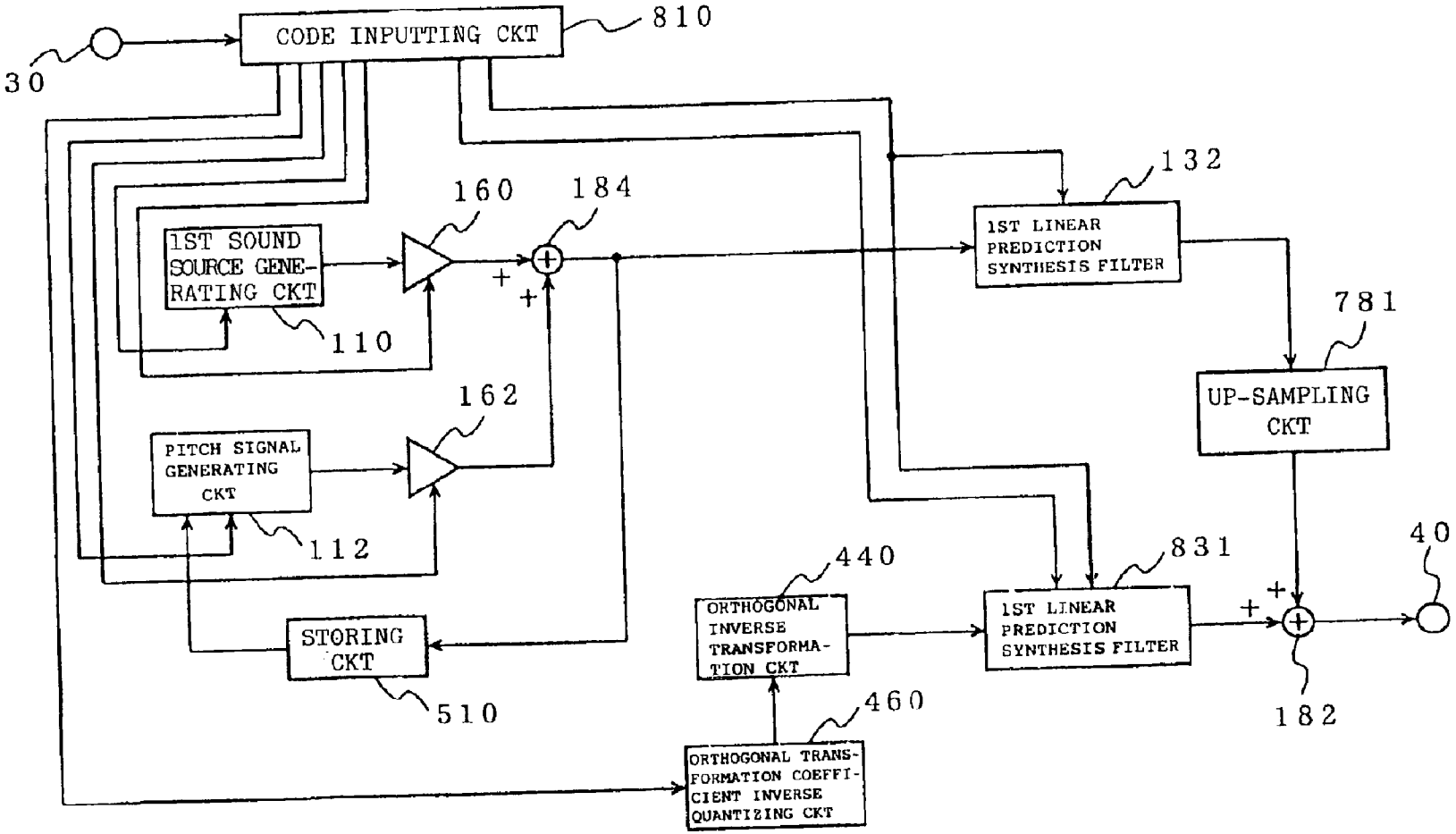
FIG. 30 is a block diagram showing a constitution of a vocal music signal decoding apparatus according to a sixteenth embodiment of the invention.

FIG. 30 is a block diagram showing a constitution of a vocal music signal decoding apparatus in correspondence with the eighth embodiment according to a sixteenth embodiment of the invention. In the following, an explanation will be given of a code inputting circuit 810, the first linear prediction coefficient synthesis filter 132, an up-sampling circuit 781 and a second linear prediction synthesis filter 831 which are blocks different from those in FIG. 29.

The code inputting circuit 810 converts codes in bit series inputted from the input terminal 30 into indexes. An index in correspondence with the first sound source vector is outputted to the first sound source generating circuit 110. An index in correspondence with the delay "d" is outputted to the pitch signal generating circuit 112. An index in correspondence with the first gain is outputted to the first gain circuit 160. An index in correspondence with the third gain is outputted to the third gain circuit 162. An index in correspondence with the first quantized linear prediction coefficient is outputted to the first linear prediction synthesis filter 132 and the second linear prediction synthesis filter 831. An index in correspondence with the third quantized linear prediction coefficient is outputted to the second linear prediction synthesis filter 831. A set of indexes summarizing indexes in correspondence with respectives of the shape code vectors and the quantization gains with regard to the subvectors for Nsbv pieces of the subvectors, is outputted to orthogonal transformation coefficient inverse quantizing circuit 460.

The first linear prediction synthesis filter 132 is provided with a table stored with first quantized linear prediction coefficients. The first linear prediction synthesis filter 132 is inputted with the fifth sound source vector outputted from the adder 184 and the index in correspondence with the first quantized linear prediction coefficient outputted from the code inputting circuit 810. Further, by reading the first quantized linear prediction coefficient in correspondence with the index from the table and driving the synthesis filter set with the first quantized linear prediction coefficient by the fifth sound source vector, the first reproduced vector having the first band is provided. Further, the first reproduced vector is outputted to the up-sampling circuit 781.

The up-sampling circuit 781 inputs the first reproduced vector outputted from the first linear prediction synthesis filter 132, up-samples the first reproduced vector and provides the third reproduced vector having the third band. Further, the third reproduced vector is outputted to the first adder 182.

The second linear prediction synthesis filter 831 is provided with a first table stored with first quantized linear prediction coefficients having the first band and a second table stored with third quantized linear prediction coefficients having the third band. The second linear prediction synthesis filter 831 is inputted with the third excitation vector outputted from the orthogonal inverse transformation circuit 440, the first index in correspondence with the first quantized linear prediction coefficient outputted from the code inputting circuit 810 and the second index in correspondence with the third quantized linear prediction coefficient. The second linear prediction synthesis filter 831 reads the first quantized linear prediction coefficient in correspondence with the first index from the first table, converts the first quantized linear prediction coefficient into LSP, further, subjects the converted first quantized linear prediction coefficient to sampling frequency conversion to thereby generate first LSP in correspondence with the sampling frequency of the third reproduced vector. Further, the third quantized linear prediction coefficient in correspondence with the second index is read from the second table and converted into LSP to thereby generate third LSP. Further, second LSP provided by adding first LSP and third LSP, is converted into the linear prediction coefficient to thereby generate the second linear prediction coefficient. The second linear prediction synthesis filter 831 generates the second reproduced vector having the third band by driving the synthesis filter set with the second linear prediction coefficient by the third excitation vector. Further, the second reproduced vector is outputted to the adder 182.

The adder 182 receives the third reproduced vector outputted from the up-sampling circuit 781 and the second reproduced vector outputted from the second linear prediction synthesis filter 831, calculates a sum of these and outputs the sum as a fourth reproducing vector via the output terminal 40.

Industrial Applicability

According to the invention, a vocal music signal can excellently be coded over all of bands. The reason is that a first reproduction signal is generated by driving a linear prediction synthesis filter calculated from an input signal by a sound source signal having a band characteristic in correspondence with a low region of the input signal, a residual signal is generated by driving an inverse filter of the linear prediction synthesis filter by a differential signal of the input signal and the first reproduction signal and a high region component of the residual signal is coded by using a coding system based on orthogonal transformation and accordingly, coding performance with regard to the high region component of the input signal is improved.

What is claimed is:

1. A speech and music signal coder for producing a reproduction signal by driving a linear prediction synthesis filter in response to an excitation signal which is provided by adding a first excitation signal corresponding to a first band of an input signal and a second excitation signal corresponding to a second band of the input signal, said linear prediction synthesis filter setting with a linear prediction coefficient calculated on the basis of said input signal, said speech and music signal coder comprising: reproduction signal generating means for reproducing a first reproduction signal by driving the linear prediction synthesis filter in response to the excitation signal corresponding to the first band; residual signal generating means for generating a residual signal by driving a linear prediction inverse filter in response to a differential signal indicative of a difference between the input signal and the first reproduction signal and; coding means for coding a component corresponding to the second band in the residual signal after orthogonal transformation of the component.

2. A speech and music signal coder for producing a reproduction signal by driving a linear prediction synthesis filter in response to an excitation signal which is provided by adding 3 pieces of excitation signals corresponding to 3 pieces of bands, said speech and music signal coder comprising, said linear prediction synthesis filter setting with a linear prediction coefficient calculated on the basis of said input signal, said speech and music signal coder comprising: reproduction signal generating means for generating a first and a second reproduction signal by driving the linear prediction synthesis filter in response to the excitation signals corresponding to a first one and a second one of the bands; and coding means for generating a residual signal by driving a linear prediction inverse filter in response to a differential signal indicative of a difference between an added signal produced by adding the first and the second reproduction signals and the input signal and for coding a component corresponding to a third one of the bands in the residual signal after orthogonal transformation of the component.

3. A speech and music signal coder for producing a reproduction signal by driving a linear prediction synthesis filter in response to an excitation signal which is provided by adding N pieces of excitation signals corresponding to N pieces of bands, said speech and music signal coder comprising: reproduction signal generating means for generating a first through an (N−1)-th reproduction signal by driving the linear prediction synthesis filter in response to the excitation signals corresponding to a first through and (N−1)-th band; and N-th coding means for generating a residual signal by driving a linear prediction inverse filter in response to a differential signal indicative of difference between a signal,;produced by adding the first through the (N−1)-th reproduction signals and the input signal and for coding a component corresponding to an N-th band in the residual signal after orthogonal transformation of the component.

4. A speech and music signal coder for producing a reproduction signal by driving a linear prediction synthesis filter in response to an excitation signal which is provided by adding 2 pieces of excitation signals corresponding to 2 pieces of bands, said speech and music signal coder comprising: means for calculating a difference of a first coded decoding signal and the input signal; and coding means for generating a residual signal by driving a linear prediction inverse filter in response to the differential signal and for coding a component corresponding to an arbitrary one of the bands in the residual signal after subjecting the component to orthogonal transformation.

5. A speech and music signal coder for generating a reproduction signal by driving a linear prediction synthesis filter calculated on the basis of an input signal in response to an excitation signal provided by adding 3 pieces of excitation signals corresponding to 3 pieces of bands, said speech and music signal coder comprising: means for calculating a differential signal indicative of difference between a signal produced by adding a first and a second coded decoding signal and the input signal; and coding means for generating a residual signal by driving a linear prediction inverse filter calculated on the basis of the input signal by the differential signal and for coding a component corresponding to an arbitrary band in the residual signal after orthogonal transformation of the component.

6. A speech and music signal coder for producing a reproduction signal by driving a linear prediction synthesis filter in response to an excitation signal which is provided by adding N pieces of excitation signals corresponding to N pieces of bands, said speech and music signal coder comprising: differential signal calculating means for calculating a differential signal indicative of difference between a signal produced by adding a first through an (N−1)-th coded decoding signal and the input signal; and N-th coding means for generating a residual signal by driving an inverse filter of the linear prediction synthesis filter on the basis of the input signal in response the differential signal and for coding a component corresponding to an arbitrary band in the residual after orthogonal transformation of the component.

7. The speech and music signal coder as claimed in claim 1, wherein: a pitch prediction filter is used in generating the excitation signal corresponding to the first band of the input signal.

8. A speech and music signal coder comprising: second input signal generating means for generating a second input signal by down-sampling a first input signal sampled at a first sampling frequency to a second sampling frequency; first reproduction signal generating means for generating a first reproduction signal by driving a synthesis filter set with a first linear prediction coefficient calculated on the basis of the second input signal in response to an excitation signal; second reproduction signal generating means for generating a second reproduction signal by up-sampling the first reproduction signal to the first sampling frequency; third linear prediction coefficient calculating means for calculating a third linear prediction coefficient on the basis of a difference of the first linear prediction coefficient and a second linear prediction coefficient provided by converting a sampling frequency to the first sampling frequency; residual signal generating means for calculating a fourth linear prediction coefficient on the basis of a sum of the second linear prediction coefficient and the third linear prediction coefficient and for generating a residual signal by driving an inverse filter set with the fourth linear prediction coefficient on the basis of a differential signal indicative of difference between the first input signal and the second reproduction signal; and coding means for coding a component corresponding to an arbitrary band in the residual signal after orthogonal transformation of the component.

9. A speech and music signal decoder for generating a reproduction signal by driving a linear prediction synthesis filter in response to an excitation signal provided by adding an excitation signal corresponding to a first band and an excitation signal corresponding to a second band, said speech and music signal decoder comprising: excitation signal generating means for generating the excitation signal corresponding to the second band by subjecting a decoded orthogonal transformation coefficient to orthogonal inverse transformation; second reproduction signal generating means for generating a second reproduction signal by driving the linear prediction synthesis, filter in response to the excitation signal corresponding to the second band; first reproduction signal generating means for generating a first reproduction signal by driving the linear prediction filter in response to the excitation signal corresponding to the first band; and speech and music decoded signal generating means for generating speech and music decoded signal by adding the first reproduction signal and the second reproduction signal.

10. A speech and music signal decoder for generating a reproduction signal by driving a linear prediction synthesis filter in response to an excitation signal provided by adding 3 pieces of excitation signals corresponding to a first through a third band, said speech and music signal decoder comprising: first and second reproduction signal generating means for generating a first and a second reproduction signal by driving the linear prediction filter in response to the excitation signals corresponding to the first and the second bands; third reproduction signal generating means for generating the excitation signal corresponding to the third band by subjecting a decoded orthogonal transformation coefficient to orthogonal inverse transformation, and for generating a third reproduction signal by driving the linear prediction synthesis filter in response to the excitation signal; and speech and music decoded signal generating means for generating a speech and music decoded signal by adding the first through the third reproduction signals.

11. A speech and music signal decoder for generating a reproduction signal by driving a linear prediction synthesis filter in response to an excitation signal provided by adding N pieces of excitation signals corresponding to first through an N-th band, said speech and music signal decoder comprising: N-th reproduction signal generating means for generating an excitation signal corresponding to the N-th band by subjecting a decoded orthogonal transformation coefficient to orthogonal inverse transformation and for generating an N-th reproduction signal by driving the linear prediction synthesis filter in response to the excitation signal; first through (N−1)-th reproduction signal generating means for generating a first through an (N−1)-th reproduction signal by driving the linear prediction filter in response to the excitation signals corresponding to the first through the (N−1)-th bands; and speech and music decoded signal generating means for generating a speech and music decoded signal by adding the first through the N-th reproduction signals.

12. A speech and music signal decoder for generating a reproduction signal by driving a linear prediction synthesis filter in response to an excitation signal provided by adding excitation signals corresponding to a first and a second band, said speech and music signal decoder comprising: reproduction signal generating means for generating an excitation signal by subjecting a decoded orthogonal transformation coefficient to orthogonal inverse transformation and for generating a second reproduction signal by driving a linear prediction synthesis filter by the excitation signal; and speech and music decoded signal generating means for generating a speech and music decoded signal by adding the second reproduction signal and a first reproduction signal from first reproduction signal generating means.

13. A speech and music signal decoder for generating a reproduction signal by driving a linear prediction synthesis filter in response to an excitation signal provided by adding excitation signals corresponding to a first through a third band, said speech and music signal decoder comprising: third reproduction signal generating means for generating the excitation signal by subjecting a decoded orthogonal transformation coefficient to orthogonal inverse transformation and for generating a third reproduction signal by driving the linear prediction synthesis filter in response to the excitation signal; and speech and music signal generating means for generating a speech and music signal by adding a first and a second reproduction signal respectively outputted from first and second reproduction signal generating means.

14. A speech and music signal decoder for generating a reproduction signal by driving a linear prediction synthesis filter in response to an excitation signal provided by adding N pieces of excitation signals corresponding to a first through an N-th band; N-th reproduction signal generating means for generating the excitation signal by subjecting a decoded orthogonal transformation coefficient to orthogonal inverse transformation and for generating an N-th reproduction signal by driving the linear prediction synthesis filter in response to the excitation signal; and speech and music decoded signal generating means for generating a speech and music decoded signal by adding the N-th reproduction signal and a first through an (N−1)-th reproduction signal.

15. A speech and music signal decoder as claimed in claim 9, wherein a pitch prediction filter is used in generating the excitation signal corresponding to the first band.

16. A speech and music signal decoder comprising: first reproduction signal generating means for up-sampling a signal provided by driving a first linear prediction synthesis filter in response to a first excitation signal corresponding to a first band to a first sampling frequency and for generating a reproduction signal; second reproduction signal generating means for generating a second excitation signal corresponding to a second band by subjecting a decoded orthogonal transformation coefficient to orthogonal inverse transformation and for generating a second reproduction signal by driving a second linear prediction synthesis filter in response to the second excitation signal; and speech and music decoded signal by adding the first and the second reproduction signal.

17. A speech and music signal coding/decoding apparatus comprising:

a speech and music signal coder that produces a coded signal by driving a first linear prediction synthesis filter in response to a first excitation signal which is provided by adding a first signal corresponding to a first band of an input signal and a second signal corresponding to a second band of the input signal, said linear prediction synthesis filter being set with a linear prediction coefficient calculated on the basis of said input signal, said speech and music signal coder comprising:

a reproduction signal generating circuit producing a reproduction signal by driving the first linear prediction synthesis filter in response to the first signal corresponding to the first band of the input signal;

a residual signal generating circuit generating a residual signal by driving a linear prediction inverse filter in response to a differential signal indicative of a difference between the first input signal and the reproduction signal; and a coding circuit coding a component corresponding to the residual signal after orthogonal transformation of the component; and a speech and music signal decoder that decodes the coded signal of the signal coder by driving a second linear prediction synthesis filter in response to a second excitation signal provided by adding a first signal corresponding to a first band of the second excitation signal and a second signal corresponding to a second band of the second excitation signal, said speech and music signal decoder comprising:

an excitation signal generating circuit generating the second signal corresponding to the second band of the second excitation signal by subjecting a decoding signal and an orthogonal transformation coefficient to orthogonal inverse transformation;

a second reproduction signal generating circuit generating a second reproduction signal by driving the second linear prediction synthesis filter in response to the second excitation signal;

a third reproduction signal generating circuit generating a third reproduction signal by driving the second linear prediction synthesis filter in response to the first signal corresponding to the first band of the second excitation signal; and a speech and music decoded signal generating circuit generating a speech and music decoded signal by adding the second reproduction signal and the third reproduction signal.

18. A speech and music signal coding/decoding apparatus comprising:

a speech and music signal coder that produces a coded signal by driving a first linear prediction synthesis filter in response to a first excitation signal which is provided by adding 3 pieces of excitation signals corresponding to 3 pieces of bands, said first linear prediction synthesis filter being set with a linear prediction coefficient calculated on the basis of an input signal, said speech and music signal coder comprising:

a first reproduction signal generating circuit generating a first and a second reproduction signal by driving the first linear prediction synthesis filter in response to the excitation signals corresponding to a first one and a second one of the bands; and a coding circuit generating a residual signal by driving a linear prediction inverse filter in response to a differential signal indicative of a difference between an added signal produced by adding the first and the second reproduction signals and the input signal and coding a component corresponding to a third one of the bands in the residual signal after orthogonal transformation of the component; and a speech and music signal decoder that decodes the coded signal of the signal coder by driving a second linear prediction synthesis filter in response to a second excitation signal provided by adding 3 pieces of excitation signals corresponding to a first through a third band, said speech and music signal decoder comprising:

a second reproduction signal generating circuit generating a third and a fourth reproduction signal by driving the second linear prediction filter in response to the second excitation signals corresponding to the first and the second bands;

a third reproduction signal generating circuit generating the second excitation signal corresponding to the third band by subjecting a decoded orthogonal transformation coefficient to orthogonal inverse transformation, and generating a fifth reproduction signal by driving the second linear prediction synthesis filter in response to the second excitation signal; and a speech and music decoded signal generating circuit generating a speech and music decoded signal by adding the third through the fifth reproduction signals.

19. A speech and music signal coding/decoding apparatus comprising:

a speech and music signal coder that produces a coded signal by driving a first linear prediction synthesis filter in response to a first excitation signal which is provided by adding N pieces of excitation signals corresponding to N pieces of bands of an input signal, said speech and music signal coder comprising:

a first reproduction signal generating circuit generating a first through an (N−1)-th first reproduction signal by driving the first linear prediction synthesis filter in response to the first excitation signals corresponding to a first through an (N−1)-th band; and an N-th coding circuit generating a residual signal by driving a linear prediction inverse filter in response to a differential signal indicative of a difference between a signal produced by adding the first through the (N−1)-th first reproduction signals and the input signal and coding a component corresponding to an N-th band in the residual signal after orthogonal transformation of the component; and a speech and music signal decoder that decodes the coded signal of the signal coder by driving a second linear prediction synthesis filter in response to a second excitation signal provided by adding N pieces of excitation signals corresponding to first through an N-th band, said speech and music signal decoder comprising:

an N-th reproduction signal generating circuit generating a reproduction signal corresponding to the N-th band by subjecting a decoded orthogonal transformation coefficient to orthogonal inverse transformation and generating an N-th reproduction signal by driving the second linear prediction synthesis filter in response to the second excitation signal;

a first through (N−1)-th second reproduction signal generating circuit generating a first through an (N−1)-th second reproduction signal by driving the second linear prediction synthesis filter in response to the second excitation signals corresponding to the first through the (N−1)-th bands; and a speech and music decoded signal generating circuit generating a speech and music decoded signal by adding the first through the (N−1)-th second reproduction signals.

20. A speech and music signal coding/decoding apparatus comprising:

a speech and music signal coder that produces a coded signal by driving a first linear prediction synthesis filter in response to a first excitation signal which is provided by adding 2 pieces of excitation signals corresponding to 2 pieces of bands, said speech and music signal coder comprising:

a difference circuit calculating a difference of a first coded decoding signal and an input signal; and a coding circuit generating a residual signal by driving a linear prediction inverse filter in response to the differential signal and coding a component corresponding to an arbitrary one of the bands in the residual signal after subjecting the component to orthogonal transformation; and a speech and music signal decoder that decodes the coded signal of the signal coder by driving a second linear prediction synthesis filter in response to a second excitation signal provided by adding excitation signals corresponding to a first and a second band, said speech and music signal decoder comprising:

a reproduction signal generating circuit generating a first reproduction signal by subjecting a decoded orthogonal transformation coefficient to orthogonal inverse transformation and generating a second reproduction signal by driving a third linear prediction synthesis filter by the first reproduction signal; and a speech and music decoded signal generating circuit generating a speech and music decoded signal by adding the second reproduction signal and the first reproduction signal from reproduction signal generating circuit.

21. A speech and music signal coding/decoding apparatus comprising:

a speech and music signal coder that produces a coded signal by driving a first linear prediction synthesis filter in response to an excitation signal provided by adding 3 pieces of excitation signals corresponding to 3 pieces of bands of an input signal, said speech and music signal coder comprising:

a difference circuit calculating a differential signal indicative of difference between a signal produced by adding a first and a second coded decoding signal and the input signal; and a coding circuit generating a residual signal by driving a linear prediction inverse filter calculated on the basis of the input signal and the differential signal, and coding a component corresponding to an arbitrary band in the residual signal after orthogonal transformation of the component; and a speech and music signal decoder that decodes the coded signal of the signal coder by driving a second linear prediction synthesis filter in response to a second excitation provided by adding excitation signals corresponding to a first through a third band, said speech and music signal decoder comprising:

a first reproduction signal generating circuit generating a first reproduction signal by subjecting a decoded orthogonal transformation coefficient to orthogonal inverse transformation;

a second reproduction signal generating circuit generating a second reproduction signal by driving the second linear prediction synthesis filter in response to the first reproduction signal; and a speech and music signal generating circuit generating a speech and music signal by adding the first and a second reproduction signals generated by the first and second reproduction signal generating circuit.

22. A speech and music signal coding/decoding apparatus comprising:

a speech and music signal coder that produces a coded signal by driving a first linear prediction synthesis filter in response to a first excitation signal which is provided by adding N pieces of excitation signals corresponding to N pieces of bands of an input signal, said speech and music signal coder comprising:

a differential signal calculating circuit calculating a differential signal indicative of difference between a signal produced by adding a first through an (N−1)-th coded decoding signal and the input signal; and an N-th coding circuit generating a residual signal by driving an inverse filter of the first linear prediction synthesis filter on the basis of the input signal in response the differential signal and coding a component corresponding to an arbitrary band in the residual signal after orthogonal transformation of the component; and a speech and music signal decoder that decodes the coded signal of the signal coder by driving a second linear prediction synthesis filter in response to a second excitation signal provided by adding N pieces of excitation signals corresponding to a first through an N-th band; said speech and music signal decoder comprising:

an N-th reproduction signal generating circuit generating a first reproduction signal by subjecting a decoded orthogonal transformation coefficient to orthogonal inverse transformation and generating an N-th reproduction signal by driving the second linear prediction synthesis filter in response to the first reproduction signal; and a speech and music decoded signal generating circuit generating a speech and music decoded signal by adding the N-th reproduction signal and a first through an (N−1)-th reproduction signal.

23. A speech and music signal coding/decoding apparatus as claimed in claim 17, wherein:

the speech and music signal coder further comprises a first pitch prediction filter that generates the first signal corresponding to the first band of the input signal; and the speech and music signal decoder further comprises a second pitch prediction filter that generates the first signal corresponding to the first band of the second excitation signal.

24. A speech and music signal coding/decoding apparatus comprising:

a speech and music signal coder comprising:

an input signal generating circuit generating an input signal by down-sampling a sampling signal sampled at a first sampling frequency to a second sampling frequency;

a first reproduction signal generating circuit generating a first reproduction signal by driving a synthesis filter set with a first linear prediction coefficient calculated on the basis of the input signal in response to a first excitation signal;

a second reproduction signal generating circuit generating a second reproduction signal by up-sampling the first reproduction signal to the first sampling frequency;

a linear prediction coefficient calculating circuit calculating a first linear prediction coefficient on the basis of a difference between a second linear prediction coefficient and a third linear prediction coefficient provided by converting a sampling frequency to the first sampling frequency;

a residual signal generating circuit calculating a fourth linear prediction coefficient on the basis of a sum of the third linear prediction coefficient and the first linear prediction coefficient and generating a residual signal by driving an inverse filter set with a fourth linear prediction coefficient calculated on the basis of a differential signal indicative of difference between the sampling signal and the second reproduction signal; and a coding circuit coding a component corresponding to an arbitrary band in the residual signal after orthogonal transformation of the component; and a speech and music signal decoder comprising:

a third reproduction signal generating circuit up-sampling a signal provided by driving a second linear prediction synthesis filter in response to a second excitation signal corresponding to a first band to a third sampling frequency and generating a third reproduction signal;

a fourth reproduction signal generating circuit generating a second excitation signal corresponding to a second band by subjecting a decoded orthogonal transformation coefficient to orthogonal inverse transformation and generating a fourth reproduction signal by driving a third linear prediction synthesis filter in response to the second excitation signal; and a speech and music decoded signal generating circuit generating a speech and music decoded signal by adding the third and the fourth reproduction signal.

* * * * *